US007225648B2

(12) United States Patent
Lai et al.

(10) Patent No.: US 7,225,648 B2
(45) Date of Patent: Jun. 5, 2007

(54) PADLOCK WITH FULLY INTEGRATED DUAL LOCKING SYSTEM WITH INDICATOR/SIGNAL ASSEMBLY

(75) Inventors: Eric Lai, Hong Kong (HK); Karl Lai, Hong Kong (HK)

(73) Assignee: The Sun Lock Company Ltd., Hong Kong (HK)

( * ) Notice: Subject to any disclaimer, the term of this patent is extended or adjusted under 35 U.S.C. 154(b) by 0 days.

(21) Appl. No.: 11/244,685

(22) Filed: Oct. 6, 2005

(65) Prior Publication Data

US 2006/0150690 A1 Jul. 13, 2006

Related U.S. Application Data

(63) Continuation-in-part of application No. 10/850,838, filed on May 21, 2004, now Pat. No. 7,140,209.

(60) Provisional application No. 60/517,006, filed on Nov. 4, 2003.

(51) Int. Cl.
*E05B 37/02* (2006.01)
*E05B 37/06* (2006.01)

(52) U.S. Cl. ..... 70/21; 70/25

(58) Field of Classification Search ..... 70/20–48, 70/284–285, 432, 435, 437, 439–441
See application file for complete search history.

(56) References Cited

U.S. PATENT DOCUMENTS 340,427 A * 4/1886 De La Hooke ..... 70/437
2,227,803 A * 1/1941 Bales ..... 70/264
2,793,522 A * 5/1957 Tornoe ..... 70/432
3,824,819 A * 7/1974 Neary ..... 70/432
5,727,405 A * 3/1998 Cromwell ..... 70/38 B
6,100,802 A * 8/2000 Adams ..... 340/542
6,516,643 B1 * 2/2003 Olshausen ..... 70/337
7,007,521 B1 * 3/2006 Misner et al. ..... 70/21
7,100,401 B2 * 9/2006 Yu ..... 70/21
2002/0088256 A1 * 7/2002 Taylor et al. ..... 70/25
2004/0226324 A1 * 11/2004 Loughlin et al. ..... 70/25
2004/0255624 A1 * 12/2004 Loughlin et al. ..... 70/56
2005/0039501 A1 * 2/2005 Yu ..... 70/29
2005/0262903 A1 * 12/2005 Ling et al. ..... 70/21
2006/0260369 A1 * 11/2006 Lai et al. ..... 70/38 C
2006/0266084 A1 * 11/2006 Kuo et al. ..... 70/21

* cited by examiner

*Primary Examiner*—Brian E. Glessner
*Assistant Examiner*—Kristina Gluchowski
(74) *Attorney, Agent, or Firm*—Melvin I. Stoltz

(57) ABSTRACT

By providing two separate and independent locking systems formed in a single padlock, with both locking systems independently enabling the single shackle to be released and/or lockingly engaged, in combination with a signal/indicator system constructed to provide a positive notification when one of said systems is employed, an effective, easily produced, multi-purpose signal providing padlock is achieved. In the preferred embodiment, a single housing and shackle assembly are employed and constructed for enabling the shackle to be released from locked engagement with the housing using either a rotatable dial combination construction or a key activating tumbler construction. In addition, a signal/indicator is activated whenever the key controlled locking section is employed with the signal/indicator being locked in position, for resetting by only the user/owner.

18 Claims, 36 Drawing Sheets

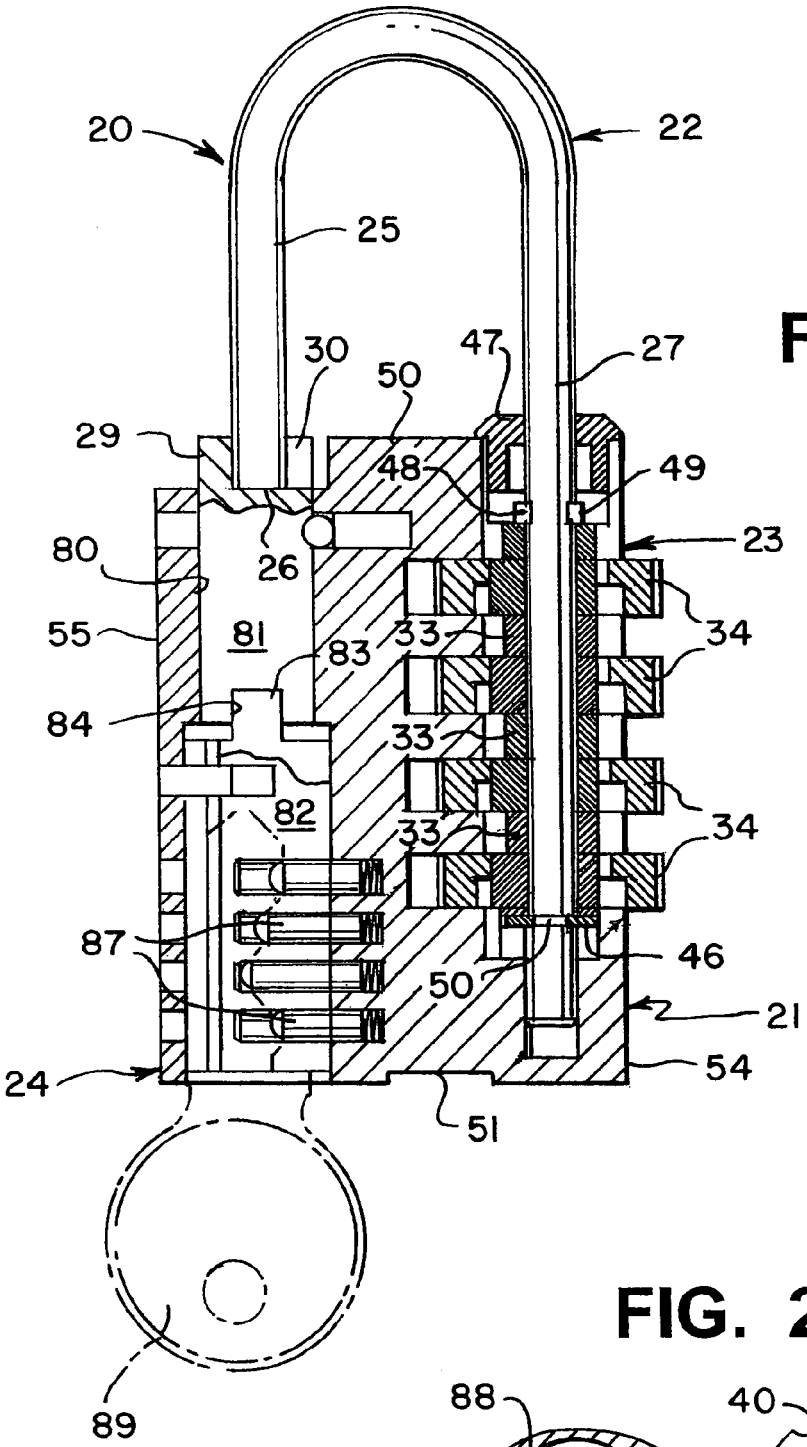
FIG. 1
FIG. 2
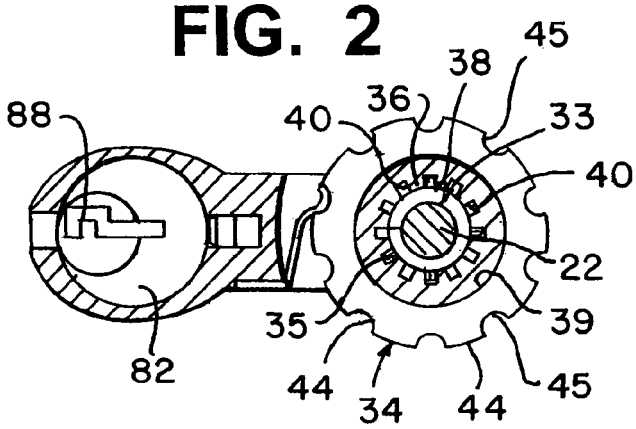

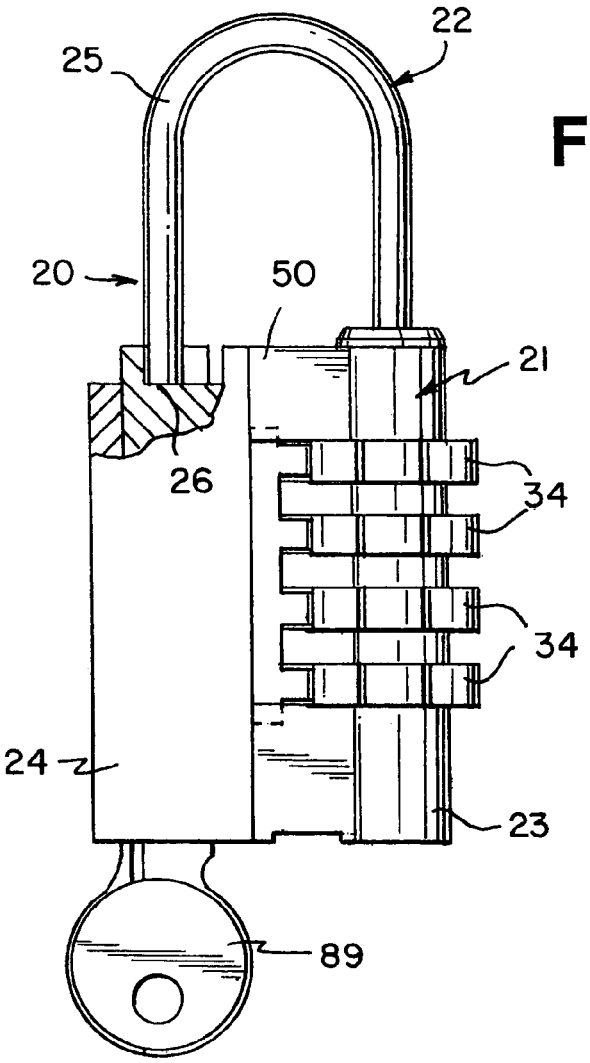
FIG. 3
FIG. 4
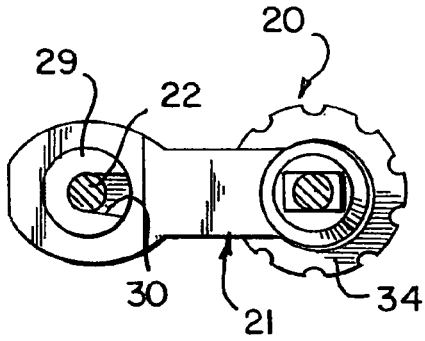
FIG. 7
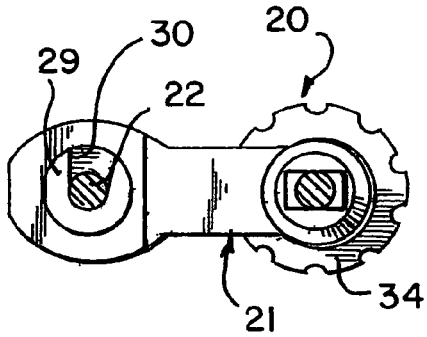
FIG. 9
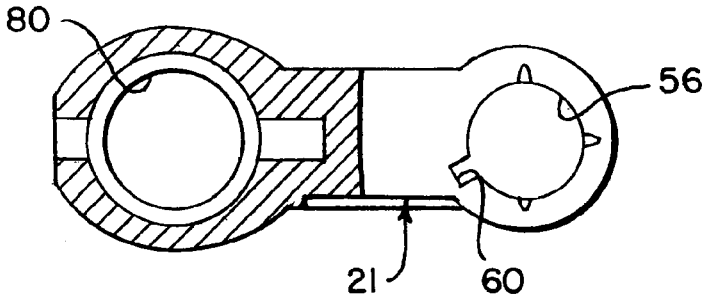

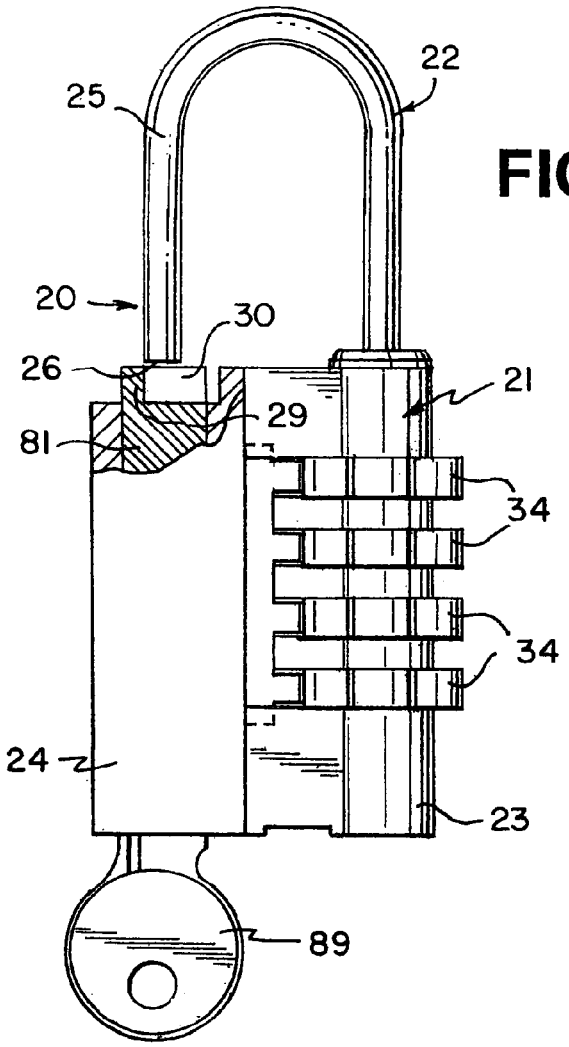
FIG. 5
FIG. 6
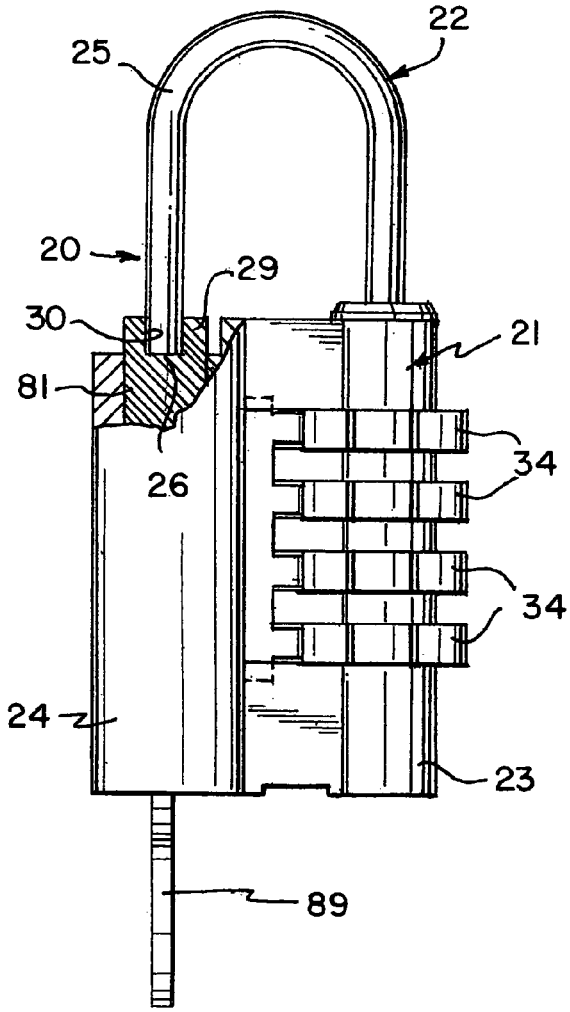

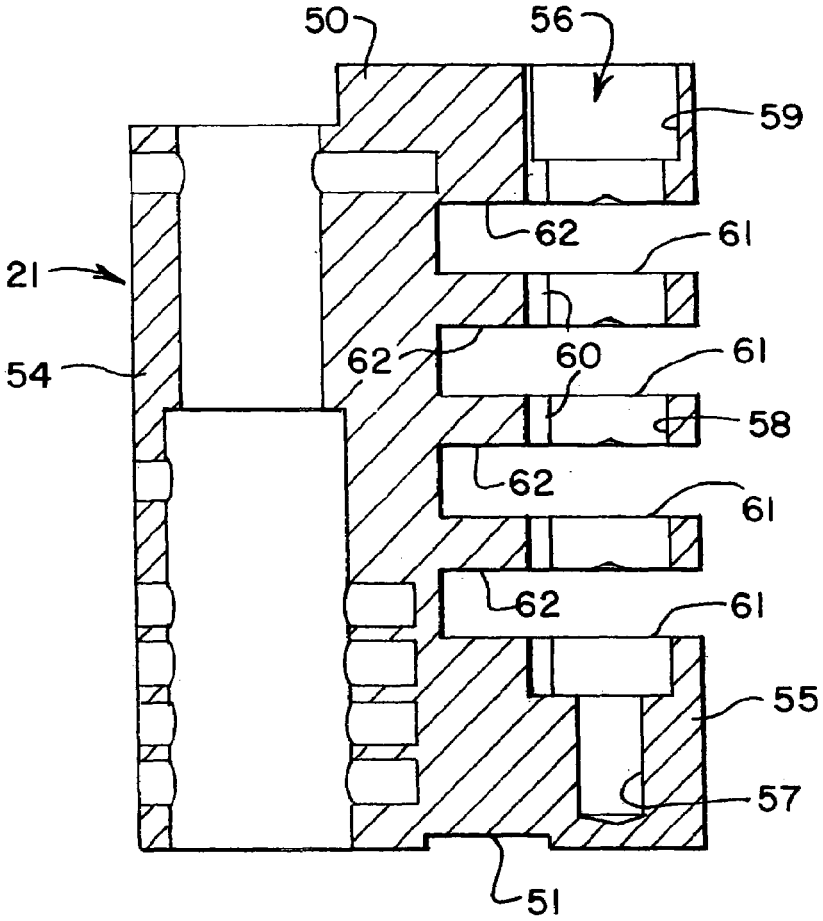
FIG. 8
FIG. 10
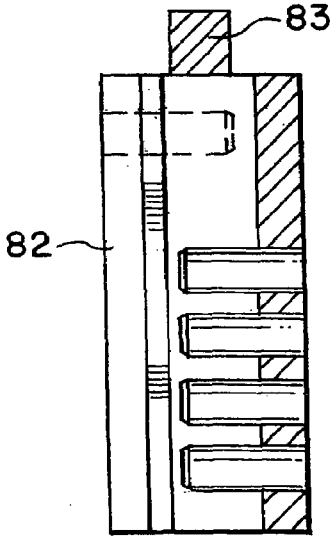
FIG. 11
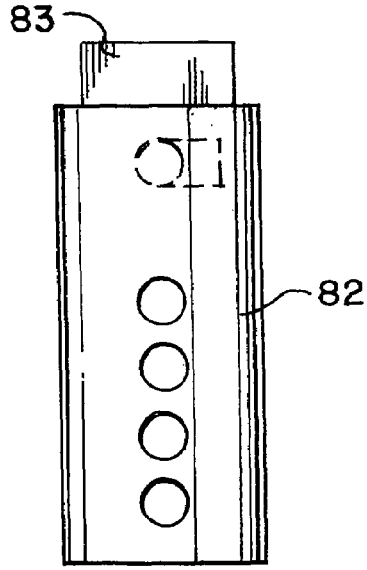

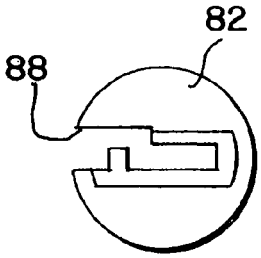
FIG. 12
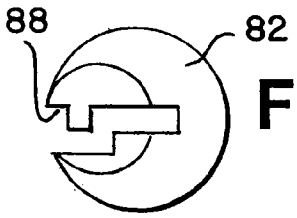
FIG. 13
FIG. 14
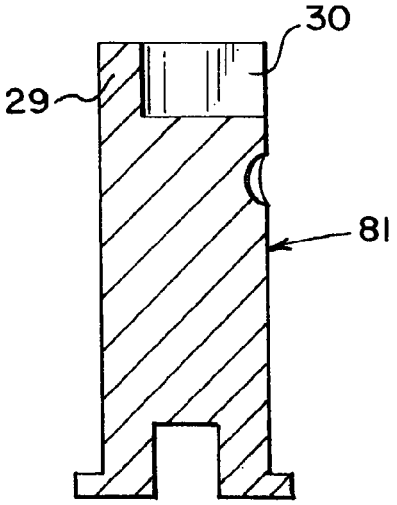
FIG. 15
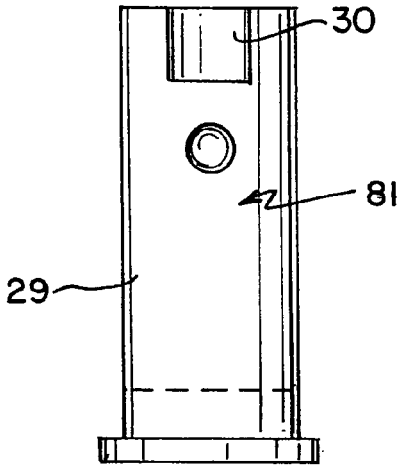
FIG. 16
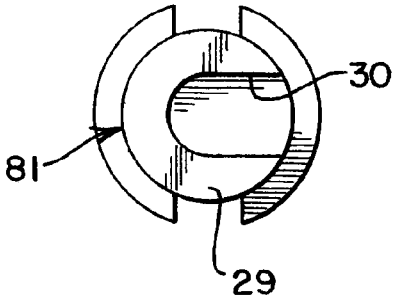
FIG. 17
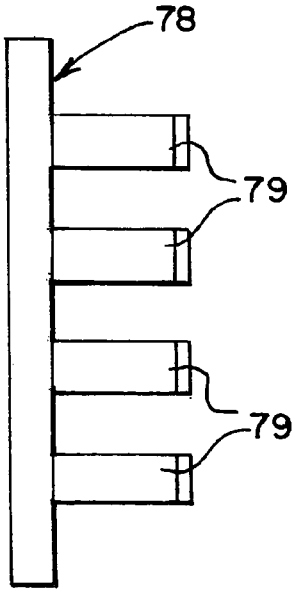
FIG. 18
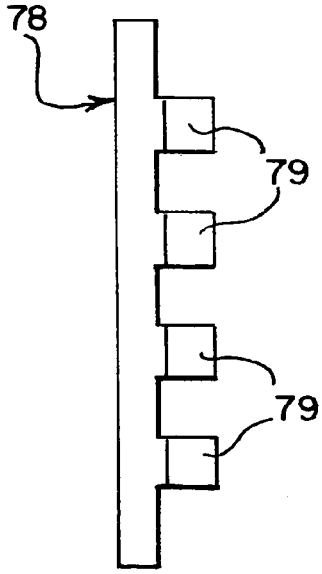
FIG. 19
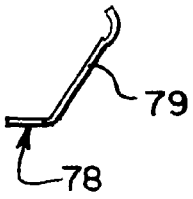

20
22
23
35
234
126
232
21
127
130
233
157
235
231
212
24
228
227
220
111
100
220
212
130
229
214
214
219
210
224
112
221
226
210
222
219
218
211
225
221
218
213
128
166
211
225
213

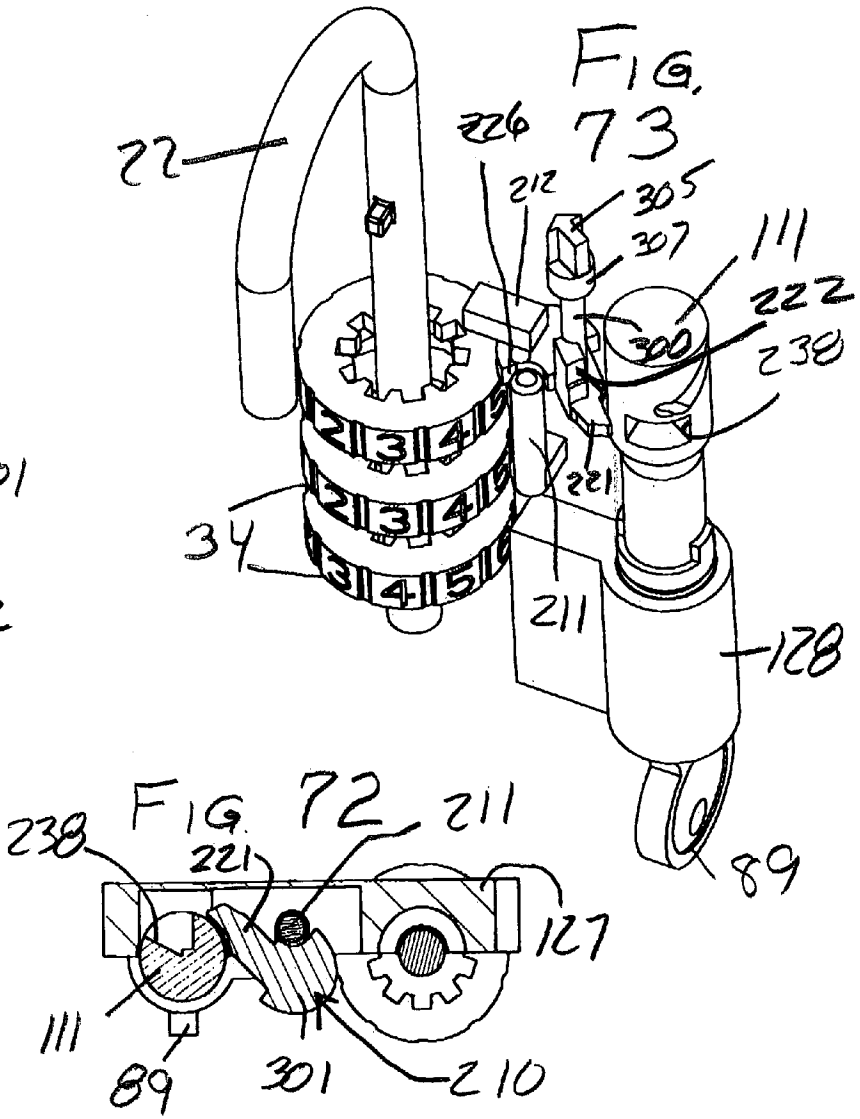
FIG. 73
22
34
226
212
305
307
111
222
230
220
221
211
128
89
FIG. 72
211
127
210
301
221
89
230
111
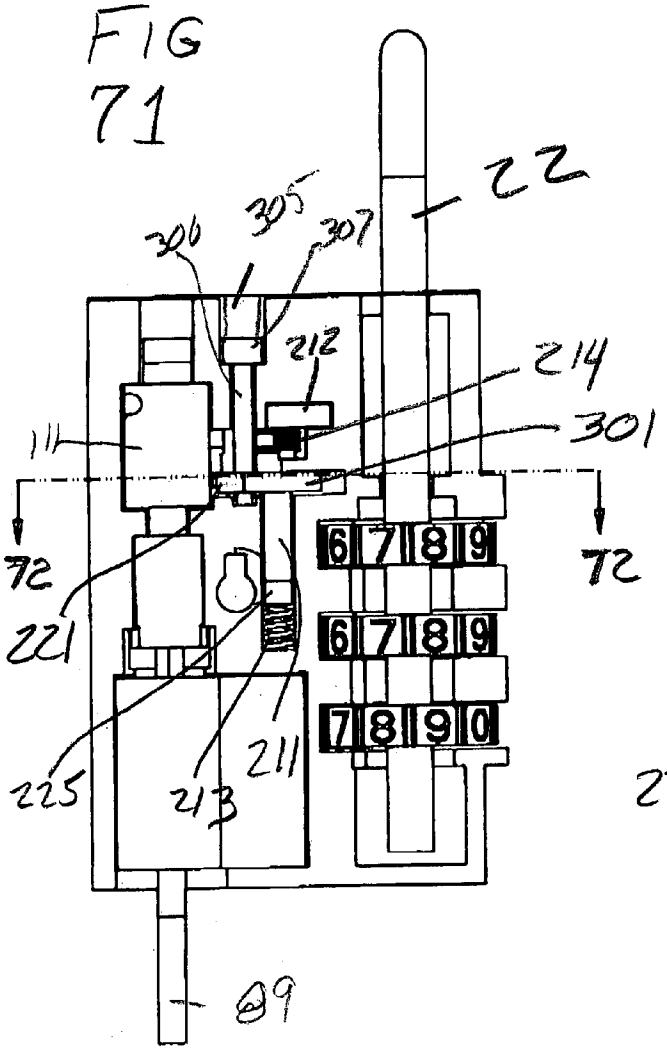
FIG 71
22
214
301
72
212
307
305
206
111
221
225
213
211
89

PADLOCK WITH FULLY INTEGRATED DUAL LOCKING SYSTEM WITH INDICATOR/SIGNAL ASSEMBLY

RELATED APPLICATIONS

This application is a continuation-in-part patent application of U.S. Ser. No. 10/850,838, filed May 21, 2004 now U.S. Pat. No. 7,140,209 entitled PADLOCK WITH FULLY INTEGRATED DUAL LOCKING MODES which is related to U.S. Provisional Patent Application Ser. No. 60/517,006, filed Nov. 4, 2003 entitled PADLOCK WITH DUAL LOCKING MODES.

TECHNICAL FIELD

This invention relates to padlocks and lock systems and, more particularly, to padlocks constructed to provide two separate an independent modes by which the padlock can be opened and closed, while also providing an automatically activated indicator or signal whenever the padlock has been opened using one specific mode.

BACKGROUND ART

Numerous padlock constructions have been developed and are widely employed by individuals to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence. Although locks of this general nature have been available for several decades, these prior art combination lock constructions suffer from common deficiencies which have not been successfully overcome.

Although many manufacturers have attempted to solve the problems associated with rotatable dial or combination locks, one principal difficulty and drawback these prior art constructions have been unable to overcome is a construction which assures the user that a preset combination will not be accidentally or inadvertently altered or changed, without the user's knowledge. In such instances when the known combination is unknowingly changed or altered without the user's knowledge, the entire combination lock is incapable of future use, since the user is typically unable to release the shackle from locked engagement with the housing.

In addition, although key operated locks do not suffer from the difficulty of having the combination changed or altered without the user's knowledge, users are frequently incapable of using key operated locks, due to the key being lost or misplaced. As a result, prior art key operated locks are also frequently discarded due to the user's inability to find a particular key for operating the lock.

Another common problem which has consistently plagued prior art constructions is the cost of construction for producing and assembling prior art padlocks, whether the padlock is key operated or combination operated. In order to attain a padlock which provides all of the features desired by consumers, prior art constructions typically incorporate numerous small components, each of which require expensive assembly procedures to produce the final product. As a result, these prior art lock constructions are expensive to produce, thereby reducing the ability of these locks to reach a broad base of consumers.

Another problem commonly found with prior art padlocks is the inability of these prior art constructions to prevent contaminants from reaching the rotatable, internal component of the lock, thereby causing damage to these components or interfering with the ease of operating the lock by an individual who either knows the actual combination or has the activating key. Although numerous attempts have been made to reduce the adverse effects caused by contaminants reaching these components, such attempts have been incapable of completely eliminating in this problem.

A final, still further difficulty, which has recently arisen and affects both combination locks and key operated locks, is a requirement that all secured locks must be broken by Customs officers, and/or inspection or security personnel in order to gain access to luggage which is deemed suspicious. Under new security regulations that is being implemented, all luggage must be scanned or inspected to prevent the transportation of potentially dangerous items or products which are deemed to be undesirable. In those instances when luggage is scanned and further visual inspection is required, the inspectors have the authority to open the luggage for visual inspection, including physically breaking any lock which may be on the luggage.

Consequently, with these new regulations presently implemented, all prior art lock systems which are incapable of being opened by inspectors and/or security personnel are subject to be physically broken, in order to gain access to any luggage which needs to be visually inspected. As a result, consumers will now be faced with the possibility that any lock system employed to protect the contents of a suitcase can be physically removed by security personnel, leaving the luggage completely unprotected during the remainder of the trip.

In addition, although some prior art locks do provide a dual locking system for enabling security personnel to gain access to the lock, when necessary, a further problem has been created. In this regard, consumers wish to know when security personnel have opened their luggage in order to gain access to the interior thereof. Since the dual locking systems enable security personnel to open the luggage, inspect the contents, and reclose and lock the suitcase, consumers have no knowledge as to what action, if any, has been taken by security personnel. As a result, in addition to having locks which incorporate dual locking modes, consumers also seek to have these locks incorporate an automatically initiated indicator or signal which will inform the consumer whenever the lock has been opened using the key portion of the lock.

Although some preliminary attempts to satisfy this need have been made by prior art systems, the prior art systems have been incapable of providing an easily initiated, reliable, positive indicator or signal. In particular, these prior art products fail to provide an easily seen positive indicator/signal which provide consumers with the positive notice desired. Furthermore, these prior art products are extremely complicated, requiring numerous components for achieving the end result.

In addition, many such prior art products require the consumer to input the predetermined combination into the lock in order to release the shackle for resetting the signaling device. This often requires the consumer to open their locks in areas where an observer would be able to see the combination, and use that combination to the detriment of the consumer.

Therefore, it is the principal object of the present invention to provide a padlock having a fully integrated dual locking system which also incorporates a positive indicator or signal for informing the consumer whenever the key portion of the padlock has been employed.

Another object of the present invention is to provide a padlock having the characteristic features described above which is easily produced and provides the user with complete control over the resetting of the indicator.

Another object of the present invention is to provide a padlock having the characteristic features described above which provides an indicator or signal which is highly visible and easily seen by the user.

A further object of the present invention is to provide a padlock having the characteristic features described above which requires a separate key for resetting the indicator or signal and enables the user to reset the indicator or signal while the lock is completely closed and locked.

Other and more specific objects will in part be obvious and will in part appear hereinafter.

SUMMARY OF THE INVENTION

By employing the present invention, all of the difficulties and drawbacks of the prior art constructions are virtually eliminated and an effective, easily produced, padlock is achieved which incorporates two separate and independent locking systems formed in a single padlock, with both locking systems independently enabling the single shackle to be released and/or lockingly engaged. In this way, by using the key activating feature, a user is assured of the ability to release the shackle from locked engagement whenever the combination is forgotten, altered or changed without the user's knowledge. Similarly, whenever the key is lost or misplaced, the user is still able to release the shackle from locked engagement with the housing by employing the known combination.

In accordance with the present invention, a single housing and shackle assembly are employed and constructed for enabling the shackle to be released from locked engagement with the housing using either a rotatable dial combination construction or a key activating tumbler construction. In this way, a dual locking and releasing padlock is achieved which virtually eliminates the difficulties typically encountered with known, prior art lock configurations.

In each of the two preferred embodiments of the present invention, a generally conventional J-shaped shackle is employed with one portion of the housing cooperatively associated with the longer leg of the shackle. In addition, this portion of the housing is also constructed with rotatable, combination defining dials which control the axial movement of the longer leg of the shackle. In this way, axial movement of the shackle in the housing is completely controlled by the rotatable, combination defining dials, enabling the locking and releasing of the shackle relative to the housing by employing the known combination.

Directly adjacent the combination lock portion of the housing is the key activating portion of the housing. This portion is constructed for lockingly engaging and releasing the short leg of the shackle. By incorporating into the housing a tumbler and rotatable chamber lock assembly, which is responsive to the cuts on a key for positioning the tumblers to be properly aligned for enabling the chamber to be rotatable, controlled movement of a shackle engaging cavity is achieved, which either lockingly engages the shackle to the housing or releases the shackle for rotatable movement relative to the housing.

By employing the dual locking mode system of the present invention, all of the difficulties and drawbacks found in prior art constructions are overcome. In the present invention, the user is capable of employing either of two separate and independent shackle controlling locking systems for releasing the shackle from locked engagement with the housing whenever release is desired. As a result, if the control system for one of the locking modes is not available, the second mode can be employed for completely operating the padlock in the desired manner.

In addition, by employing the dual locking constructions of the present invention, all of the difficulties and drawbacks which travelers face under newly enacted regulations are completely overcome. As detailed above, recently enacted regulations empower Customs officers, and/or inspection and security personnel to physically break any secured lock on a suitcase in order to gain access to a suitcase which is a believed to contain suspicious material. However, by employing the present invention, the possibility of having one's lock completely broken by Customs or security personnel is totally prevented.

By employing the dual locking mode padlocks of the present invention, which comprises a combination controlled section and key controlled section, a Master Key is created which is able to open the key controlled section of all dual mode padlocks. As a result, in the event that a Customs officer or security personnel require a particular piece of luggage to be opened for further visual inspection, the Customs officer or security personnel is able to open the dual locking mode padlocks by employing the Master Key, which is provided to all such individuals. In this way, physically breaking a lock is totally eliminated and, once visual inspection has been completed, the dual locking mode padlocks would be replaced on the luggage and locked in position, in order to assure that the contents remains secure throughout the remainder of the trip.

Furthermore, the padlocks of the present invention are constructed with the interior chambers virtually sealed from the ambient surroundings, thereby preventing unwanted contamination from entering the interior of the padlock and the rotating component thereof. In this way, prior art degradation and interference of the lock operation by contamination is virtually eliminated.

In addition, in accordance with the present invention, a minimum number of components are employed in combination with the housing and the movable shackle, in order to provide the desired unique, dual mode padlock constructions of the present invention. In addition to the shackle and housing, only the plurality of rotating dials, plurality of tumblers sleeves, key operated tumblers and rotatable chamber are required to provide the dual mode padlock constructions of this invention.

In addition to the features detailed above, the present invention achieves a dual mode padlock using a minimum number of independent components, each of which is capable of being quickly assembled into the final product. As a result, a construction is attained which is capable of being manufactured at a competitive price, while providing a high quality, highly effective dual mode padlock which virtually eliminates any degradation due to exposure to environmental contamination.

In further alternate embodiments of the present invention, the dual mode locking padlocks detailed above also incorporate an indicator or signal assembly which is automatically activated in response to the use of the key portion for releasing or opening the padlock. In this way, users of the padlocks of the present invention are automatically informed whenever the padlock has been opened by an unknown third-party using the key portion of the padlock. In this way, users always receive a positive indicator or signal whenever a suitcase, or other product, on which the locked padlock has been secured is opened for inspection by transit security personnel, customs officials, or other inspection authorities.

In accordance with the present invention, two alternate embodiments are detailed herein for providing the desired indicator or signal in response to the use by a third party of the key portion of the padlock. In one embodiment, the signal or indicator element is mounted in the housing in controlled, operational interengagement with the key operated lock portion of the padlock. In this embodiment, whenever the key operated portion has been used, the signal or indicator moves vertically from a stored position within the housing into a raised position, wherein the indicator element extends outwardly from the housing, immediately informing the user that the padlock had been opened by use of the key operated portion thereof.

In the alternate embodiment of the present invention, an arcuately pivotable or rotatable signal/indicator is incorporated in the padlock assembly, constructed for rotational movement in response to use of the key operated portion of the padlock. In this embodiment, the rotatable signal/indicator is mounted in cooperating relationship with the housing, for being readily viewable. In this regard, this signal/indicator is in a first position during its normal operation, and arcuately moved or rotated about 90° whenever the padlock is open using the key portion of the padlock. When arcuately moved into this alternate position, the signal/indicator incorporates indicia which readily informs the consumer that the padlock has been opened using the key portion thereof.

Regardless of which signal/indicator embodiment of the present invention is employed, the user of the padlock of the present invention is immediately informed whenever a locked suitcase, or other product, has been opened while the suitcase or product is out of control of the user. In this way, the user immediately knows that an inspection of the suitcase/product has been undertaken by a third-party without the owner's knowledge.

Furthermore, in both embodiments of the present invention, the signal/indicator is incapable of being reset by the third party after activation, since a special reset key must be employed in order to reposition the signal/indicator into its original, unactivated, pre-triggered mode. As a result, the user is assured that any third-party using the key operated portion of the padlock is incapable of resetting the signal/indicator after activation and, once activated, the signal/indicator must remain visible for the user to see and observed.

In addition, in accordance with the present invention, either of the two alternate embodiments for providing a signal/indicator can be employed with either of the two alternate embodiments for the dual locking mode padlock of this invention. Consequently, numerous alternate combinations of inventions that can be produced in accordance with the teaching of this invention. However, whichever combination of features or elements is employed, the scope of the present invention is intended to dominate and include all of these alternate combinations, as well as all further constructions which are rendered obvious from this disclosure.

The invention accordingly comprises an article of manufacture assessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which:

FIG. 1 is a cross-sectional, side elevation view of one embodiment of the dual mode padlock of the present invention;

FIG. 2 is a cross-sectional bottom plan view of the dual-mode padlock of the present invention taken along line 2—2 of FIG. 1;

FIG. 3 is a side elevation view of the dual-mode padlock of FIG. 1 shown in its locked position;

FIG. 4 is a top plan review taken along that line 4—4 of FIG. 3;

FIG. 5 is a side elevation view, partially in cross-section, of the dual mode padlock of FIG. 1 shown with the shackle released by the combination controlled locking section thereof;

FIG. 6 is a side elevation view, partially in cross-section, of the dual-mode padlock FIG. 1 shown with the shackle released by the key controlled the locking section thereof;

FIG. 7 is a top plan view, partially in cross-section, taken along line 7—7 of FIG. 6;

FIG. 8 is a cross-sectional side elevation view of the housing forming one principal component of the dual-mode padlock of FIG. 1;

FIG. 9 is a cross-sectional bottom view of the housing of the dual-mode padlock of the present invention taken along the line 9—9 of FIG. 8;

FIG. 10 is a side elevation view, partially in cross-section, of one cylinder forming a component of the dual mode padlock of FIG. 1;

FIG. 11 is an end view of the cylinder of FIG. 10;

FIG. 12 and FIG. 13 are bottom views of the cylinder of FIG. 10;

FIG. 14 is a cross-sectional side elevation view of a second cylinder forming a component of the dual-mode padlock of FIG. 1;

FIG. 15 is an end view of the cylinder of FIG. 14;

FIG. 16 is a top plan view of the cylinder of FIG. 14;

FIG. 17 is a side elevation view of the spring plate forming a component of the dual-mode padlock of FIG. 1;

FIG. 18 is an end view of the spring plate of FIG. 17;

FIG. 19 is a top plan view of the spring plate of FIG. 17;

FIG. 71 is a front elevation view of the dual-mode locking padlock incorporating the signal indicator of FIG. 70;

FIG. 72 is a cross-sectional top plan view of the dual-mode locking padlock incorporating the signal indicator assembly and taken along line 72—72 of FIG. 71;

FIG. 73 is a rear perspective view of the dual mode locking padlock incorporating the signal indicator assembly of FIG. 71 with the rear panel section removed;

DETAILED DISCLOSURE

Figure 20:
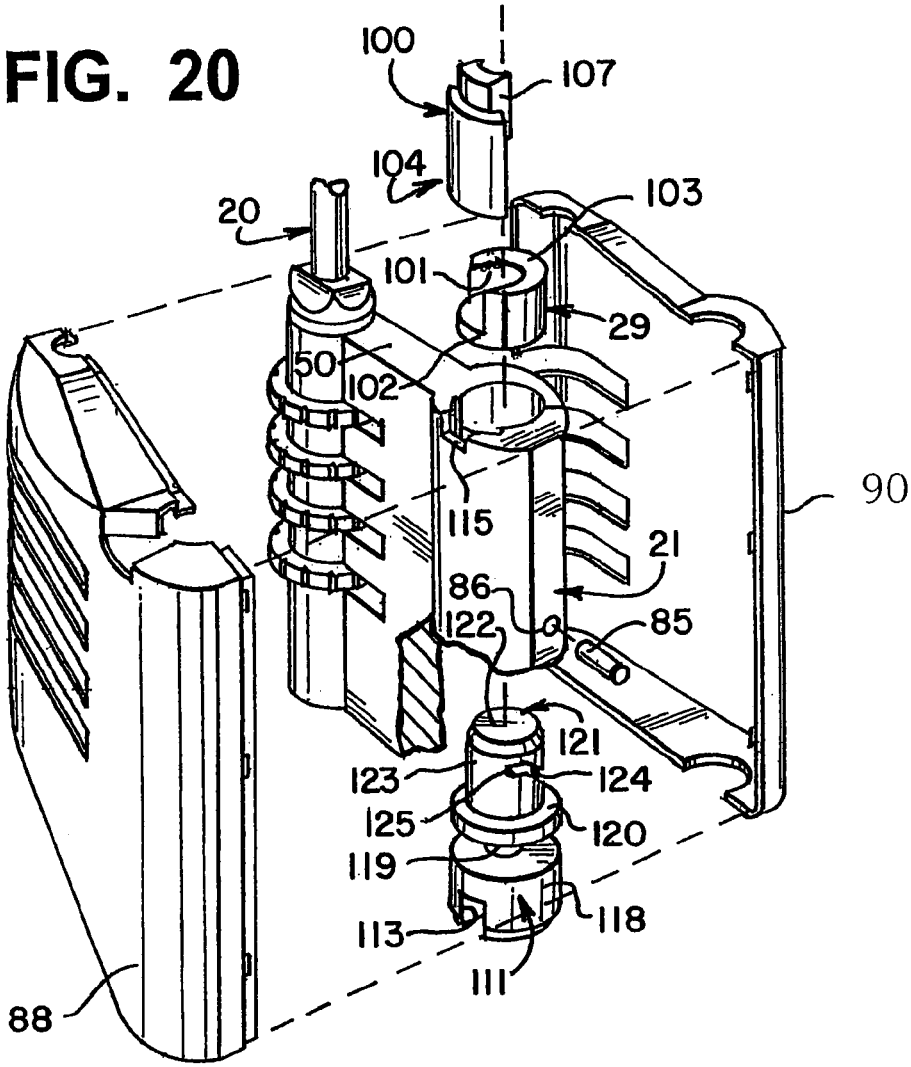
FIG. 20 is an exploded perspective view, partially broken away, of a second embodiment of the dual-mode padlock fo the present invention.
Figure 21:
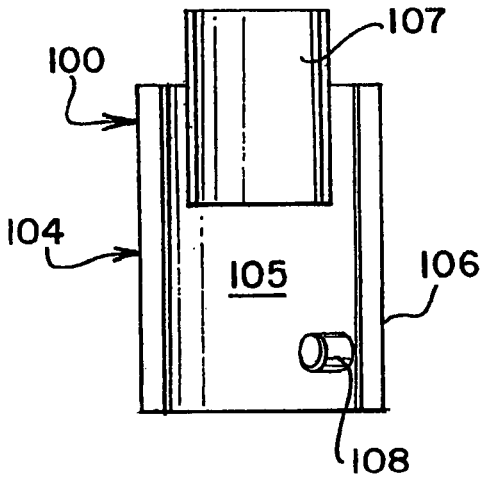
FIG. 21 is a side elevation view of a movable plate member forming a component of the dual mode padlock of FIG. 20.
Figure 22:
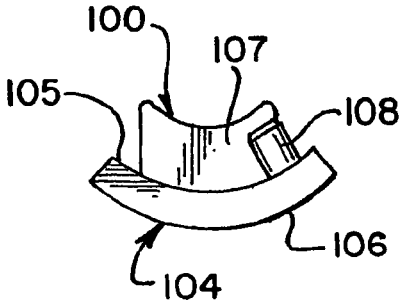
FIG. 22 is a bottom plan view of the movable plate member of FIG. 21.
Figure 23:
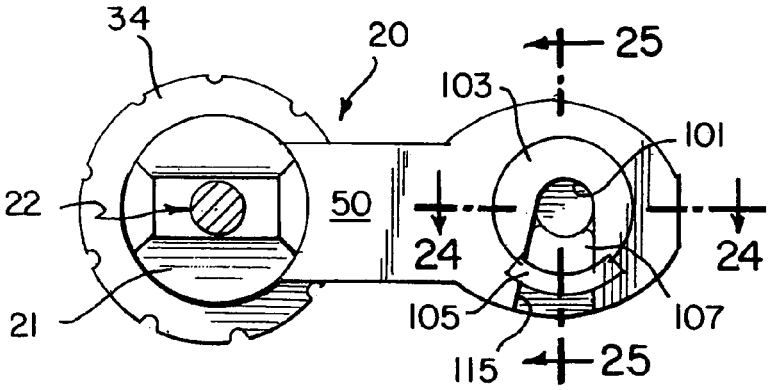
FIG. 23 is a top plan view of the dual mode padlock of FIG. 20.

By referring to FIGS. 1–26, along with the following detailed discussion, the construction and operation of two alternate embodiments of dual mode padlock 20 of the present invention can best be understood. In addition, by referring to FIGS. 27–75 and the following detailed discussion, the construction and operation of five alternate constructions for incorporating an information indicator or signal into either of the foregoing embodiments of FIGS. 1–26 can be fully understood. In the drawings and in the following detailed disclosure, the preferred alternate embodiments of the present invention are fully disclosed. However, this disclosure is provided for exemplary purposes only and, since the present invention can be implemented using further alternate constructions, it is intended that these alternate constructions are within the scope of the present invention.

In FIGS. 1–19, one preferred embodiment of dual mode padlock 20 of the present invention is depicted using a minimum of principal components, thereby achieving a dual mode padlock, while also substantially reducing the complexity found in most prior art padlocks. In this way, the present invention provides a highly effective, commercially desirable construction which is capable of being produced at a competitive cost, while also providing the unique attributes of the present invention and all of the locking and theft deterrent features typically incorporated in prior art padlocks.

In this embodiment of the present invention, the two principal components which form the dual mode padlock 20 comprise central housing 21 and shackle 22, with central housing 21 incorporating combination controlled locking section 23 formed on one side thereof and key controlled locking section 24 formed on the opposed side thereof. The components required for forming and operating combination controlled locking section 23, as well as the components required for forming and operating key controlled locking section 24 are all detailed below. However, regardless of the section used by an individual to lock and unlock padlock 20 of the present invention, the cooperative engagement of shackle 22 with housing 21 is employed.

In this preferred embodiment, shackle 22 comprises a conventional j-shape incorporating short leg 25 which has a terminating end 26, and long leg 27 having terminating end portion or section 28. As is fully detailed below, shackle 22 is in its locked and fully engaged position when a major portion of long leg 27 is contained within housing 21 and terminating end 26 of short leg 25 is engaged within locking collar 29. Furthermore, in order for dual mode padlock 22 to be unlocked or open, terminating end 26 of short leg 25 must be released or disengaged from locking collar 29.

As detailed below, the disengagement or release of short leg 25 from locking collar 29 is accomplished by activating one of the two locking sections formed in housing 21. By employing combination controlled locking section 23, and properly inputting the correct preset combination, the long leg 27 of shackle 22 is released and is able to move longitudinally or axially relative to housing 21. This longitudinal or axial movement enables terminating end 26 of short leg 25 to be axially removed from locking collar 29 resulting in the opening of dual mode padlock 20, as shown in FIG. 5.

Alternatively, by employing key controlled locking section 23, locking collar 29 is able to be arcuately pivoted, preferably through an angular distance of about 90°, positioning slot 30 formed in locking collar 29 to a location which allows shackle 22 to be arcuately pivotable relative to housing 21, enabling terminating end 26 of short leg 25 to be moved out of engagement within locking collar 29, as shown in FIGS. 6 and 7. In this way, shackle 22 is released from locked engagement with collar 29, enabling the removal of padlock 20 from the items to which it had been secured or, alternatively, enabling items to be securely engaged therewith.

In order to enable combination controlled locking section 23 of housing 21 to control the axial or longitudinal movement of long leg 27 of shackle 22, combination controlled locking section 23 incorporates four separate and independent tumbler sleeves 33 and four separate and independent rotatable dials 34. By employing these components, along with housing 21 and shackle 22, an easily produced, highly effective combination controlled locking section is realized.

Each tumbler sleeve 33 comprises a generally cylindrical shape incorporating a single locking fin 35 radially extending from outer, circular-shaped surface 36. In addition, each tumbler sleeve 33 also comprises an inside, circular-shaped surface 37 which is coaxially aligned with outside surface 36. The diameter of inside surface 37 of tumbler sleeve 33 is constructed to enable each tumbler sleeve 33 to freely pivot about the outer surface of shackle 22.

Each dial 34 is constructed for peripherally surrounding and cooperating with a tumbler sleeve 33. In this regard, each dial 34 comprises two separate and distinct, circular-shaped inside surfaces 38 and 39. Side surface 38 comprises a diameter slightly greater than the diameter of outside surface 36 of tumbler sleeve 33, in order to enable tumbler sleeve 33 and dial 34 to cooperate with each other while being independently rotationally movable about 22.

In addition, each dial 34 comprises a plurality of slots 40 formed in inside surface 38, with each slot being constructed for receiving and retaining radially extending fin 35 of tumbler sleeve 33. In this way, whenever radially extending fin 35 is mounted in a slot 40 of dial 34, tumbler sleeve 33 and dial 34 are in interlocked engagement, causing both members to rotate together about shackle 22.

The number of slots 40 formed in dial 34 corresponds to the number of separate and distinct indicia formed on the outer surface of dial 34. In the preferred embodiment, ten indicia are employed on the outside surface of dial 34 and ten slots 40 are formed in surface 38.

Inside surface 39 of dial 34 comprises a circular shape formed by a diameter which is aligned with the axis of surface 38, but is greater than the length of fin 35. In this way, when fin 35 is disengaged from slot 40 of dial 34, dial 34 is able to rotate about shackle 22 independently of tumbler sleeve 33. Each tumbler sleeve 33 is rotationally mounted to leg 27 of shackle 22, with each tumbler sleeve having a dial 34 rotationally associated therewith.

As discussed above, each dial 34 has a plurality of indicia formed on the outer peripheral surface thereof, each of which represents one component of the combination for positioning tumbler sleeves 33 in the requisite location for releasing shackle 22. Although any desired indicia can be employed, numerals or letters are typically employed on prior art constructions. In the present invention, each dial 34 comprises an outer surface 44 on which ten panels 45 are formed with slots 46 separating each panel 45. In addition, one numeral ranging from 0, 1, 2, 3, 4, 5, 6, 7, 8 and 9 is formed on each panel 45. The numeral in each panel 45 of each dial 24 is then employed to define the combination for padlock 20.

The remaining components employed to form combination controlled locking section 23 of housing 21 of padlock 20 comprise split locking ring 46 and sealing cap 47. In the preferred construction, leg 27 of shackle 22 incorporates ribs 48 and 49 formed on the outer surface thereof and a locking ring receiving slot 50 formed directly adjacent terminating end section 28 of leg 27 of shackle 22.

As clearly depicted in FIG. 1, the axial distance between ribs 48 and 49 and slot 50 is constructed for being substantially equivalent to the axial length required for enabling locking ring 46, when mounted in slot 50, to retain the four tumbler sleeves 33 on leg 27 of shackle 22, with each tumbler sleeves 33 being capable of independent rotational movement, while substantially eliminating any axial movement thereof. In this way, tumbler sleeves 33 are able to provide the desired locking and unlocking function, while achieving this result in an easily manufactured and easily assembled construction.

Preferably, a visual indicator of the proper orientation for each numeral or letter of each panel 45 of each dial 34 is also provided by incorporating on housing 21 a position orientating line. This line enables the user to visually position each numeral in the proper location for a pre-set combination.

As shown in the drawings, housing 21 comprises a single piece construction, within which various cavities, bores, and receiving zones are formed for enabling the dual, independent, locking systems to operate. In general, housing 21 comprises a top surface 50, a bottom surface 51, a front panel 52, a rear panel 53, and two side panels 54 and 55.

In addition, combination controlled locking section 23 of housing 21 incorporates a central, elongated bore 56 which extends through section 23 from top surface 50 to bottom surface 51. In this regard, bore 56 comprises portal 68, formed with top surface 50. In addition, bore 56 comprises three separate diameters, forming three separate and independent coaxial zones 57, 58, and 59. Zone 57 comprises the lowermost zone of bore 56, and comprises a diameter slightly greater than the diameter of shackle 22. In this way, terminating end section 28 of leg 27 of shackle 22 is capable of axial movement in zone 57, while also preventing any other components mounted to leg 33 of shackle 22 from entering zone 57.

Zone 58 comprises the intermediate zone of bore 56 and has a diameter slightly greater than the outside diameter of tumbler sleeves 33. In this way, tumbler sleeves 33 are capable of axial movement through zone 58 of central bore 56. In addition, zone 58 also comprises an elongated slot or channel 60 formed along one wall of zone 58, providing the release position for each radially extending fin 35 of each tumbler sleeve 33. As is more fully detailed below, when each locking fin of each tumbler sleeve 33 is aligned with release channel 60, shackle 22 is capable of axial movement, thereby enabling shackle 22 to be removed from its locked position or, if desired, inserted into its locked position, or axially advanced into zone 57 of bore 56 of housing 21, to enable the combination to be changed, set or re-set.

The final zone of bore 56 is upper zone 59 which comprises the largest diameter of bore 56. Generally, the diameter of zone 59 is constructed to enable each tumbler sleeve 33 with its radially extending fin 35 to be easily advanced through first portal 68 of zone 59. In this way, assembly of combination section 23 of padlock 20 is easily attained.

In addition, upper zone 59 and its associated first portal zone 68 are constructed for receiving and securely retaining sealing cap 47. In its preferred construction, sealing cap 47 comprises a cylindrical shape formed by outer surface 70 and upper flange 71. Preferably, the diameter of zone 59 is substantially equivalent to the diameter of outer surface 70 of cap 47 in order to require cap 37 to be forced into first portal 68 and zone 59 and, once inserted therein, securely affixed thereto.

In the preferred construction, tumbler sleeves 34 and locking ring 46 are mounted to leg 27 of shackle 22. Then, when dials 34 are mounted in place, the fully assembled leg 27 of shackle 22 is inserted into first portal 68 of bore 56 of housing 21. The assembly is then completed by forcing sealing cap 47 into first portal 68 of zone 59 of bore 56 until the entire outer surface 70 of cap 47 is fully engaged in zone 59 and peripheral flange 71 contacts top surface 50.

With sealing cap 47 securely, integrally fastened to housing 21, tumbler sleeves 34 are protected from interference from environmental debris. Since bore 56 is effectively sealed from the ambient surroundings, the entry of unwanted dirt and/or debris into bore 56 is effectively prevented. As a result, long-term, trouble-free operation of padlock 20 is provided.

In order to assure that each dial 34 is cooperatively associated with a tumbler sleeve 33 and is rotatable about leg 27 of shackle 22 along with its associated tumbler sleeve, combination controlled locking section 23 of housing 21 incorporates four separate and independent dial receiving zones 61. Each dial receiving zone 61 is formed in juxtaposed spaced aligned parallel relationship with each other, while also being cooperatively associated with zone 58 of central bore 56 and elongated release channel 60. In addition, each dial receiving zone 61 is defined by an upper surface 62 and a lower surface 63 which are parallel to each other. Furthermore, each dial receiving zone 61 may be cooperatively associated with spring plate 78 which incorporates flexible arms 79. By employing spring plate 78, arms 79 are positioned for interengagement with dial 34, in order to prevent unwanted rotation of dials 34. In this way, physical movement of dials 34 by the user is required to rotate dials 34. In FIGS. 17–19, the preferred construction of spring plate 78 is depicted.

Whenever a user wishes to set or change the particular combination for operating combination controlled locking section 23 of dual-mode padlock 20, the user is able to quickly and easily alter the particular combination as desired. In order to achieve this change, the user opens padlock 20, using the known combination, and then accurately pivots shackle 22 about the axis of leg 27. Thereafter, by longitudinally advancing leg 27 downwardly into elongated bore 56 of housing 21, fins 35 of tumblers 33 are all disengaged from slots 40 of dials 34.

Once dials 34 are all disengaged from tumblers 33, dials 34 can be arcuately rotated into any desired position. By individually rotating each dial 34 into a particular desired position, a unique or personalized code or sequence is created. Once each dial has been placed into the precisely desired position or alignment, shackle 22 is axially moved upwardly, bringing the locking fins 35 of each tumbler 33 into engagement in one slot 40 of one dial 34. Once these steps have been completed, the precisely desired new combination or code is established.

In addition to enabling padlock 20 to be opened by employing combination controlled locking section 23 of housing 21, dual mode padlock 20 of the present invention also incorporates key controlled locking section 24 formed as a part of housing 21 for enabling padlock 20 to be unlocked in a separate and independent alternate manner. By referring to FIGS. 1–19, along with the following detailed discussion, the construction and operation of this key controlled locking and unlocking mode of padlock 20 can best be understood.

In the preferred construction of the present invention, key controlled locking section 24 of housing 21 incorporates elongated bore 80 extending from top surface 50 through to bottom surface 51. As depicted, elongated bore 80 extends substantially parallel to elongated bore 56 formed in combination controlled locking section 23. In addition, in order to provide the desired key controlled arcuate pivoting movement of locking collar 29, for enabling shackle 22 to be securely locked and released, when desired, key controlled locking section 24 incorporates cooperating cylinders 81 and 82.

Cylinders 81 and 82 are each rotationally journalled in elongated bore 80 and are mounted in controlled engagement with each other. If desired, a single elongated cylinder may be employed. However, it has been found for ease of construction, the use of two separate cylinders is preferred. In order to assure that cylinders 81 and 82 are arcuately pivoted simultaneously, effectively functioning as a single elongated cylinder, cylinder 81 incorporates channel 83 formed in the bottom surface thereof, while cylinder 82 incorporates an upstanding flange or ridge 84 formed in its top section. By lockingly engaging flange/ridge 84 in channel 83, cylinders 81 and 82 are arcuately pivoted simultaneously.

As discussed above, key controlled locking section 24 incorporates locking collar 29 which is constructed for controlled engagement with terminating end 26 of short leg 25 of shackle 22. In the preferred construction, locking collar 29 is formed with a substantially U-shape as an integral component of cylinder 81, thereby assuring that the arcuate pivoting movement of locking collar 29 occurs simultaneously with the arcuate pivoting movement of cylinders 81 and 82.

In the preferred construction, cylinder 82 incorporates key receiving slot 88 formed in the base thereof which is constructed for cooperating controlled relationship with key 89. Furthermore, cylinder 82 incorporates a plurality of spring biased tumblers 87 which are constructed for cooperating with cut-out zones formed on key 89.

In this construction, tumblers 87 prevent the arcuate movement of cylinder 82 unless all tumblers 87 are positioned in a precise, predetermined alignment and/or arrangement. When in the desired aligned position, cylinder 82 is capable of being arcuately rotated.

In addition, in order to achieve the precisely desired aligned position for enabling cylinder 82 to be arcuately rotated, key 89 is employed for axially positioning each tumbler 87 in the precisely desired, predetermined position. In addition, key 89 provides the necessary leverage for enabling cylinder 82 to be arcuately pivoted.

Once key 89 is inserted into slot 88 of cylinder 82, tumblers 87 are aligned in the precisely desired predetermined position, enabling cylinder 82 to be arcuately rotated. In addition, since flange 84 of cylinder 82 is engaged within channel or slot 83 of tumbler 82, the arcuate pivoting movement of the cylinder 82 simultaneously causes cylinder 81 to arcuately pivot therewith. Furthermore, with locking collar 29 formed as an integral component of cylinder 81, the arcuate pivoting movement of cylinder 81 causes locking collar 29 to also pivot.

In this way, terminating end 26 of short leg 25 of shackle 22 is released from locked engagement with collar 29. As detailed above, U-shaped locking collar 29 incorporates slot or portal 30, which is normally positioned inwardly, generally facing housing 21 and preventing shackle 22 from being arcuately pivoted about its longitudinal axis. However, when locking collar 29 is arcuately pivoted about 90°, in response to the arcuate pivoting movement of cylinders 81 and 82, slot/portal 30 faces outwardly towards the side surface of housing 21, enabling terminating end 26 of leg 25 of shackle 22 to be arcuately pivoted out of engagement with locking collar 29, thereby releasing shackle 22 from locked engagement therein. In this way, the second separate and independent locking mode for padlock 20 is easily activated, in complete control by the user.

In order to prevent cylinders 81 and 82 from moving axially, once mounted in elongated bore 80, a holding pin 82 is mounted in housing 21 and engaged within slotted opening 86 formed in cylinder 82. In this way, cylinder 82 is freely pivotal about its central axis, while being incapable of axial movement in bore 80 of housing 21.

In FIGS. 20–26, a second preferred embodiment of dual mode padlock 20 of the present invention is depicted. In this embodiment, a minimum of principal components is also employed, thereby achieving a dual mode padlock, while also substantially reducing the complexity found in most prior art padlocks. In this way, the present invention provides a highly effective, commercially desirable construction which is capable of being produced at a competitive cost, while also providing the unique attributes of the present invention and all of the locking and theft deterrent features typically incorporated in prior art padlocks.

In this embodiment of the present invention, the two principal components which form the dual mode padlock 20 comprise central housing 21 and shackle 22, with central housing 21 incorporating combination controlled locking section 23 formed on one side thereof and key controlled locking section 24 formed on the opposed side thereof. The components required for forming and operating combination controlled locking section 23, as well as the components required for forming and operating key controlled locking section 24 are all detailed below. However, regardless of the section used by an individual to lock and unlock padlock 20 of the present invention, the cooperative engagement of shackle 22 with housing 21 is employed.

In this preferred embodiment, shackle 22 comprises a conventional j-shape incorporating short leg 25 which has a terminating end 26, and long leg 27 having terminating end portion or section 28. As is fully detailed below, shackle 22 is in its locked and fully engaged position when a major portion of long leg 27 is contained within housing 21 and terminating end 26 of short leg 25 is engaged within locking collar 29. Furthermore, in order for dual mode padlock 22 to be unlocked or open, terminating end 26 of short leg 25 must be released or disengaged from locking collar 29.

As detailed below, the disengagement or release of short leg 25 from locking collar 29 is accomplished by activating one of the two locking sections formed in housing 21. By employing combination controlled locking section 23, and properly inputting the correct preset combination, the long leg 27 of shackle 22 is released and is able to move longitudinally or axially relative to housing 21. This longitudinal or axial movement enables terminating end 26 of short leg 25 to be axially removed from locking collar 29 resulting in the opening of dual mode padlock 20, as shown in FIG. 5.

Figure 26:
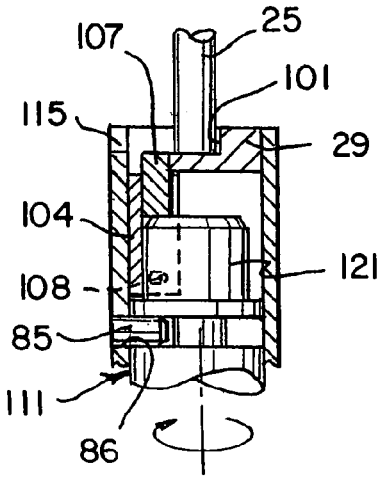
FIG. 26 is a cross-sectional side elevation view, partially broken away, depicting this embodiment of the dual mode padlock in its unlocked configuration.
Figure 27:
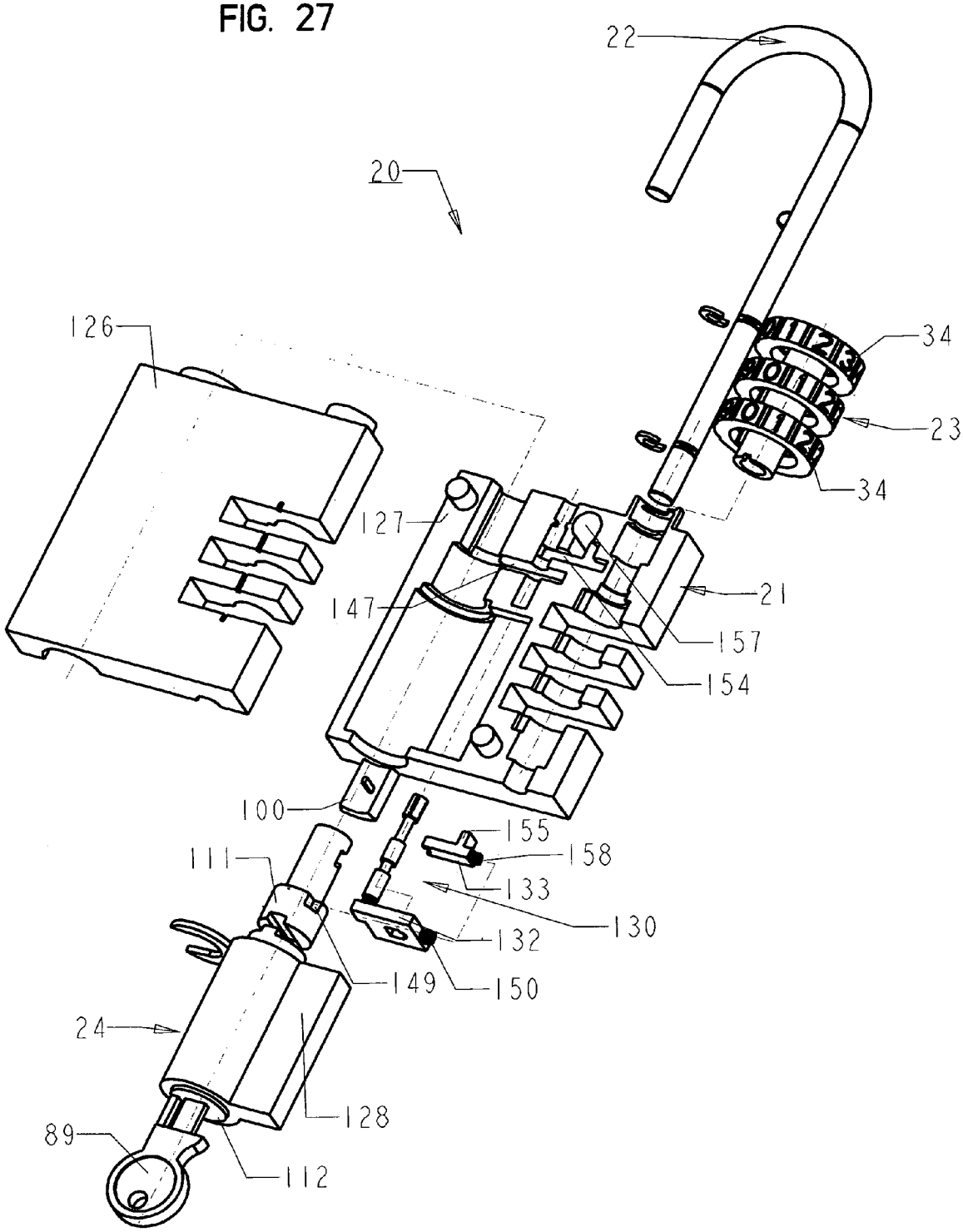
FIG. 27 is an exploded perspective view of a further alternate embodiment of the dual mode locking padlock of the present invention incorporating a signal/indicator assembly.
Figure 27A:
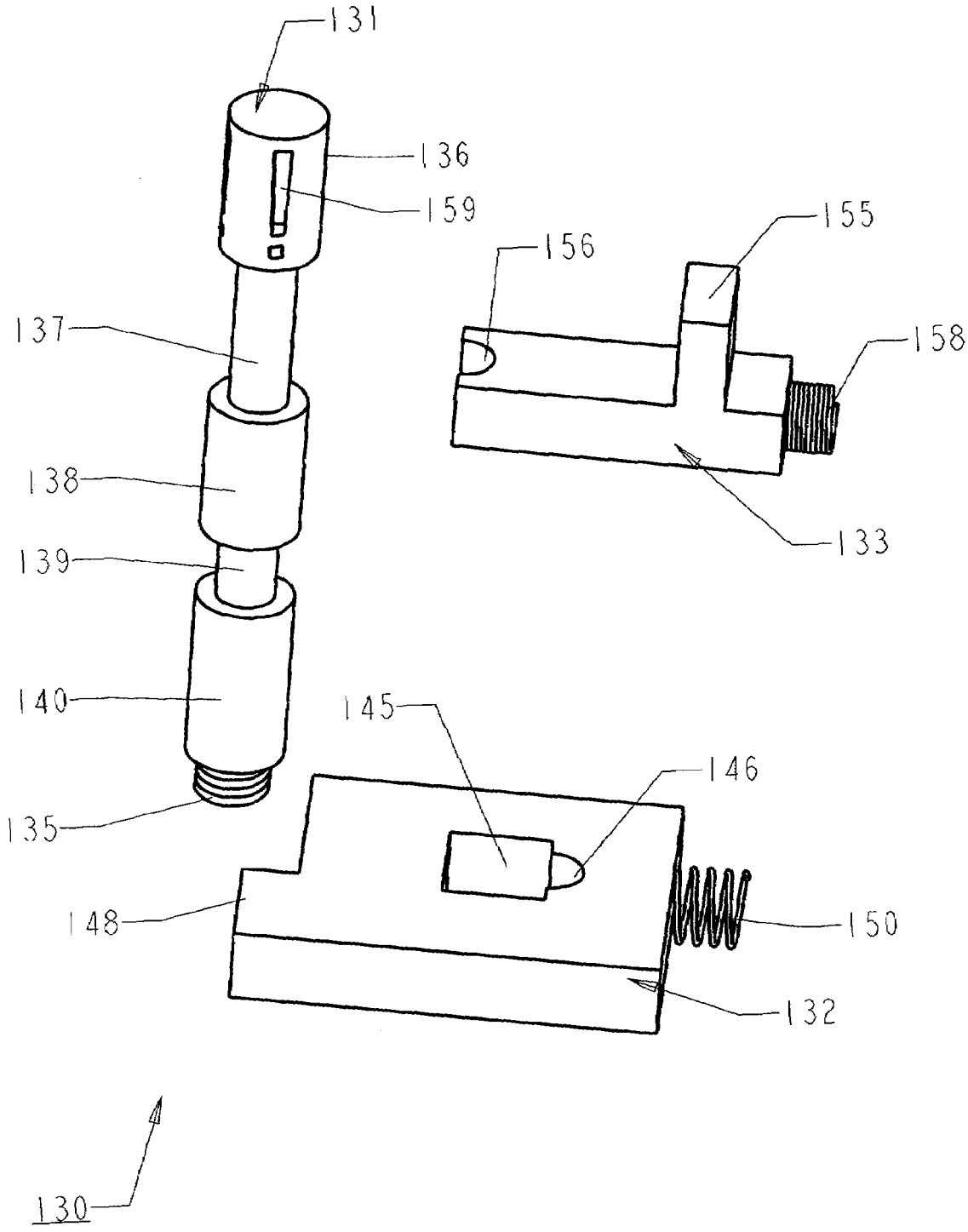
FIG. 27A is an enlarged perspective view of the signal/indicator assembly incorporated into the dual mode locking padlock of FIG. 27.

Alternatively, by employing key controlled locking section 23 in this embodiment, wall member 100 of locking collar 29 is moved vertically, relative to housing 21, effectively forming portal or open zone 101 in collar 29 which allows shackle 22 to be arcuately pivotable relative to housing 21, enabling terminating end 26 of short leg 25 to be moved out of engagement within locking collar 29, as shown in FIG. 26. In this way, shackle 22 is released from locked engagement with collar 29, enabling the removal of padlock 20 from the items to which it had been secured or, alternatively, enabling items to be securely engaged therewith.

In order to enable combination controlled locking section 23 of housing 21 to control the axial or longitudinal movement of long leg 27 of shackle 22, combination controlled locking section 23 of this embodiment of the present invention is constructed in a manner substantially identical to the embodiment detailed above. As a result, by referring to the following detailed disclosure along with FIGS. 20–25 and FIGS. 1–19, the construction and operation of this embodiment can be fully understood. In this regard, combination controlled locking section 23 incorporates four separate and independent tumbler sleeves 33 and four separate and independent rotatable dials 34. By employing these components, along with housing 21 and shackle 22, an easily produced, highly effective combination controlled locking section is realized.

As described above, each tumbler sleeve 33 comprises a generally cylindrical shape incorporating a single locking fin 35 radially extending from outer, circular-shaped surface 36. In addition, each tumbler sleeve 33 also comprises an inside, circular-shaped surface 37 which is coaxially aligned with outside surface 36. The diameter of inside surface 37 of tumbler sleeve 33 is constructed to enable each tumbler sleeve 33 to freely pivot about the outer surface of shackle 22.

Each dial 34 is constructed for peripherally surrounding and cooperating with a tumbler sleeve 33. In this regard, each dial 34 comprises two separate and distinct, circular-shaped inside surfaces 38 and 39. Side surface 38 comprises a diameter slightly greater than the diameter of outside surface 36 of tumbler sleeve 33, in order to enable tumbler sleeve 33 and dial 34 to cooperate with each other while being independently rotationally movable about 22.

In addition, each dial 34 comprises a plurality of slots 40 formed in inside surface 38, with each slot being constructed for receiving and retaining radially extending fin 35 of tumbler sleeve 33. In this way, whenever radially extending fin 35 is mounted in a slot 40 of dial 34, tumbler sleeve 33 and dial 34 are in interlocked engagement, causing both members to rotate together about shackle 22.

The number of slots 40 formed in dial 34 corresponds to the number of separate and distinct indicia formed on the outer surface of dial 34. In the preferred embodiment, ten indicia are employed on the outside surface of dial 34 and ten slots 40 are formed in surface 38.

Inside surface 39 of dial 34 comprises a circular shape formed by a diameter which is aligned with the axis of surface 38, but is greater than the length of fin 35. In this way, when fin 35 is disengaged from slot 40 of dial 34, dial 34 is able to rotate about shackle 22 independently of tumbler sleeve 33. Each tumbler sleeve 33 is rotationally mounted to leg 27 of shackle 22, with each tumbler sleeve having a dial 34 rotationally associated therewith.

As discussed above, each dial 34 has a plurality of indicia formed on the outer peripheral surface thereof, each of which represents one component of the combination for positioning tumbler sleeves 33 in the requisite location for releasing shackle 22. Although any desired indicia can be employed, numerals or letters are typically employed on prior art constructions. In the present invention, each dial 34 comprises an outer surface 44 on which ten panels 45 are formed with slots 46 separating each panel 45. In addition, one numeral ranging from 0, 1, 2, 3, 4, 5, 6, 7, 8 and 9 is formed on each panel 45. The numeral in each panel 45 of each dial 24 is then employed to define the combination for padlock 20.

The remaining components employed to form combination controlled locking section 23 of housing 21 of padlock 20 comprise split locking ring 46 and sealing cap 47. In the preferred construction, leg 27 of shackle 22 incorporates ribs 48 and 49 formed on the outer surface thereof and a locking ring receiving slot 50 formed directly adjacent terminating end section 28 of leg 27 of shackle 22.

As clearly depicted, the axial distance between ribs 48 and 49 and slot 50 is constructed for being substantially equivalent to the axial length required for enabling locking ring 46, when mounted in slot 50, to retain the four tumbler sleeves 33 on leg 27 of shackle 22, with each tumbler sleeves 33 being capable of independent rotational movement, while substantially eliminating any axial movement thereof. In this way, tumbler sleeves 33 are able to provide the desired locking and unlocking function, while achieving this result in an easily manufactured and easily assembled construction.

Preferably, a visual indicator of the proper orientation for each numeral or letter of each panel 45 of each dial 34 is also provided by incorporating on housing 21 a position orientating line. This line enables the user to visually position each numeral in the proper location for a pre-set combination.

As shown in the drawings, housing 21 comprises a single piece construction, within which various cavities, bores, and receiving zones are formed for enabling the dual, independent, locking systems to operate. In general, housing 21 comprises a top surface 50, a bottom surface 51, a front panel 52, a rear panel 53, and two side panels 54 and 55. In addition, as shown in FIG. 20, cover panels 98 and 99 are mounted to housing 21 for peripherally surrounding and enveloping housing 21. In this way, any desired outer surface configuration, color, visual appearance etc. can be attained for providing a desired aesthetic appeal and/or providing added protection to the surface of the housing.

In addition, combination controlled locking section 23 of housing 21 incorporates a central, elongated bore 56 which extends through section 23 from top surface 50 to bottom surface 51. In this regard, bore 56 comprises portal 68, formed with top surface 50. In addition, bore 56 comprises three separate diameters, forming three separate and independent coaxial zones 57, 58, and 59. Zone 57 comprises the lowermost zone of bore 56, and comprises a diameter slightly greater than the diameter of shackle 22. In this way, terminating end section 28 of leg 27 of shackle 22 is capable of axial movement in zone 57, while also preventing any other components mounted to leg 33 of shackle 22 from entering zone 57.

Zone 58 comprises the intermediate zone of bore 56 and has a diameter slightly greater than the outside diameter of tumbler sleeves 33. In this way, tumbler sleeves 33 are capable of axial movement through zone 58 of central bore 56. In addition, zone 58 also comprises an elongated slot or channel 60 formed along one wall of zone 58, providing the release position for each radially extending fin 35 of each tumbler sleeve 33. As is fully detailed herein, when each locking fin of each tumbler sleeve 33 is aligned with release channel 60, shackle 22 is capable of axial movement, thereby enabling shackle 22 to be removed from its locked position or, if desired, inserted into its locked position, or axially advanced into zone 57 of bore 56 of housing 21, to enable the combination to be changed, set or re-set.

The final zone of bore 56 is upper zone 59 which comprises the largest diameter of bore 56. Generally, the diameter of zone 59 is constructed to enable each tumbler sleeve 33 with its radially extending fin 35 to be easily advanced through first portal 68 of zone 59. In this way, assembly of combination section 23 of padlock 20 is easily attained.

In addition, upper zone 59 and its associated first portal zone 68 are constructed for receiving and securely retaining sealing cap 47. In its preferred construction, sealing cap 47 comprises a cylindrical shape formed by outer surface 70 and upper flange 71. Preferably, the diameter of zone 59 is substantially equivalent to the diameter of outer surface 70 of cap 47 in order to require cap 37 to be forced into first portal 68 and zone 59 and, once inserted therein, securely affixed thereto.

In the preferred construction, tumbler sleeves 34 and locking ring 46 are mounted to leg 27 of shackle 22. Then, when dials 34 are mounted in place, the fully assembled leg 27 of shackle 22 is inserted into first portal 68 of bore 56 of housing 21. The assembly is then completed by forcing sealing cap 47 into first portal 68 of zone 59 of bore 56 until the entire outer surface 70 of cap 47 is fully engaged in zone 59 and peripheral flange 71 contacts top surface 50.

With sealing cap 47 securely, integrally fastened to housing 21, tumbler sleeves 34 are protected from interference from environmental debris. Since bore 56 is effectively sealed from the ambient surroundings, the entry of unwanted dirt and/or debris into bore 56 is effectively prevented. As a result, long-term, trouble-free operation of padlock 20 is provided.

In order to assure that each dial 34 is cooperatively associated with a tumbler sleeve 33 and is rotatable about leg 27 of shackle 22 along with its associated tumbler sleeve, combination controlled locking section 23 of housing 21 incorporates four separate and independent dial receiving zones 61. Each dial receiving zone 61 is formed in juxtaposed spaced aligned parallel relationship with each other, while also being cooperatively associated with zone 58 of central bore 56 and elongated release channel 60. In addition, each dial receiving zone 61 is defined by an upper surface 62 and a lower surface 63 which are parallel to each other. If desired, each dial receiving zone 61 may be cooperatively associated with a spring plate as detailed above. However, if desired, this component may be eliminated.

Whenever a user wishes to set or change the particular combination for operating combination controlled locking section 23 of dual-mode padlock 20, the user is able to quickly and easily alter the particular combination as desired. In order to achieve this change, the user opens padlock 20, using the known combination, and then accurately pivots shackle 22 about the axis of leg 27. Thereafter, by longitudinally advancing leg 27 downwardly into elongated bore 56 of housing 21, fins 35 of tumblers 33 are all disengaged from slots 40 of dials 34.

Once dials 34 are all disengaged from tumblers 33, dials 34 can be arcuately rotated into any desired position. By individually rotating each dial 34 into a particular desired position, a unique or personalized code or sequence is created. Once each dial has been placed into the precisely desired position or alignment, shackle 22 is axially moved upwardly, brining the locking fins 35 of each tumbler 33 into engagement in one slot 40 of one dial 34. Once these steps have been completed, the precisely desired new combination or code is established.

In addition to enabling padlock 20 to be opened by employing combination controlled locking section 23 of housing 21, this embodiment of dual mode padlock 20 of the present invention also incorporates key controlled locking section 24 formed as a part of housing 21 for enabling padlock 20 to be unlocked in a separate and independent alternate manner. By referring to FIGS. 20–26, along with the following detailed discussion, the construction and operation of this key controlled locking and unlocking mode of padlock 20 can best be understood.

In the preferred construction of this embodiment of the present invention, key controlled locking section 24 of housing 21 incorporates elongated bore 110 extending from top surface 50 through to bottom surface 51. As depicted, elongated bore 110 extends substantially parallel to elongated bore 56 formed in combination controlled locking section 23. In addition, in order to provide the desired key controlled arcuate pivoting movement of locking collar 29, for enabling shackle 22 to be securely locked and released, when desired, key controlled locking section 24 incorporates cooperating cylinders 111 and 112.

Cylinders 111 and 112 are each rotationally journalled in elongated bore 110 and are mounted in controlled engagement with each other. If desired, a single elongated cylinder may be employed. However, it has been found for ease of construction, the use of two separate cylinders is preferred. In order to assure that cylinders 111 and 112 are arcuately pivoted simultaneously, effectively functioning as a single elongated cylinder, cylinder 111 incorporates channel 113 formed in the bottom surface thereof, while cylinder 112 incorporates an upstanding flange or ridge 114 formed in its top section. By lockingly engaging flange/ridge 114 in channel 113, cylinders 111 and 112 are arcuately pivoted simultaneously.

In addition, cylinder 112 preferably incorporates axial slotted aperture 86 formed therein which cooperates with pin 85 mounted through housing 21 for extending into aperture 86. In this way, axial movement of cylinders 111 and 112 is prevented, while assuring free pivotal movement therein.

As discussed above, key controlled locking section 24 incorporates locking collar 29 which is constructed for controlled engagement with terminating end 26 of short leg 25 of shackle 22. In the preferred construction of this embodiment, locking collar 29 comprises a substantially circular shaped member incorporating support base 102 on which upstanding, generally U-shaped wall portion 103 is formed. By constructing wall portion 103 in a substantially U-shape, portal or open zone 101 is formed between the terminating ends of wall portion 103.

In the preferred construction of this embodiment of the present invention, locking collar 29 is securely mounted in elongated bore 110 directly adjacent top surface 50 of housing 21. Preferably, locking collar 29 is press-fitted or frictionally engaged in bore 110 in order to assure movement-free affixation of locking collar 29 with housing 21. In addition, as shown in FIGS. 20 and 23–26, portal/open zone 101 of locking collar 29 is positioned in alignment with cutout zone 115 formed in housing 21 for cooperating with locking collar 29. In this way, a pathway is established for the passage of short leg 25 of shackle 22 when key controlled section 24 of padlock 20 is in the open position, as is detailed below.

In order to provide the desired locked, captured engagement of short leg 25 of shackle 22 with locking collar 29, as well as enable shackle 22 to be released from locking collar 29, when desired, this embodiment of padlock 20 incorporates movable plate member 100, which is constructed for co-operating with locking collar 29, portal/open zone 101, and cutout zone 115. As fully detailed below, plate member 100 is constructed for being vertically movable relative to locking collar 29, for effectively opening and closing portal/open zone 101 and cutout zone 115. In this way, the arcuate pivoting movement of shackle 22 about the axis of its long leg 27 is completely controlled by locking section 24 of padlock 20.

As shown in FIGS. 20–26, in this embodiment of the present invention, cylinders 111 and 112 are coaxially mounted in elongated bore 110 for rotational movement therein about the central axes of cylinders 111 and 112. As fully detailed herein, rotational movement of cylinders 111 and 112 is attainable only when the designated key 89 is inserted in the key receiving slot formed in cylinder 112. Furthermore, as discussed above, the key-controlled rotational movement of cylinder 112 causes cylinder 111 to rotate simultaneously therewith, due to the secure interengagement of cylinders 111 and 112.

In its preferred construction, cylinder 111 is constructed with a substantially circular shaped base portion 118, with channel 113 formed in one end thereof. On the opposed end, axially extending support pin 119 is formed, with circular shaped plate 120 mounted on the opposed end of pin 119. Finally, the construction of cylinder 111 is completed by positioning upstanding, axially extending, substantially cylindrical post 121 on the upper surface of plate 120, with post 121 comprising a substantially flat, top surface 122 and a curved outer surface 123. In addition, as depicted, post 121 is constructed with an overall diameter less than the diameter of plate 120 and base 118.

Post 121 also incorporates cam slot 124 formed in curved, outer surface 123, with cam slot 124 extending at a sloping angle relative to substantially flat top surface 122. In the preferred construction, the slope angle employed for cam slot 124 ranges between about 30° and 60°. Furthermore, in its preferred embodiment, sloping cam slot 124 terminates directly adjacent top surface 122, in a substantially horizontally extending section 125, with section 125 extending substantially parallel to top surface 122.

In completing the preferred construction of this embodiment of the present invention, movable plate member 100 is mounted in elongated bore 110 directly adjacent top surface 50 of housing 21 in co-operating relationship with locking collar 29, while also being movably controlled by the rotation of cylinder 111. Preferably, movable plate member 100 comprises wall member 104, having an inside surface 105 and outside surface 106, with wall member 104 being constructed with an arcuately curved configuration that is dimensioned for insertion in co-operating sliding engagement with elongated bore 110. In this regard, the overall thickness of wall member 104 is constructed for nested, sliding engagement between outer surface 123 of post 121 and the inside surface of bore 110.

In addition, plate member 100 incorporates arcuately curved blocking segment 107 which is mounted to inside surface 106 of wall member 104. As depicted, blocking segment 107 is mounted near the upper edge of wall member 104, with a portion of blocking segment 104 extending beyond the terminating upper edge of wall member 104. Finally, the construction of movable plate member 100 is completed by forming cam follower pin 108 on inside surface 105 of wall member 104, positioned near the bottom edge thereof, with pin 108 radially extending inwardly from wall member 104.

In the preferred construction, blocking segment 107 is dimensioned with an overall, arcuately curved width which is substantially equivalent to the arcuate curved width of portal/open zone 101 of locking collar 29. In this way, as shown in FIG. 25, when movable plate member 100 is in its first, upper, raised position, blocking segment 107 effectively closes upstanding, U-shaped wall portion 103, sealing portal/open zone 101 and effectively locking short leg 25 of shackles 22 in locking collar 29 by peripheral, surrounding engagement thereof.

In addition, as shown in FIG. 26, whenever plate member 100 is moved into its second, lowered position, blocking segment 107 is moved out of closing alignment with U-shaped wall portion 103 of locking collar 29, effectively opening portal/open zone 101 thereof for enabling short leg 25 of shackle 22 to move through portal/open zone 101 and cutout zone 115, enabling shackle 22 to be arcuately pivoted and released from locked engagement with housing 21. In this way, the desired secure locked engagement of shackle 22 with housing 21 is achieved, along with the quick and easy release of shackle 22 from housing 21, by employing key controlled section 24 of padlock 20.

In order to achieve the desired vertical movement of plate member 100 for controlling the locking engagement and/or release of short leg 25 of shackle 22, plate member 100 is positioned in elongated bore 111 with the movement thereof completely controlled by the rotational movement of cylinder 111. In attaining this construction, outside surface 106 of wall member 104 is positioned in sliding engagement with the inside surface of bore 110, while inside surface 105 of wall member 104 is positioned in sliding engagement with outside surface 123 of post 121. In addition, radially extending, follower pin 108 is mounted in cam slot 124 and/or slot 125 for controlled movement therein.

Figure 25:
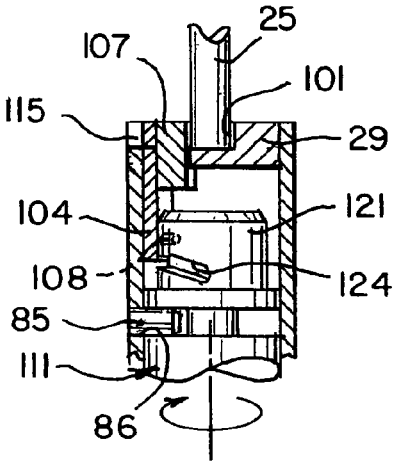
FIG. 25 is a cross-sectional side elevation view, partially broken away, taken along line 25—25 of FIG. 23 and depicting this embodiment of the dual mode padlock in its locked configuration.
Figure 24:
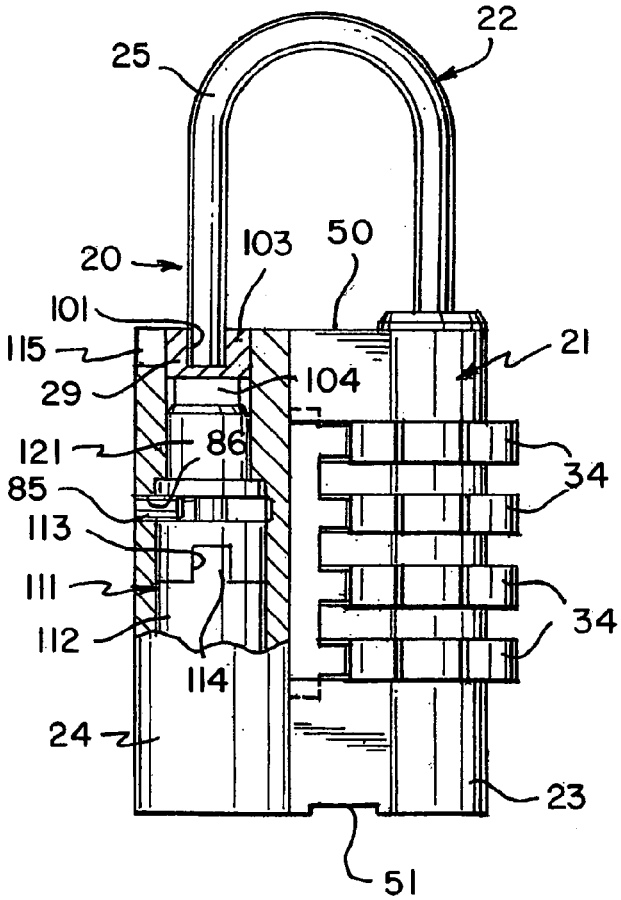
FIG. 24 is a side elevation view, partially broken away, of the dual mode padlock of FIG. 23.

As best seen in FIGS. 25 and 26, the rotational movement of cylinders 111 and 112 causes plate member 100 to vertically move between its first positioned and its second position. As previously discussed, cylinders 111 and 112 are capable of only rotational movement about their central axes. Vertical movement of cylinders 111 and 112 is prevented. Consequently, when the designated key is inserted into cylinder 112 for enabling cylinder 112 to be rotated about its central axis, cylinder 111 simultaneously rotates therewith. This rotational movement causes follower pin 108 to first move from extension slot 125 into sloping cam slot 124 and, thereafter, to move through sloping slot 124.

Thereafter, once follower pin 108 is in upper portion of sloping cam slot 124, the continued rotation of the cylinder 111 forces follower pin 108 to move downwardly through cam slot 124 as cylinder 111 continues to rotate. The downward movement of pin 108 causes wall member 104 and blocking segment 107 to move vertically downwardly in elongated bore 110, effectively removing blocking segment 107 from cooperating engagement with locking collar 29. In this way, short leg 25 of shackle 22 is released and, once plate member 100 has been moved into its second position, shackle 22 is capable of pivoting out of engagement with locking collar 29, thereby enabling padlock 20 to be released. In this way, an alternate preferred embodiment for constructing key controlled locking section 24 is attained in a manner which provides secure locked engagement of short leg 25 of shackle 22, while also enabling the quick and easy release of short leg 25 whenever a user has an authorized key.

As discussed above, cylinder 112 incorporates key receiving slot 88 formed in the base thereof which is constructed for cooperating controlled relationship with key 89. Furthermore, cylinder 112 incorporates a plurality of spring biased tumblers 87 which are constructed for cooperating with cut-out zones formed on key 89.

In this construction, which is conventional in key controlled locking, tumblers 87 prevent the arcuate movement of cylinder 112 unless all tumblers 87 are positioned in a precise, predetermined alignment and/or arrangement. When in the desired aligned position, cylinder 112 is capable of being arcuately rotated.

In addition, in order to achieve the precisely desired aligned position for enabling cylinder 112 to be arcuately rotated, key 89 is employed for axially positioning each tumbler 87 in the precisely desired, predetermined position. In addition, key 89 provides the necessary leverage for enabling cylinder 112 to be arcuately pivoted.

Once key 89 is inserted into slot 88 of cylinder 112, tumblers 87 are aligned in the precisely desired predetermined position, enabling cylinder 112 to be arcuately rotated. In addition, since flange 114 of cylinder 112 is engaged within channel or slot 113 of cylinder 112, the arcuate pivoting movement of cylinder 112 simultaneously causes cylinder 111 to arcuately pivot therewith. Furthermore, with plate member 100 movably controlled by the rotation of cylinder 111, the arcuate pivoting movement of cylinder 111 causes plate member 100 to move between its two alternate positions, either locking shackle 22 or releasing shackle 22.

By referring to FIG. 27–75, along with the following detailed disclosure, the preferred construction and operation of five further alternate embodiments of the present invention can best be understood. In these five further alternate embodiments, padlock constructions are detailed which incorporate a signal or indicator which is automatically activated whenever the key control locking section of the padlock is employed. As a result, whenever the padlock is opened by a third-party, unknown to the user/owner, such as security personnel in an airport, the padlocks of the present invention automatically provide a signal or indicator which enables the owner/user to immediately know that the padlock has been opened. Furthermore, since the signal or indicator is incapable of being reset by the third-party, the user/owner is assured that this information will be provided, without interference by the third-party.

In the five alternate indicator/signal providing embodiments depicted and disclosed herein, all embodiments are fully and completely disclosed in FIGS. 27–75, in association with the padlock construction disclosed and detailed above in reference to FIGS. 1–26. However, as will be evident from the following detailed discussion, alternate embodiments may be employed with equal efficacy using either of the padlock constructions disclosed and detailed above in reference to FIGS. 1–26. Consequently, although the second alternate embodiment of the padlock construction is employed for exemplifying the full and complete disclosure of most of the signal/indicator providing embodiments of this invention, it is to be understood that this invention is not limited to this one embodiment and both embodiments of the padlock construction detailed above can be employed with equal efficacy, as well as any further alternate padlock constructions coming within the scope of the present invention.

In FIGS. 27–33, the first preferred construction for providing dual mode padlock 20 with an automatically initiated signal or indicator assembly 130 is fully depicted. In this embodiment, as fully detailed above, dual mode padlock 20 comprises housing 21, shackle 22, combination controlled locking section 23 formed on one side of housing 21, and key controlled locking section 24 formed on the opposed side thereof.

In this embodiment, housing 21 of padlock 20 is preferably formed in two mating sections, front panel section 126 and rear panel section 127. In addition, key receiving cylinder 112 is preferably rotationally mounted in sleeve member 128, which is secured within housing 21. In this construction, sleeve member 128 securely retains cylinder 112 and enables cylinder 112 to be rotationally movable in response to the receipt of an appropriate key 89, for releasing shackle 22 from the locked position.

For purposes of convenience, the components forming padlock 20 which are substantially identical to the components detailed above in reference to FIGS. 20–26 are shown in FIGS. 27–42, using the identical numeral references. In addition, in order to avoid repetition, a detailed disclosure of these components is not provided, and the disclosure provided above is incorporated herein by reference. Consequently, any questions which may exist regarding particular numeral references, and the components designated thereby, should be immediately apparent by referring to the foregoing detailed discussion.

As shown in FIGS. 27–33, automatically initiated signal/indicator assembly 130 principally comprises elongated, substantially cylindrically shaped rod 131, slider plate 132, and locking plate 133. As detailed below, each of these components are movably mounted in housing 21, in controlled interengagement with each other, for assuring the consistent, repeatable, trouble-free, dependable operation of signal/indicator assembly 130.

In the preferred construction of this embodiment of the present invention, cylindrically shaped rod 131 is mounted in cylindrically shaped, longitudinally extending channel 134 formed in the housing 21. Although the Figures principally depict the formation of channel 134 in rear panel section 127, a similar, cooperating portion of channel 134 is also formed in front panel section 126 for assuring complete, surrounding engagement of rod 131 in channel 134. In addition, as depicted, spring member 135 is mounted in the base of channel 134 in direct contact with rod 131, continuously biasing rod 131 to move in an upward direction.

In the preferred construction, rod 131 comprises a plurality of separate and distinct sections, with each section having a diameter different from the adjacent sections. In the preferred configuration, rod 131 comprises sections 136, 137, 138, 139, and 140, with sections 137 and 139 comprising diameters smaller than the diameters of the sections adjacent thereto. Sections 136, 138, and 140 may comprise identical diameters or, if desired, different diameters. However, in the preferred construction, regardless of diameters of sections 136, 138, and 140, sections 137 and 139 must comprise diameters which are smaller than the diameters of the adjacent sections.

In order to control the vertical movement of elongated rod 131, slider plate 132 incorporates a substantially rectangle or square shaped cut out zone 145 formed therein, with an articulately curved cut out zone 146 formed in slider plate 132 and interconnected with and extending from one side of cut out zone 145. In addition, cut out zones 145 and 146 are formed substantially in the center of slider plate 132, with elongated rod 131 positioned for extending through cut out zones 145 and 146, when in the fully assembled configuration.

Slider plate 132 is mounted in receiving cavity 147 which is formed in housing 21. In addition, receiving cavity 147 is constructed to enable slider plate 132 to longitudinally move within housing 21 in a direction which is substantially perpendicular to the longitudinal axis of cylinders 111 and 112. Furthermore, slider plate 132 incorporates a forwardly extending ledge 148 formed along one edge thereof and positioned for co-operative interengagement with notch 149 formed in cylinder 111. Finally, slider plate 132 is controllably engaged with spring member 150, which is mounted on the edge of slider plate 132 opposite from the edge of slider plate 132 from which ledge 148 extends. In this way, slider plate 132 is continuously biased by spring member 150 in a manner which causes ledge 148 of slider plate 132 to be continuously engaged with notch 149 of cylinder 111.

The construction of this embodiment of signal/indicator assembly 130 is completed by movably mounting locking plate 133 in receiving cavity 154 which is formed in housing 21. In the preferred construction, locking plate 133 incorporates an upstanding wall 155 which is mounted substantially perpendicularly to slider plate 132, and comprises an articulately curved cut out zone 156 formed in the forward end of slider plate 132. In addition, receiving cavity 154 is positioned in cooperating alignment with keyhole shaped aperture 157 formed in rear panel section 127, with keyhole shaped aperture 157 positioned for being in cooperating relationship with wall 155 of locking plate 133.

Finally, spring member 158 is mounted in cooperating relationship with the end of locking plate 133 which is opposed from the end of locking plate incorporating cut out zone 156. In this way, spring member 158 continuously biases locking plate 133 to move in a direction towards rod 131, forcing cutout zone 156 to be continuously engaged with rod 131.

When positioned in housing 21, locking plate 133 is movably mounted for longitudinal movement in a direction substantially parallel with slider plate 132. In addition, locking plate 133 is positioned for moving substantially perpendicularly to elongated rod 131, for providing locking and releasing interengagement therewith, as detailed below. Furthermore, with wall 155 of locking plate 133 positioned in cooperating alignment with keyhole shaped aperture of 157, locking plate 133 is capable of being slidingly moved by the user/owner in order to release locking plate 133 from locked engagement with rod 131, as is fully detailed below.

When positioned in housing 21, locking plate 133 is mounted for longitudinal movement in a direction substantially parallel with slider plate 132. In addition, locking plate 133 is positioned for moving substantially perpendicularly to elongated rod 131, for providing locking and releasing interengagement therewith, as detailed below. Furthermore, with wall 155 of locking plate 133 positioned in cooperating alignment with keyhole shaped aperture 157, locking plate 133 is capable of being slidingly moved by the user/owner in order to release locking plate 133 from locked engagement with rod 131, as is fully detailed below.

Figure 28:
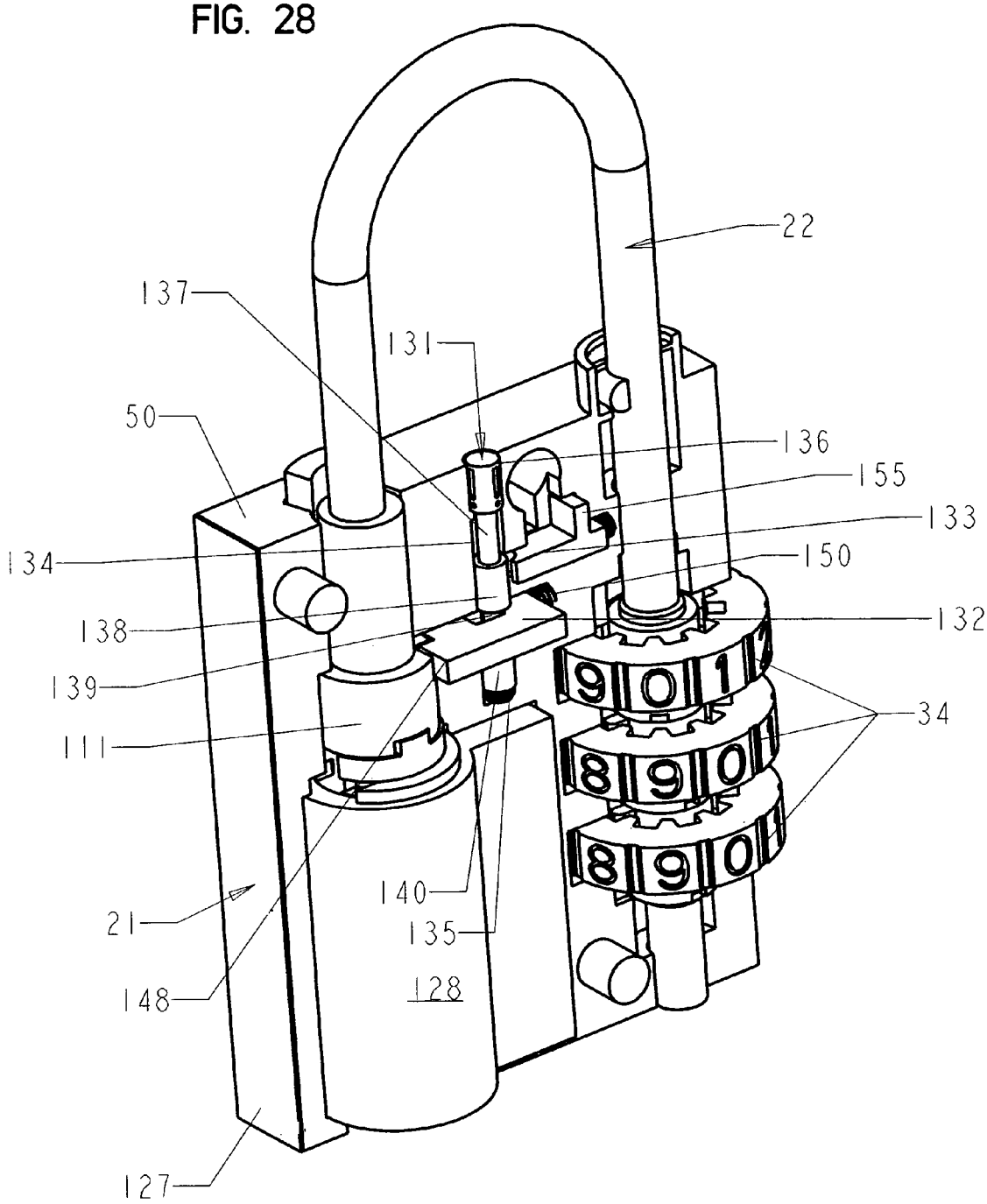
FIG. 28 is a front perspective view of the dual mode locking padlock incorporating a signal/indicator assembly of FIG. 27, shown in the locked position.
Figure 29:
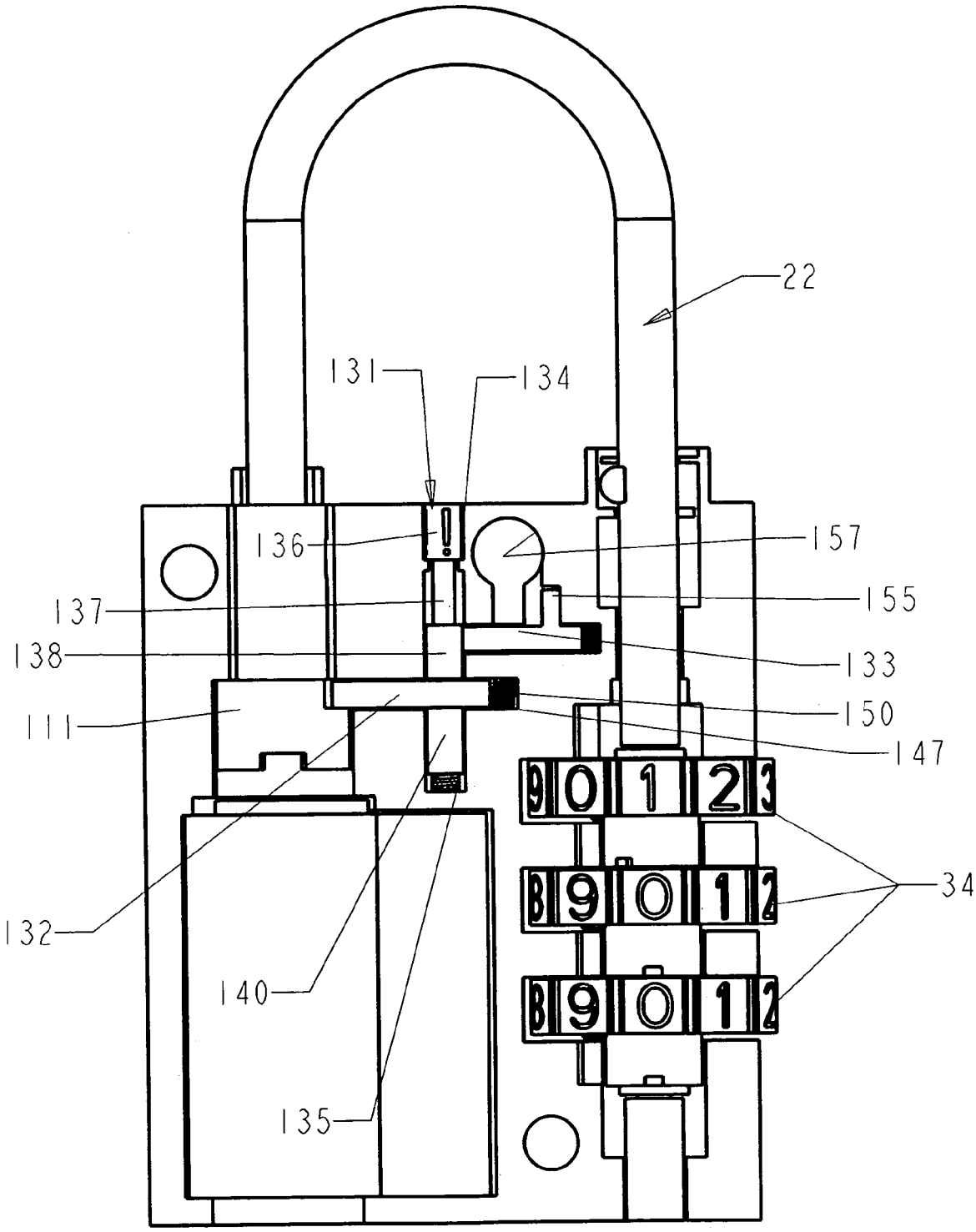
FIG. 29 is front elevation view of the dual mode locking padlock incorporating a signal/indicator assembly of FIG. 28.

When fully assembled in its locked and secured operational position, as shown in FIGS. 28 and 29, dual locking mode padlock 20 of this embodiment of the present invention incorporates elongated rod 131 securely mounted within housing 21. In order to maintain elongated rod 131 in this position, rod 131 is mounted vertically extending through rectangular cut out zone 145 and curved cutout zone 146 of slider plate 132. In addition, when in this normal, unactivated position, curved cutout zone 146 is engaged with section 139 of rod 131 with the top surface of slider 132 positioned adjacent the lower end of section 138, while the bottom surface of slider 132 is positioned above the top surface of section 140. As a result, with slider plate 132 biased to be maintained in this position, rod 131 is virtually locked in its unactivated position by the engagement of cutout zone 146 of slider plate 132 within section 139, and forced to remain in this position until curved cutout zone 146 of slider plate 132 is disengaged from locked engagement with section 139.

In addition, when padlock 20 is in its normal locked and unactivated position, locking plate 133 is biased into contact with rod 131. As shown in FIGS. 28 and 29, cut out zone 156 of locking plate 133 is forced into direct contact with section 138 of rod 131, due to the biasing forces of spring member 158. In addition, while rod 131 remains in the unactivated position, direct contact between cut out zone 156 of locking plate 133 with section 138 of rod 131 is continuously maintained.

During most normal operations, dual locking mode padlock 20 is securely mounted to a desired product, such as the suitcase, and remains in the configuration detailed above, with shackle 22 securely locked in engagement with housing 21. However, whenever key controlled locking section 24 of padlock 20 is employed, signal/indicator assembly 130 is activated, causing elongated rod 131 to be automatically forced upwardly with section 136 thereof being readily visible as section 136 extends upwardly, above top surface 50 of housing 21.

In this regard, as shown throughout the Figures, section 136 is preferably constructed with indicia 159 formed thereon for providing increased visibility and enhanced ease of recognition that section 136 has been raised above top surface 50 of housing 21. Preferably, the desired indicia comprise one of more selected from the group consisting of colors, alphanumeric markings, and symbols. As shown, indicia 159 is in the form of an exclamation mark, which may be colored red, for enhanced notice and visibility.

By employing this embodiment of signal/indicator assembly 130, elongated rod 131 is forced to move vertically upwardly, from a position within housing 21 to a position outside of housing 21, whenever key controlled locking section 24 of padlocked 20 is employed. In this regard, when key controlled locking section 24 is used, key 89 is inserted into cylinder 112, causing cylinder 112 to arcuately rotate within sleeve member 128. This arcuate rotation also causes cylinder 111 to arcuately rotate, releasing shackle 22 in the manner detailed above.

Furthermore, in order to assure that elongated rod 131 is automatically activated whenever key controlled locking section 24 of padlocked 20 is employed, the arcuate rotation of cylinder 111, which is required to release shackle 22 from engagement therewith, causes notch 149 to rotate. This arcuate rotation by notch 149 forces ledge 148 to move in a direction causing slider plate 132 to be moved away from cylinder 111, against the biasing forces of spring member 150.

In addition, the longitudinal movement of slider plate 132 causes curved cutout zone 146 to move out of engagement with section 139 of elongated rod 131. Once curved cutout zone 146 is fully disengaged from section 139 and rod 131, elongated rod 131 is free to move upwardly through cutout zone 145, due to the biasing forces of spring member 135 and the construction of cutout zone 145 with dimensions substantially greater than the diameter of rod 131.

Figure 31:
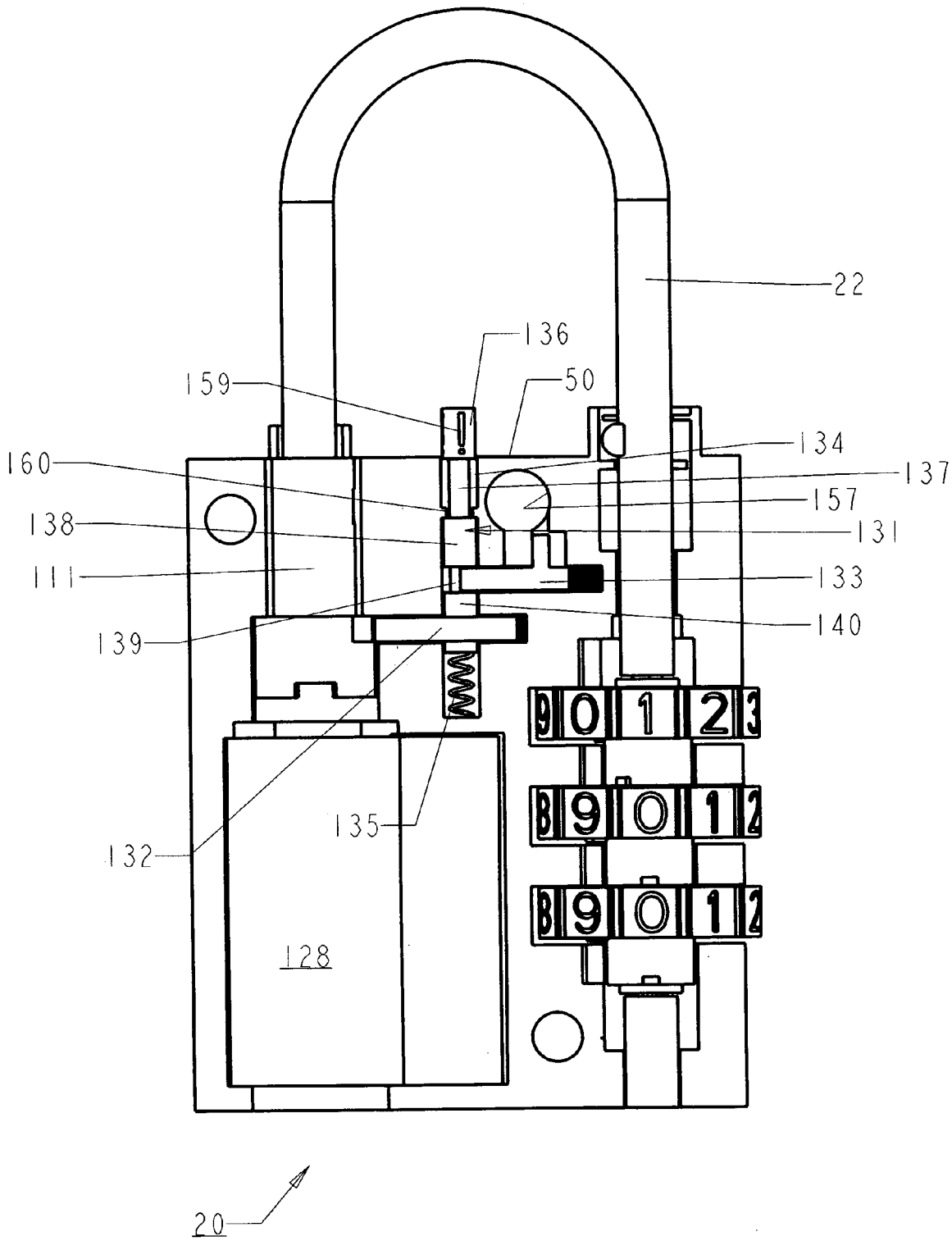
FIG. 31 is a front elevation view of the dual mode locking padlock of FIG. 30.
Figure 32:
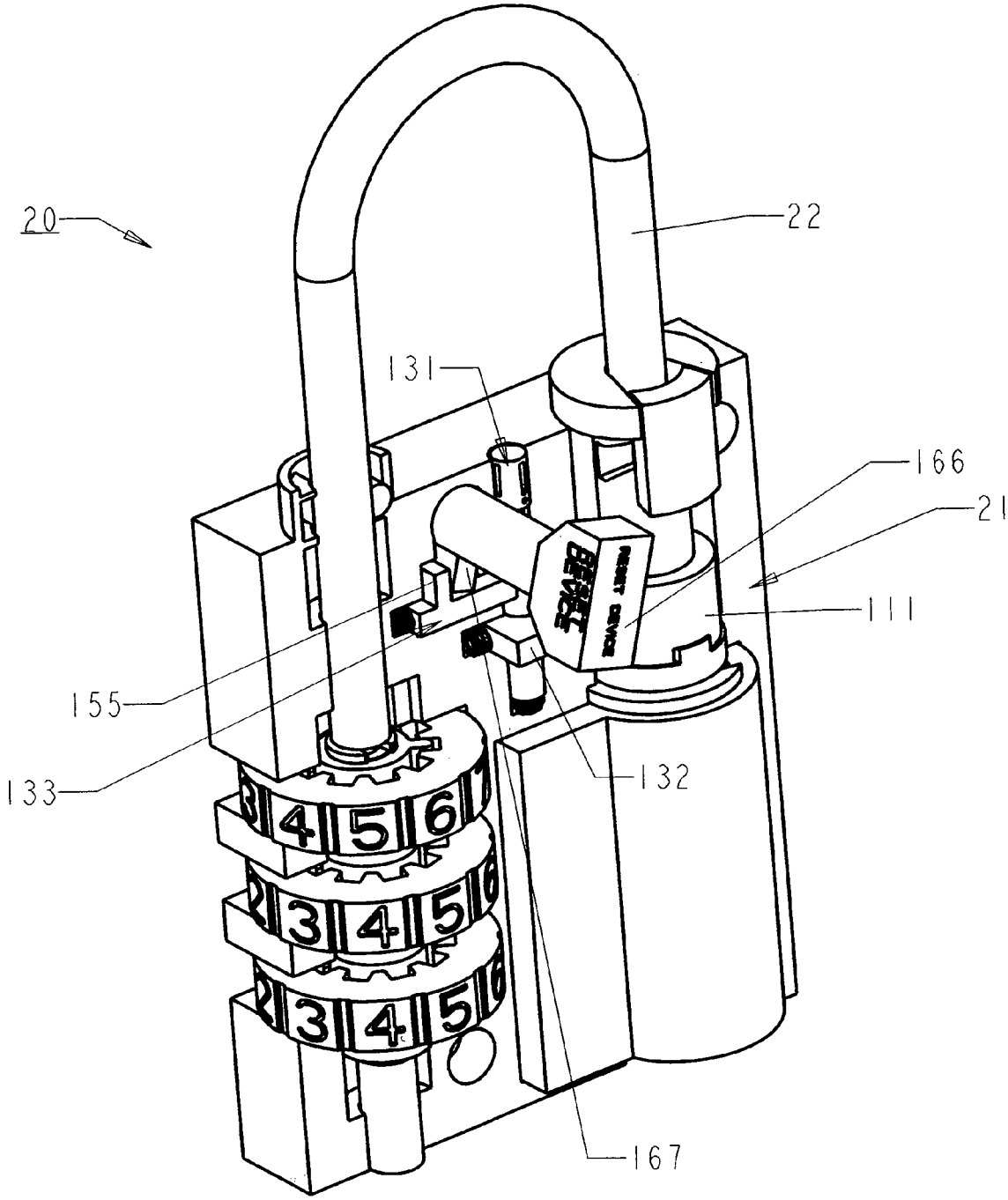
FIG. 32 is a rear perspective view of the dual mode locking padlock of the present invention shown in the process of being reset into its original position.
Figure 33:
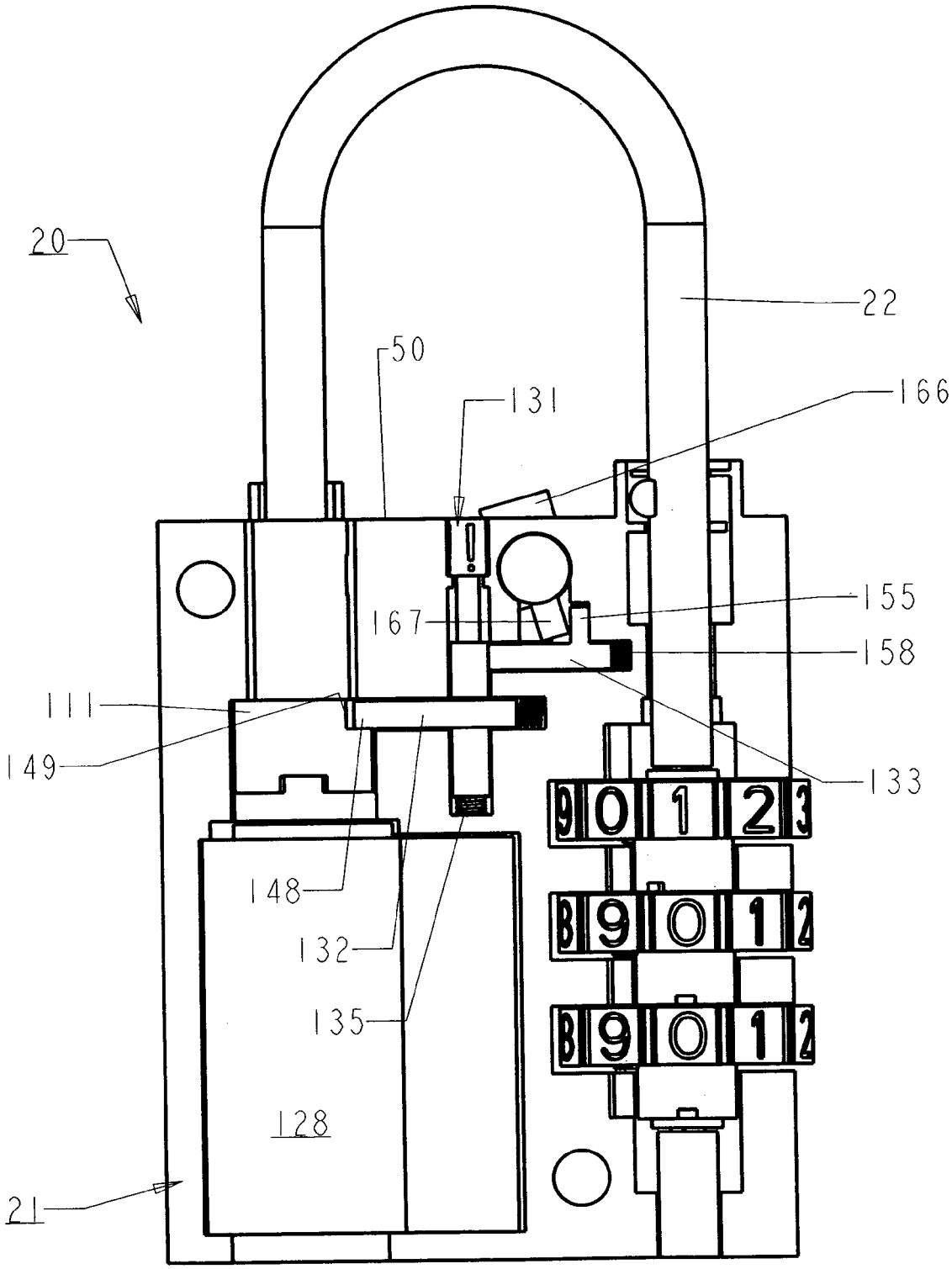
FIG. 33 is front elevation of the dual mode locking padlock of FIG. 32.

In order to control or limit the vertical movement of elongated rod 131 in longitudinally extending channel 134, channel 134 incorporates a flange 160 which radially extends inwardly at a desired location spaced below the entryway to channel 134. As best seen in FIG. 31, radially extending flange 160 is positioned at the precise location desired for contacting the top surface of section 138 to effectively stop the upward movement of rod 131. In addition, flange 160 is positioned at the precise location, which enables section 136 of rod 131 to be fully extended outwardly from channel 134 of housing 21. In this way, section 136 is capable of being readily observed by the user/owner.

In addition to controlling and limiting the vertical movement of elongated rod 131, radially extending flange 160 is also positioned for aligning section 139 with locking plate 133. As a result, when elongated rod 131 is activated and moves upwardly for being displayed from top surface 50 of housing 21, while also being maintained in this position by radially extending flange 160, locking plate 133 is horizontally aligned with section 139 of elongated rod 131. Furthermore, since locking plate 133 is continuously biased towards elongated rod 131 by spring member 158, the biasing force exerted by spring member 158 forces cutout zone 156 of locking plate 133 to move into engagement with section 139 of rod 131, effectively locking elongated rod 131 in the raised position.

Figure 30:
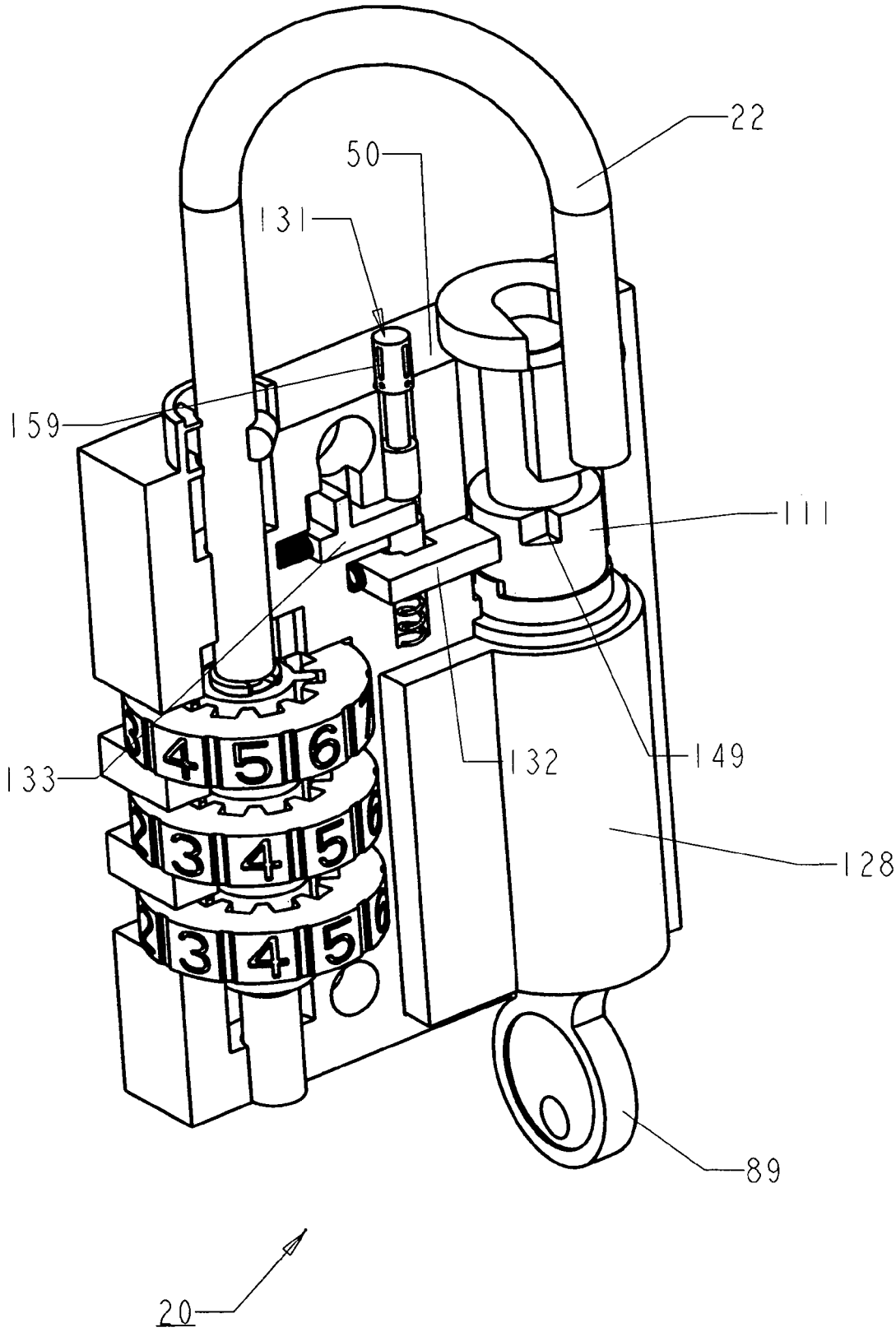
FIG. 30 is a front perspective view of the dual mode locking padlock of the present invention, shown after being opened by a key and with the indicator assembly activated.

As shown in FIGS. 30 and 31, when elongated rod 131 has been raised into its display position, the top surface of locking plate 133 is positioned adjacent the lower surface of section 138, while the bottom surface of locking plate 133 is positioned adjacent the top surface of section 140. As a result, rod 133 is effectively locked, incapable of vertical movement due to the secure locking engagement of plate 133 with section 139 of rod 131.

By employing this construction, the individual employing key 89 to release shackle 22 from engagement with housing 21, for inspecting the contents of a particular suitcase, is able to return padlock 20 into its locked position by returning shackle 22 into engagement with housing 21. However, although the arcuate rotation of tumblers 112 and 111 causes the tumblers to return to their original position, for locking engagement with shackle 22, rod 131 is incapable of returning to its original position.

In this regard, with locking plate 133 securely engaged with section 139 of rod 131, vertical movement of rod 131 is incapable of being achieved. Furthermore, cutout zone 145 of slider plate 132 is in contact with section 140 of rod 131, preventing arcuately curved cutout zone 146 of slider plate 132 from engaging with rod 131, since the diameter of section 140 is larger than the diameter of cutout zone 146. As a result, ledge 148 remains disengaged from notch 149 of tumbler 111.

As is evident for the foregoing detailed discussion, once elongated rod 131 has been activated and moves into the raised, alert providing position, rod 131 is incapable of being returned to its original position by the third party who has opened padlock 20. Instead, a special key, which is in the personal possession of the user/owner, must be employed in order to reset rod 131 into its original position. This operation is fully detailed in FIGS. 32 and 33.

In order to release elongated rod 131 from locked engagement with locking plate 133, reset key 166 is required. In addition, in order to achieve the desired return of rod 131 into its original position, reset key 166 is inserted through keyhole slot 157 of rear panel section 127 of housing 21. Once inserted into the proper position, reset key 166 is rotated, causing radially extending finger 167 of reset key 166 to contact wall 155 of locking plate 133.

As reset key 166 is rotated further in the proper direction, finger 167 controllably engages wall 155, forcing wall 155 and locking plate 133 to move longitudinally against the biasing forces of spring member 158. This longitudinal movement causes cut out zone 156 to become disengaged from section 139 of rod 131, effectively releasing rod 131 from locked engagement with locking plate 133.

Once elongated rod 131 has been released in this manner, rod 131 can be easily moved vertically downwardly, against the biasing force of spring member 135, until slider plate 132 is able to move laterally, causing curved cut out zone 146 of slider plate 132 to engage section 139 of rod 131. Once this position has been reached, rod 131 is returned to locked engagement within housing 21 of padlock 20, with ledge 148 positioned in engagement with notch 149, ready for being activated at the appropriate time.

As is evident from the foregoing detailed disclosure, the embodiment of the present invention depicted in FIGS. 27–33 provides an effective and reliable signal/indicator system which is automatically activated whenever the key controlled locking section of padlock 20 is employed. Furthermore, once the signal/indicator has been activated, the signal/indicator can only be returned to its original position by the user/owner.

In this regard, a special reset key is required for returning the signal/indicator to its original position. Since only the user/owner possesses the reset key, only the user/owner of padlock 20 is able to return the signal/indicator to its original position after being made aware that padlock 20 had been opened by a third party.

In addition to the first preferred embodiment of the present invention as shown in FIGS. 27–33 and fully detailed above, the present invention also comprises a second preferred embodiment for providing a signal/indicator to the user/owner whenever the key controlled locking portion of the padlock of the present invention is employed. In addition, as with the embodiment detailed above, the second embodiment also requires the user/owner to employ a special reset key in order to reposition the signal/indicator into its original position. By referring to FIGS. 34–42, along with the following detailed disclosure, the construction and operation of the second preferred embodiment can best be understood.

In this second preferred embodiment, signal providing, dual locking mode padlock 20 incorporates signal/indicator assembly 130 mounted in housing 21 in cooperating relationship with cylinders 111 and 112. As cylinders 111 and 112 are arcuatly rotated in response to the insertion of a key for releasing shackle 22 from locked engagement with housing 21, the arcuate rotation of cylinder 111 causes signal/indicator assembly 130 to be activated, causing a highly visible alert display to be generated for informing the owner/user that padlock 20 has been opened by using key controlled locking portion 24. In addition, as with the previous embodiment, the alert display is incapable of being reset by anyone other than the user/owner, using a special reset key.

As depicted, in this embodiment of the present invention, housing 21 of padlock 20 preferably comprises two mating sections, front panel section 126 and rear panel section 127. In addition, as with the previous embodiment detailed above, key receiving cylinder 112 is preferably rotationally mounted in sleeve member 128 and is secured within housing 21. Sleeve member 128 securely retains cylinder 112 and enables cylinder 112 to rotationally move in response to the receipt of an appropriate key, for releasing shackle 22 from the locked position.

As shown in FIGS. 34–42, automatically initiated signal/indicator assembly 130 principally comprises substantially cylindrically shaped post member 175, locking bar 176, ball bearing 177, and spring members 178 and 179. By employing these components, which are constructed and mounted in housing 21 in the manner detailed below, a highly effective, reliable, automatically initiated signal/indicator assembly 130 is realized.

In the preferred construction of this embodiment of signal/indicator assembly 130, post member 175 comprises substantially circular shaped plates or disks 184 and 185, formed at the opposed ends of post member 175. In addition, post 175 comprises centrally located, cylindrically shaped shaft 186 extending between and interconnecting circular plates/disks 184 and 185. Furthermore, collar 187 peripherally surrounds a portion of shaft 186, incorporating arm 188 radially extending outwardly therefrom and arcuately curved receiving zone 189. Finally, the construction of post member 175 is completed by spring holding pin 190 and support wall 191, both of which are preferably formed on collar 187.

In completing the construction of this embodiment of signal/indicator assembly 130, locking bar 176 comprises arcuately curved, receiving zone 195 formed in one surface thereof and positioned for being cooperatively associated with ball bearing 177. Pin 196 is formed on another surface of locking bar 176 for securely retaining and supportingly holding spring member 178, while flat surface 197 is formed on bar 176 directly adjacent receiving zone 195.

In order to achieve the desired operation of this embodiment of signal/indicator assembly 130, housing 21 incorporates cavity 198 formed therein, which is constructed for enabling post 175 to arcuately pivot about its central axis in response to the arcuate movement of tumbler 111. In addition, cavity 198 is constructed for enabling locking bar 176 and ball bearing 177 to operate in the desired manner detailed herein.

As is more fully detailed below, post member 175 is constructed for being arcuately pivoted in response to the arcuate movement of tumbler 111. Typically, post member 175 pivots through an arcuate distance of about 90°, as tumbler 111 pivots in controlled engagement with tumbler 112. This arcuate movement of post member 175 causes circular shaped plate/disk 184 to arcuately move, causing alert providing indicia 200, printed on the surface of plate/disk 184 to become readily visible.

In this regard, indicia 200 may comprise a wide variety of alternate constructions and/or configurations, including colors, words, alphanumeric displays, symbols, and the like. As depicted throughout the drawings, indicia 200 comprises the word "ALERT" printed thereon, which may be further emphasized by being in a color such as red. In addition, housing 21 may be constructed in a wide variety of alternate designs and configurations in order to enable indicia 200 to be easily seen.

As shown throughout the drawings, indicia 200 is arcuately pivoted for being positioned into a location cooperating with a portion of housing 21 which enables indicia 200, as printed on a plate/disk 184, to be easily seen from both the side edge and top surface of plate/disk 184. However, this construction is merely exemplary of the numerous alternate constructions which may be employed. If desired, plate/disk 184 may be mounted along the top surface of housing 21, with a small panel covering indicia 200 when in the non-alert position. In this way, whenever plate/disk 184 is arcuately pivoted, indicia 200 would be moved into a highly visible, readily seen position.

Figure 36:
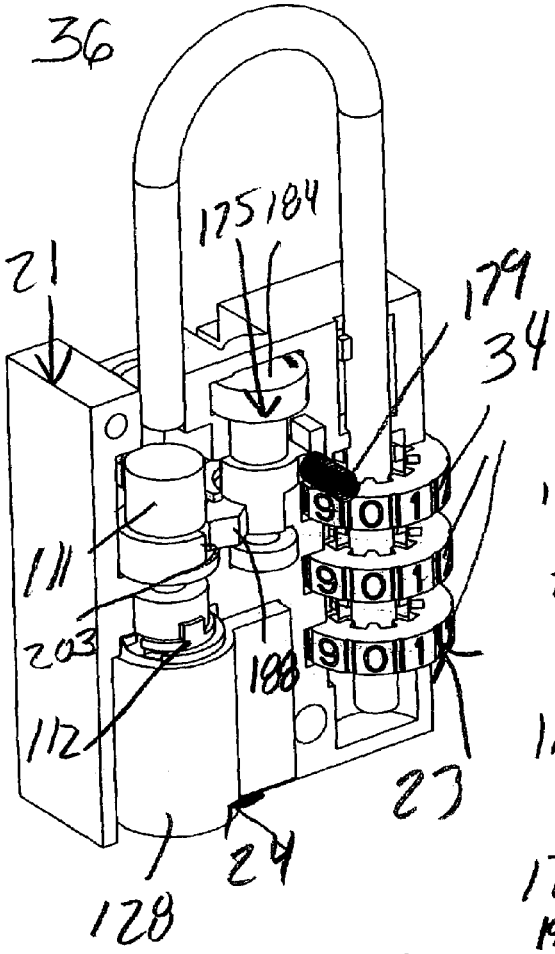
FIG. 36 is a front perspective view of the dual mode locking padlock incorporating a signal/indicator assembly of FIG. 27, shown in the locked position.
Figure 37:
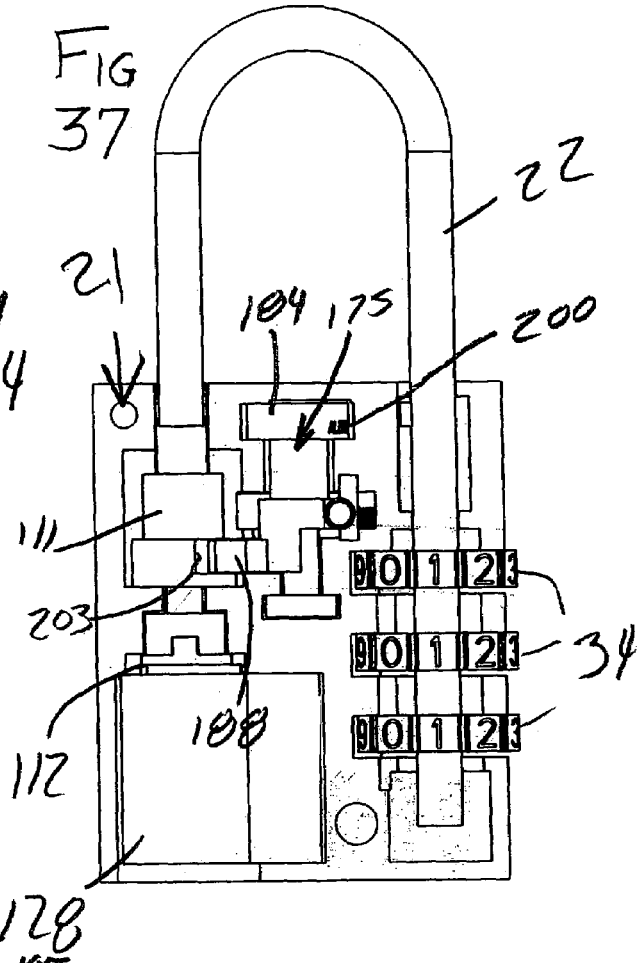
FIG. 37 is front elevation view of the dual mode locking padlock incorporating a signal/indicator assembly of FIG. 36.
Figure 38:
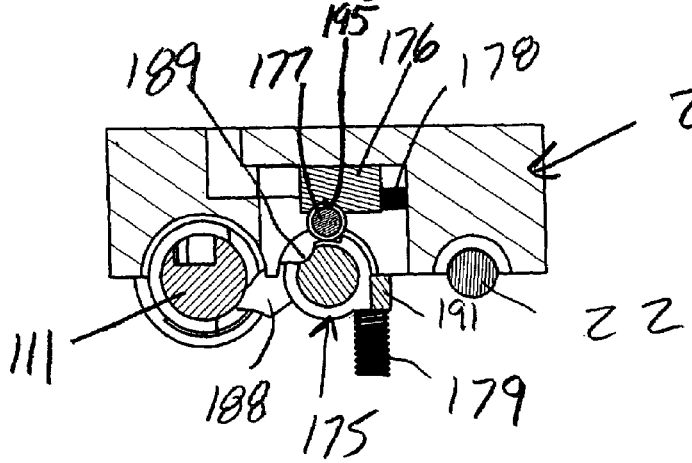
FIG. 38 is a cross-sectional top plan view of the present invention taken along line 38—38 of FIG. 37.

In FIGS. 36–38, dual locking mode padlock 20 is depicted with this embodiment of automatically initiated signal/indicator assembly 130 securely mounted therein, and locked in its non-alert state. When in this position, shackle 22 is in locked engagement with housing 21, retained in this locked position by both combination controlled section 23 and key controlled locking section 24. In addition, alert indicating indicia 200 of plate/disk 184 of post member 175 is locked in the non-alert position, due to the engagement of ball bearing 177 in arcuate receiving zone 195 of locking bar 176.

In this position, ball bearing 177 is sandwiched between ledge surface 192 of collar 187 and arcuate receiving zone 195 of locking bar 176. Due to the sandwiched, frictional interengagement of ball bearing 177 in this position, locking bar 176 is maintained in this position, completely resisting the forces being exerted by spring member 178.

In most operations and use, dual locking mode padlock 20 is securely affixed to a desired product, such as a suitcase, and remains in the configuration detailed above, with shackle 22 securely locked in engagement with housing 21. However, whenever key control locking section 24 of padlock 20 is employed, signal/indicator assembly 130 is activated, causing post member 175 to arcuately pivot, causing indicia 200, as formed on plate/disk 184, to become readily visible.

Figure 40:
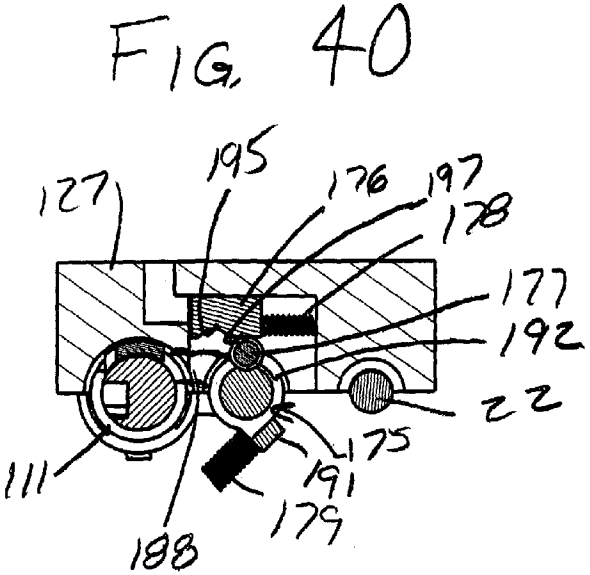
FIG. 40 is a cross-sectional top plan view of the present invention taken along line 40—40 of FIG. 39.
Figure 39:
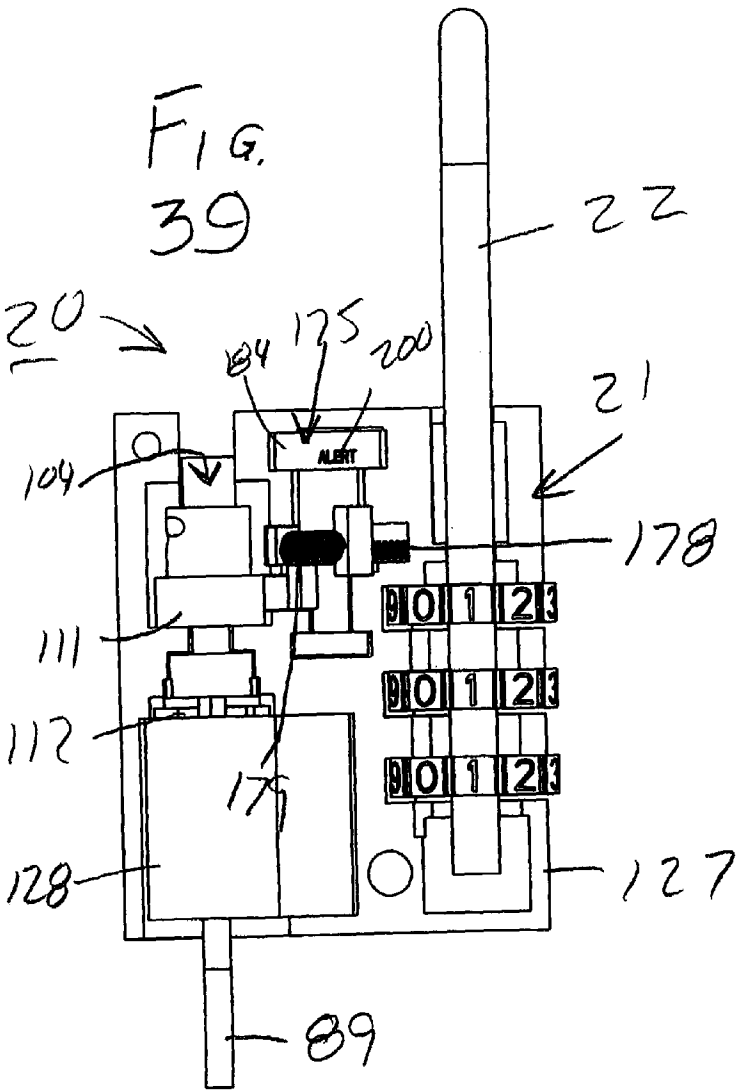
FIG. 39 is a front elevation view of the dual mode locking padlock of the present invention, shown after being opened by a key and with the indicator assembly activated.
Figure 42:
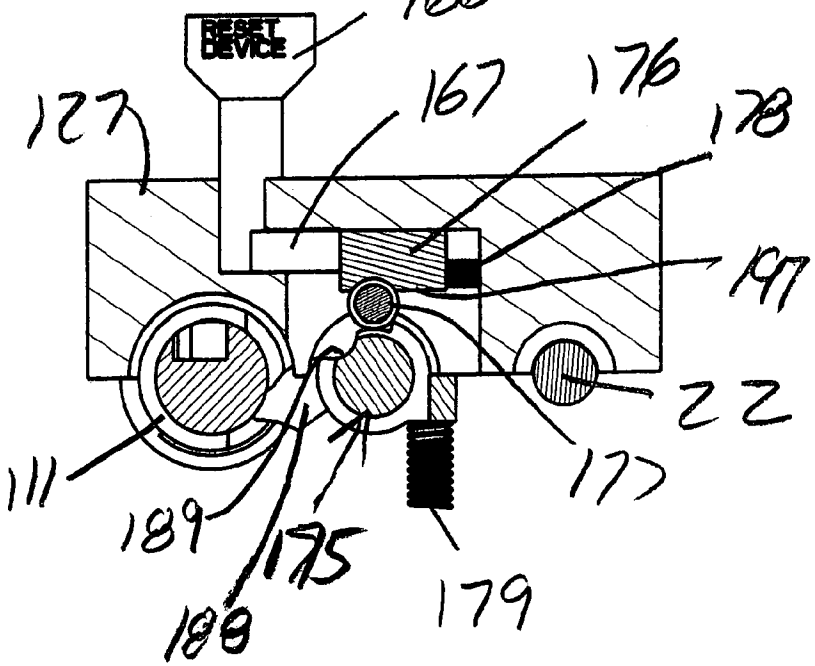
FIG. 42 is a cross-sectional top plan view of the dual mode locking padlock of the present invention, taken along line 42—42 of FIG. 41.
Figure 41:
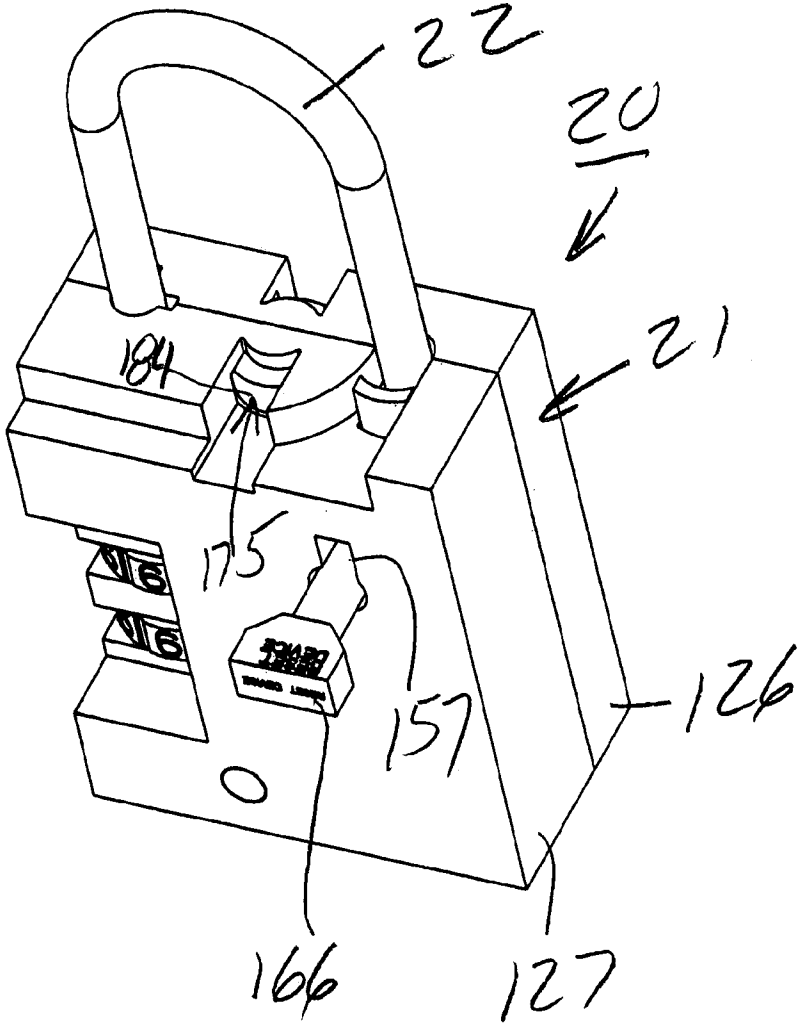
FIG. 41 is a rear perspective view of the dual mode locking padlock of the p resent invention shown in the process of being reset into its original position.
Figures 43, 44:
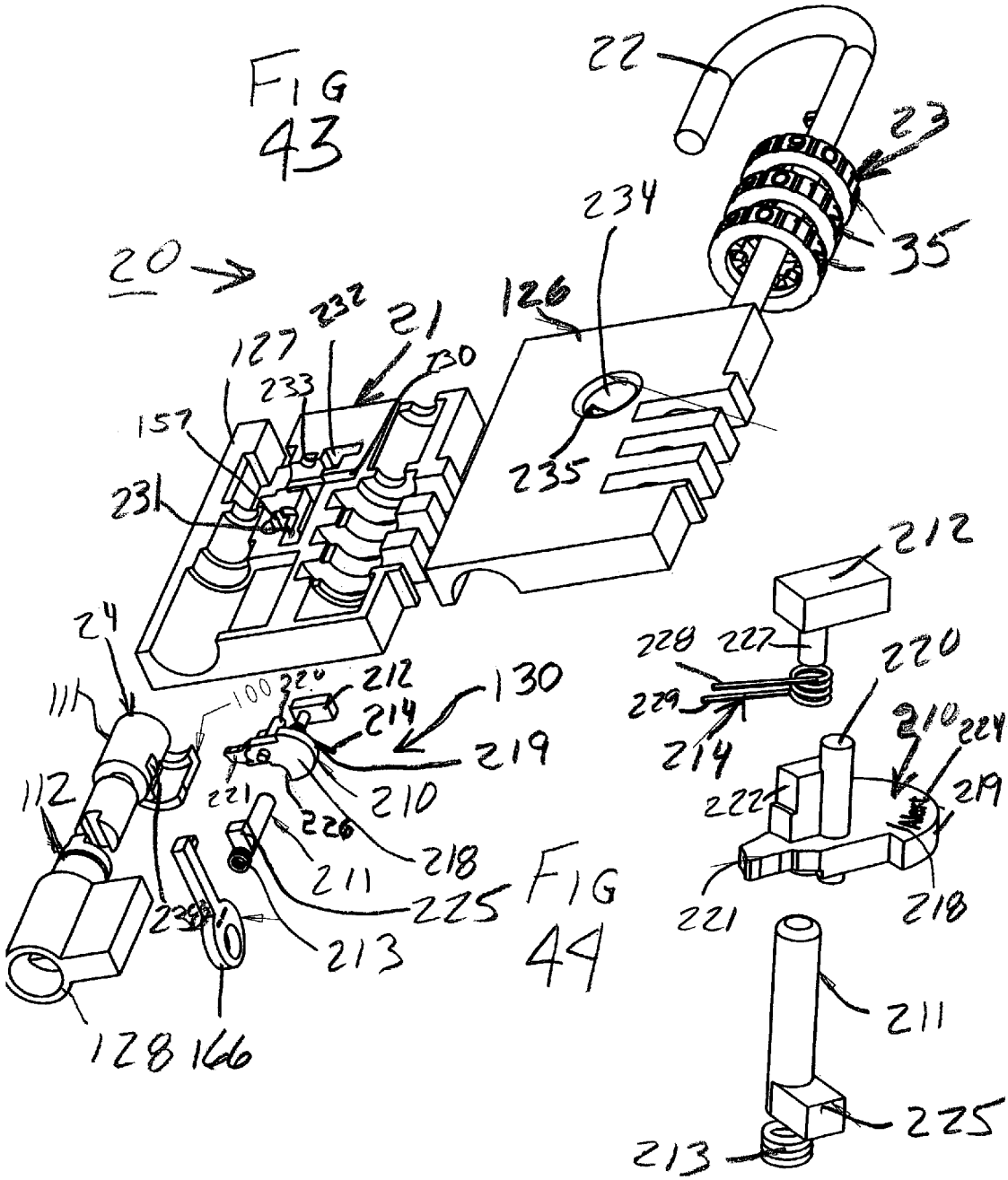
FIG. 43 is an exploded perspective view of an additional still further alternate embodiment of a dual-mode locking padlock incorporating a signal/indicator assembly of the present invention.
FIG. 44 is an enlarged perspective view of the signal/indicator assembly incorporated into the dual mode locking padlock of FIG. 43.

In this regard, as shown in FIGS. 39 and 40, when key control locking section 24 is used, key 89 is inserted into cylinder 112, with the user causing cylinder 112 to arcuately rotate within sleeve 128. This arcuate rotation also causes cylinder 111 to arcuately rotate and release shackle 22 as detailed above. In addition, the arcuate rotation of cylinder 111 also causes post member 175 to arcuately rotate simultaneously therewith, since post member 175 is in controlled engagement with cylinder 111.

Figure 34:
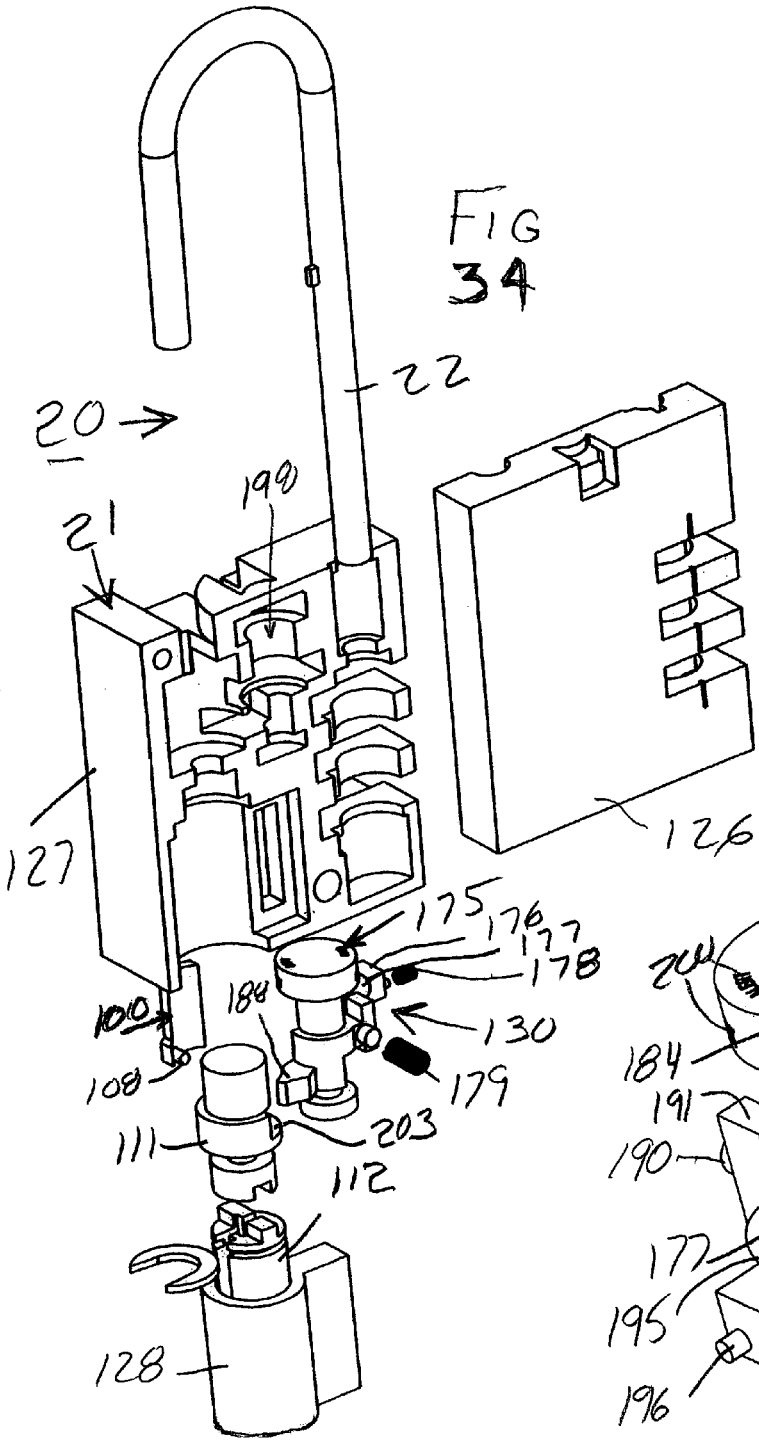
FIG. 34 is an exploded perspective view of a still further alternate embodiment of the dual mode locking padlock of the present invention incorporating an alternate construction for a signal/indicator assembly.
Figure 35:
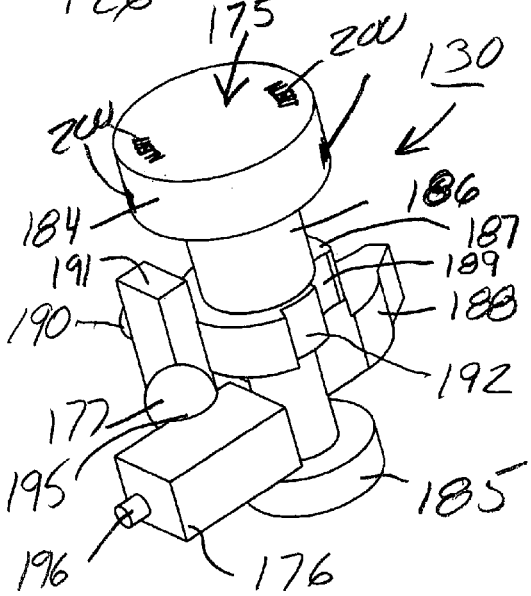
FIG. 35 is an enlarged perspective view of the signal/indicator assembly incorporated into the dual mode locking padlock of FIG. 34.

As best seen in FIGS. 34, 36 and 37, cylinder 111 incorporates an arm engaging cut out zone 203 which is constructed and positioned for contacting arm 188 of post member 175 whenever cylinder 111 is arcuately pivoted by the movement of cylinder 112. As a result, the use of key control locking section 24 of padlock 20 causes cylinder 111 to arcuately pivot, which simultaneously, controllably forces post member 175 to arcuately pivot about its central axis within cavity 198 of housing 21.

As shown in FIGS. 39 and 40, as post member 175 arcuately pivots about its central axis, arcuately curved receiving zone 189 of collar 187 of post member 175 is rotated into juxtaposed, spaced, cooperating relationship with ball bearing 177. Once in this position, ball bearing 177 is able to move out of holding engagement in receiving zone 195 of with locking bar 176. Once ball bearing 177 moves into engagement in cavity 189, the force being exerted by spring member 178 is able to force locking bar 176 to move towards tumblers 111 and 112, causing flat surface 197 of locking bar 176 to contact ball bearing 177, effectively locking ball bearing 177 in receiving zone 189.

In addition, as discussed above, the arcuate rotation of post member 175 causes indicia 200 to be moved into a highly visible position, enabling the user/owner to immediately know that padlock 20 had been opened by employing key control locking section 24. As a result, the desired notice to the user/owner is provided.

Furthermore, once this position has been attained, post member 175 is locked in position, and is incapable of being arcuately pivoted back to its original position, unless a specially constructed reset key is employed. As a result, the individual using key 89 to open padlock 20, typically a security or inspection agent who needs to gain access to the locked product, such as a suitcase, is unable to return post member 175 to its original position. As a result, the user/owner of padlock 20 is assured that indicia 200 will be visible, informing the user/owner that key control locking section 24 of padlock 20 had been employed.

As discussed above, once post member 175 has been pivoted into its alert providing position, post member 175 is incapable of being returned to its original position by the third-party who opened padlock 20, even though shackle 22 is returned into locked engagement with key control locking section 24 of padlock 20. Instead, a special key which is in the personal possession of the user/owner must be employed to reset post member 175 into its original position. This reset operation is fully depicted in FIGS. 41 and 42, and discussed below.

In order to arcuately pivot post member 175 into its original position, with indicia 200 being moved out of its displaying, notice giving position, reset key 166 is inserted into keyhole slot 157 formed in rear panel section 127 of housing 21. Once inserted into the proper position, reset key 166 is rotated, causing finger member 167 of reset key 166 to contact locking bar 176.

Once finger member 167 contacts and engages the front surface of locking bar 176, the continued rotation of reset key 166 causes finger member 167 to force locking bar 176 to move in a direction towards spring member 178, causing locking bar 176 to compress spring member 178, increasing the biasing forces being exerted thereby. However, due to the force exerted by finger member 167 of reset key 166, locking bar 176 is able to be returned to its original position, with arcuate receiving zone 195 of locking bar 176 in juxtaposed alignment with ball bearing 177.

When receiving zone 195 of locking bar 176 has been moved into alignment with ball bearing 177, ball bearing 177 is forced out of arcuately receiving zone 189 of collar 187 of post member 175, due to the biasing force exerted by spring member 179 on post member 175. As a result of this biasing force, post member 175 is arcuately pivoted back to its original position, with ball bearing 177 sandwiched between ledge 192 of collar 187 and arcuate receiving zone 195 of locking bar 176.

Once this position has been reached, post member 175 is effectively locked in this position, due to the frictional engagement of ball bearing 177 with ledge 192 and receiving zone 195. Furthermore, radially extending arm 188 of collar 187 of post member 175 is returned to its original position, in juxtaposed, spaced relationship with arm engaging cut out zone 203 of tumbler 111, ready for engagement therewith whenever tumbler 111 is arcuately pivoted.

In addition to the two alternate preferred embodiments of the present invention shown in FIGS. 27–42 and fully detailed above, the present invention also comprises three further preferred embodiments for providing a padlock with a fully integrated dual locking system with a signal/indicator assembly which is automatically activated to inform the user/owner whenever key controlled locking portion 24 of padlock 20 is employed. By referring to FIGS. 43–54, along with the following detailed disclosure, the construction and operation of this third preferred embodiment of the present invention can best be understood.

As with the previous two embodiments, this embodiment of the present invention is also depicted in association with the padlock construction shown in FIGS. 20–26. However, the alternate embodiment shown in FIGS. 1–19, and fully detailed above, can be employed with equal efficacy. In addition, as with the previous two embodiments detailed above and shown in FIGS. 27–42, this third alternate embodiment provides a signal/indicator to the user/owner whenever the key controlled locking portion 24 of padlock 20 is employed. In addition, this embodiment also requires the user/owner to employ a special reset key in order to reposition the signal/indicator into its original position.

As shown, in this embodiment of the present invention, dual locking mode padlock 20 comprises housing 21, shackle 22, combination controlled locking section 23 formed on one side of housing 21, and key controlled locking section 24 formed on the opposed side thereof. Furthermore, housing 21 of padlock 20 preferably comprises two mating sections, front panel section 126 and rear panel section 127. In addition, as with the previous embodiments detailed above, key receiving cylinder 112 is preferably rotationally mounted in sleeve member 128 which is secured in housing 21. Sleeve member 128 securely retains cylinder 112 and enable cylinder 112 to rotationally move in response to the receipt of an appropriate key, for releasing shackle 22 from the locked position.

For purposes of convenience, the components forming padlock 20 which are substantially identical to the components detailed above in reference to FIGS. 1–42 are shown in FIGS. 43–54 using the identical numeral references. In addition, in order to avoid repetition, a detailed disclosure of these components is not provided, and the disclosure provided above is incorporated herein by reference. Consequently, any questions which may exist regarding particular reference numerals, and the components designated thereby, should become immediately apparent by referring to the foregoing detailed discussion.

As shown in FIGS. 43–54, automatically initiated signal/indicator assembly 130 principally comprises indicator member 210, locking spindle 211, holding block 212 and spring members 213 and 214. By employing these components, which are constructed and mounted in housing 21 in the manner detailed below, a highly effective, reliable, easily constructed, automatically initiated signal/indicator assembly 130 is attained.

In the preferred construction of this embodiment of signal/indicator assembly 130, indicator member 210 comprises an enlarged, substantially flat plate portion 218 preferably terminating at one end thereof in arcuately curved edge 219. In addition, pivot post 220 is mounted substantially midway along the overall width of plate portion 218, extending substantially perpendicularly from flat plate portion 218 from both the top surface and bottom surface thereof. Furthermore, pivot controlling arm member 221 is formed in plate portion 218, extending therefrom at the opposed end from arcuately curved edge 219. Finally, abutment wall 222 is mounted to the top surface of plate portion 218 of indicator member 210, extending substantially perpendicularly therefrom.

In addition, signal providing indicia 224 is formed on the top surface of plate portion 218, in association with arcuately curved edge 219. As discussed above, indicia 224 may comprise any desired form, such as colors, words, alphanumeric designations, symbols, etc. As shown in the drawings, indicia 224 is depicted as the word "ALERT", for exemplary purposes only, which may be further emphasized by being in a color such as red. Furthermore, as is fully detailed below, indicator member 210 is constructed for automatically arcuately pivoting, in response to the use of the key operated portion 24 of padlock 20 to release shackle 22 from locked engagement with housing 21, providing the user/owner with immediate notification that key controlled locking section 24 has been employed.

In completing the construction of this embodiment of signal/indicator assembly 130, indicator member 210 incorporates an arcuately curved locking zone 226 formed along the edge of plate portion 218 directly adjacent curved edge 219. As is more fully detailed below, curved locking zone 226 is constructed for engaging with locking spindle 211 whenever key controlled locking section 24 of padlock 20 is employed. In this way, indicator member 210 is locked in the alert displaying position, retained in this position until reset by the user/owner.

In addition, locking spindle 211 incorporates radially extending ledge 225 formed at the lower end thereof, while holding block 212 incorporates spring retaining shaft 227, about which spring member 214 is mounted. As shown, spring member 214 preferably comprises radially extending arms 228 and 229, with arm 229 in abutting engagement with housing 21, while arm 228 is in direct contact with abutment wall 222 of indicator member 210.

As a result, the spring forces generated by spring member 214 continuously exerts a biasing force on abutment wall 222 of indicator member 210, attempting to force indicator member 210 into its unactivated position, whenever indicator member 210 has been activated. However, due to the locked engagement of spindle 211 with arcuately curved locking zone 226 after activation, the automatic return of indicator member 210 to its original position is prevented, until positive steps are taken by the user/owner to reset signal/indicator assembly 130. This operation is fully detailed below.

In the preferred construction of this embodiment of the present invention, indicator member 210 is retained within cavity 230 formed in housing 21, with pivot post 210 retained in cavity 233 of housing 21, which is constructed for holding post 220 in position and enabling post 220 to arcuately pivot therein. In addition, locking spindle 211 is mounted in cavity 231 which is constructed for enabling locking spindle 211 to be axially movable therein, with spring member 213 mounted at the bottom of cavity 231, in controlling engagement with locking spindle 211. Finally, holding block 212 is securely mounted in cavity 232 of housing 21 which is constructed for securely retaining holding block 212 and spring member 214 in the manner detailed above.

Furthermore, in the preferred construction of this embodiment of the present invention, front panel 126 of housing 21 incorporates enlarged opening 234 formed directly in the side wall thereof, positioned for cooperating with indicator member 210. As depicted, enlarged opening 234 incorporates slot 235 which is constructed for enabling arcuately curved edge 219 of plate portion 218 of indicator member 210 to pass therethrough, whenever signal/indicator assembly 130 is activated. In this way, arcuately curved edge 219 of plate portion 218 of indicator member 210 extends completely through slot 235 of front panel 126, assuring that the user/owner is able to immediately see indicia 224, whenever signal/indicator assembly 130 has been activated by the use of key controlled locking section 24.

Figure 45:
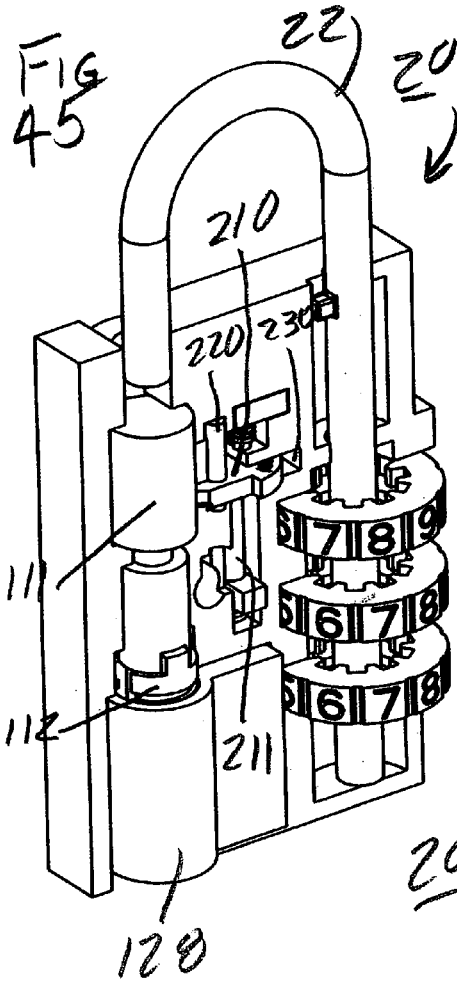
FIG. 45 is a front perspective view of the dual mode locking padlock incorporating the signal/indicator assembly of FIG. 43, shown in the locked position and with the front panel removed.
Figure 46:
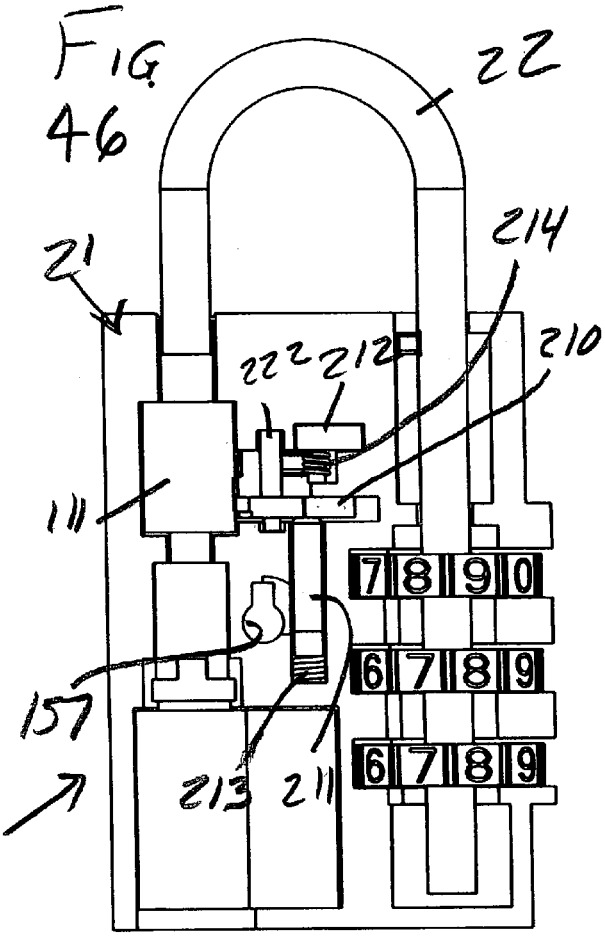
FIG. 46 is a front elevation view of the dual-mode locking padlock incorporating the signal/indicator assembly of FIG. 45.
Figure 47:
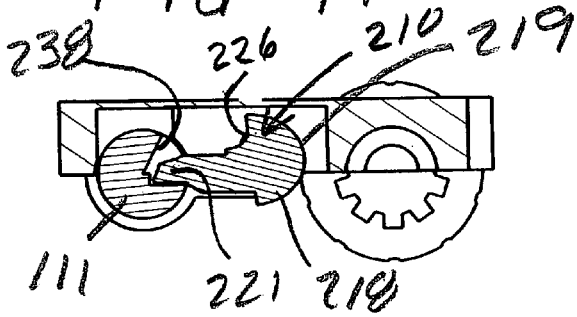
FIG. 47 is a cross-sectional top plan view of the dual-mode locking padlock incorporating the signal/indicator assembly of assembly taken along the line 47—47 of FIG. 46.
Figure 48:
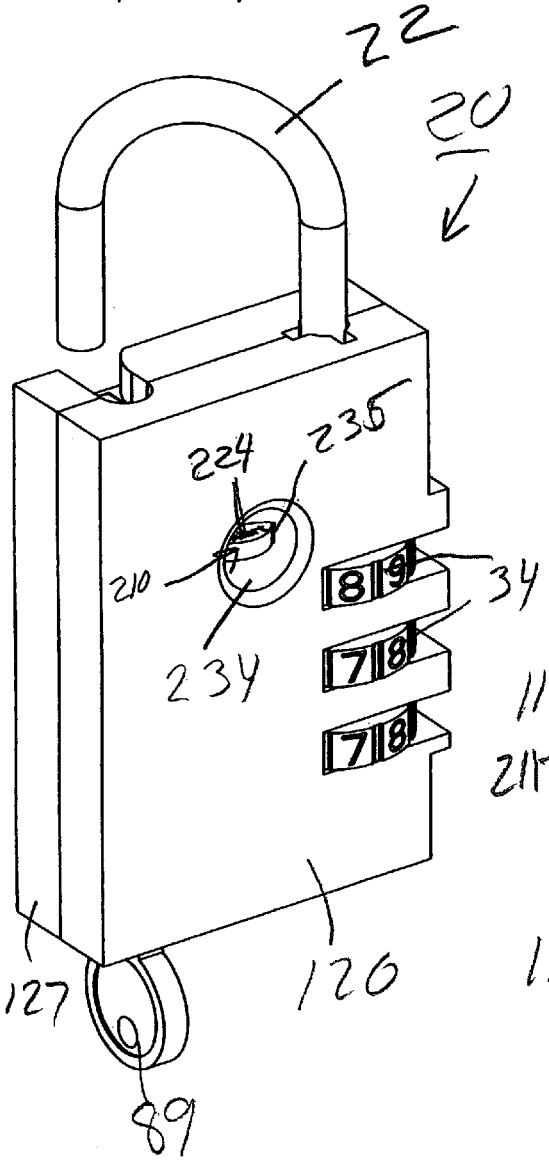
FIG. 48 is a front perspective view of the dual mode locking padlock incorporating the signal/indicator assembly of FIG. 43 shown fully assembled and after being opened by a key with the indicator assembly activated.
Figure 49:
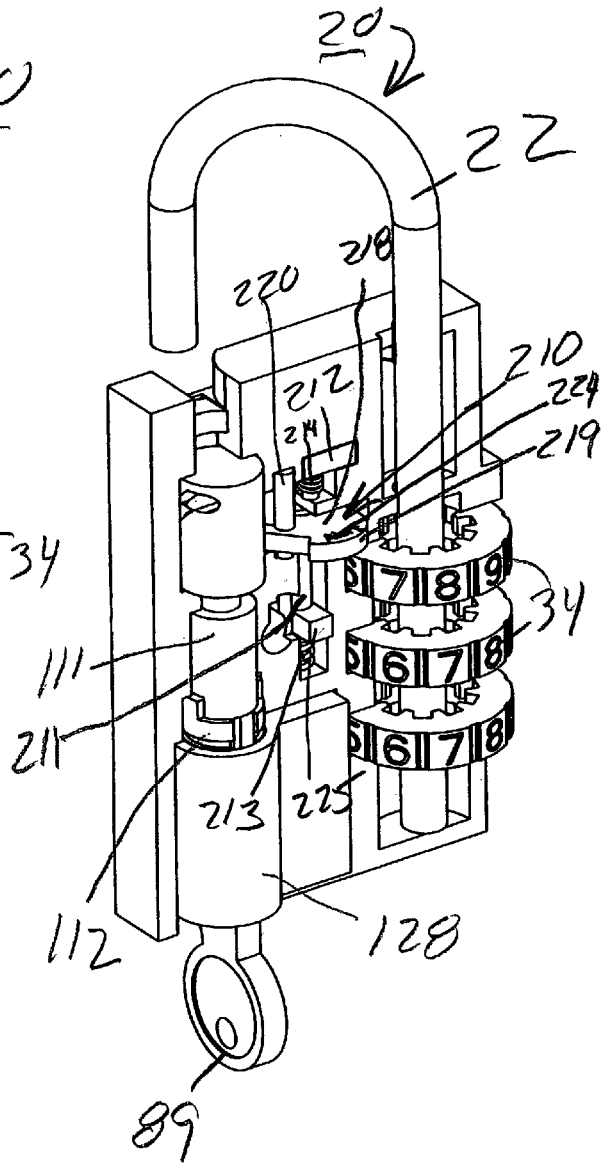
FIG. 49 is a front perspective view of the dual-mode locking padlock incorporating the signal/indicator assembly of FIG. 48, shown with the front panel removed.
Figure 50:
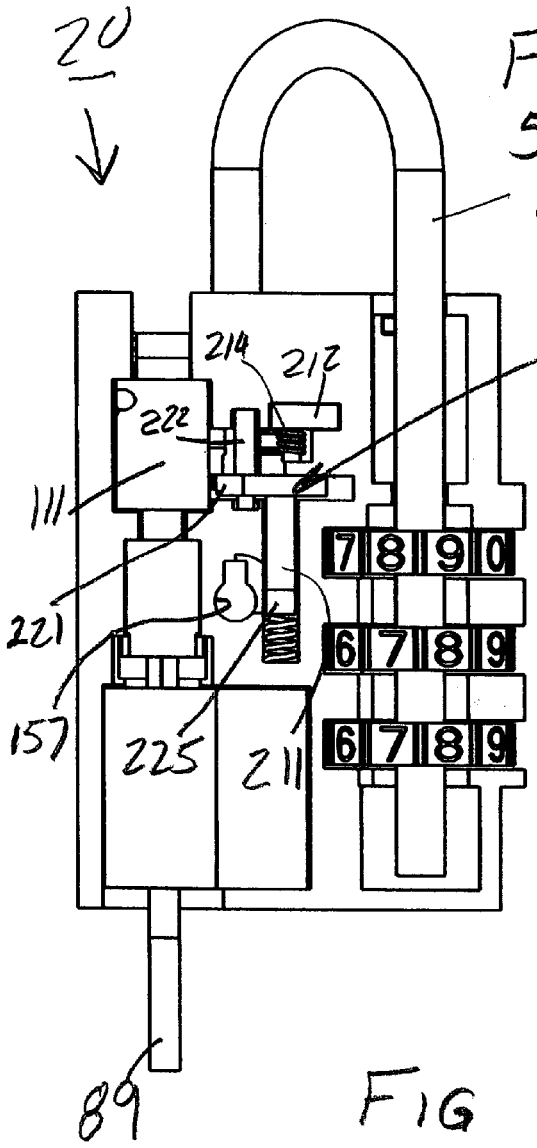
FIG. 50 is a front elevation view of the dual-mode locking padlock incorporating the signal/indicator assembly of FIG. 49.

In FIGS. 45–47, dual locking mode padlock 20 is depicted with this embodiment of automatically initiated signal/indicator of assembly 130 securely mounted therein, and locked in its non-alert state. When in this position, shackle 22 is in locked engagement with housing 21, retained in this locked position by both combination controlled section 23 and key controlled locking section 24. In addition, alert indicating indicia 224 of indicator member 210 is maintained in its non-alert position. In this position, arcuately curved edge 219 of plate portion 218 is fully retained within cavity 230 of housing 21, thereby preventing indicia 224 from being visible while also removing any portion of signal/indicator assembly 130 from being visible through slot 235 or opening 234.

In addition, locking spindle 211 is retained within cavity 231 with spring member 213 engaged with the lower end of spindle 211 and fully compressed, ready to move locking spindle 211 upwardly. However, as best seen in FIG. 46, the top edge of locking spindle 211 is engaged with the bottom surface of indicator member 210, thereby preventing any axial movement of locking spindle 211 in spite of the forces being exerted by spring member 213.

In this position, pivot inducing arm member 221 is mounted in arm receiving zone 238 which is formed in cylinder 111. By positioning arm member 221 in receiving zone 238 of cylinder 111, the arcuate pivoting movement of cylinder 111, which is produced whenever key controlled locking section 24 of padlock 20 is employed, forces arm member 221 to arcuately pivot indicator member 210 in its entirety about the axis defined by pivot post 220.

By referring to FIGS. 48–52, along with the following detailed discussion, the automatic activation of signal/indicator assembly 130 of this embodiment of the present invention can best be understood. As is evident from the foregoing detailed discussion, whenever a product, such as a suitcase, to which padlock 20 has been secured needs to be opened by a third party, such as security personnel, the security personnel is able to use key controlled locking section 24 of padlock 20 by employing key 89. In this regard, key 89 is inserted into cylinder 112 and rotated, thereby causing shackle 22 to be released from locked engagement with housing 21. In addition, however, the arcuate rotation of cylinder 112 also causes signal/indicator assembly 130 to be simultaneously activated, as detailed herein.

In this regard, as stated above, the arcuate movement of cylinder 112 causes cylinder 111 to simultaneously rotate therewith. This pivoting movement also causes arm member 221 to pivot therewith, forcing pivot indicator member 210 to arcuately pivot about the axis defined by pivot post 220. In addition, the arcuate pivoting movement of indicator member 210 causes plate portion 218 and arcuately curved edge 219 to pivot through slot 235 of opening 234, causing indicia 224 printed on plate portion 218 to become immediately visible.

Figure 52:
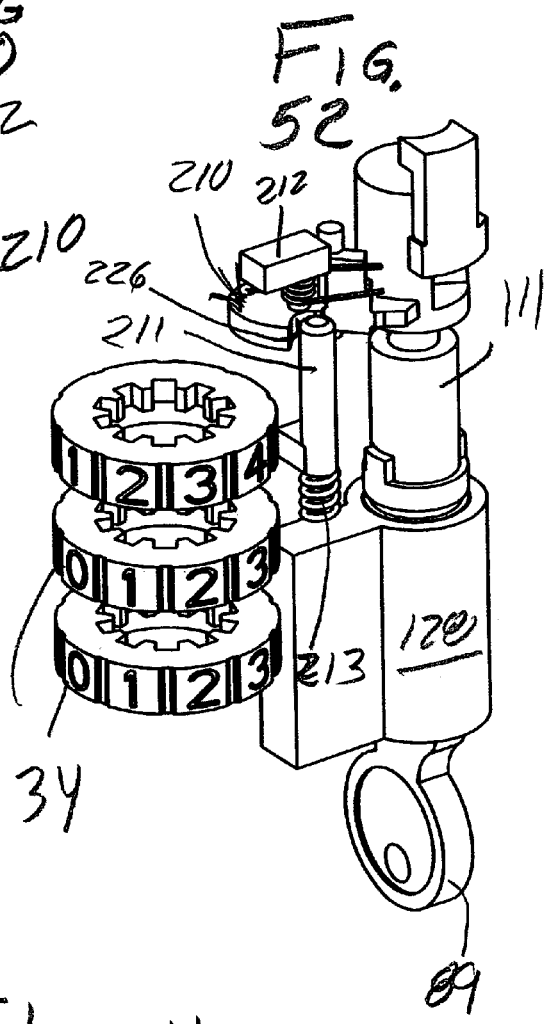
FIG. 52 is a rear perspective view of the dual mode locking padlock incorporating the signal/indicator assembly of FIG. 50 with the housing and shackle removed.
Figure 51:
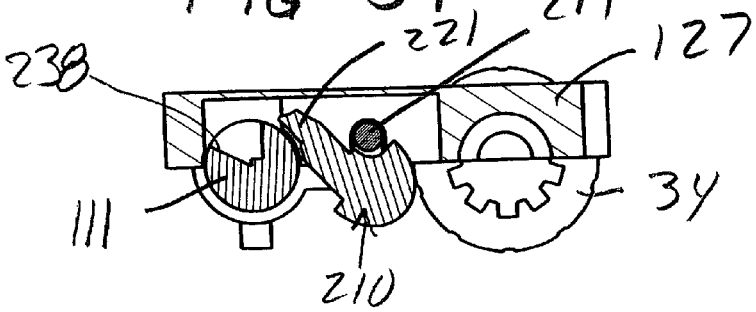
FIG. 51 is a cross-sectional top plan view of the dual-mode locking padlock incorporating the signal/indicator assembly and taken along the line 51—51 of FIG. 50.
Figure 53:
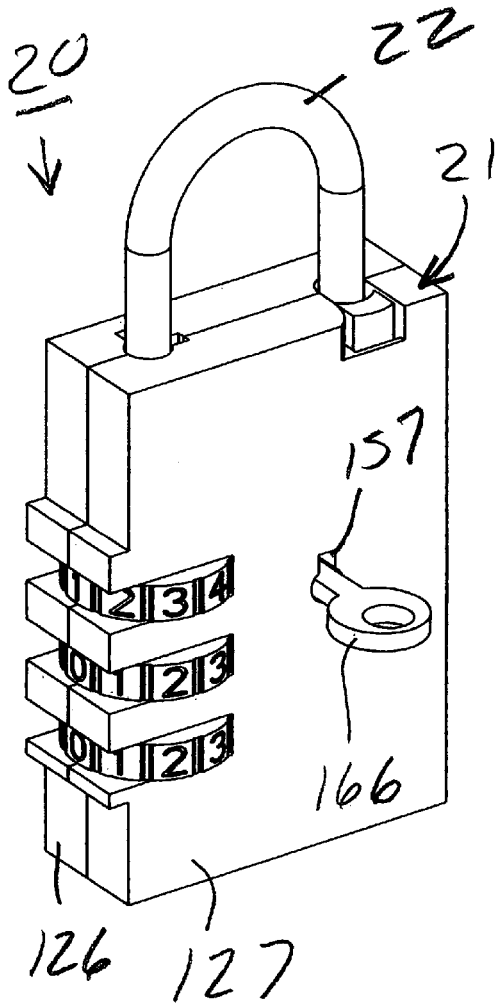
FIG. 53 is a rear perspective view of the dual-mode locking padlock incorporating the signal/indicator assembly of FIG. 55 shown in the process of being reset into its original position.

In addition, arcuately curved locking zone 226 of plate portion 218 also simultaneously pivots therewith, causing curved locking zone 226 to extend beyond the position of locking spindle 211. As a result, as soon as locking zone 226 extends beyond cavity 231, within which locking spindle 211 is retained, spring member 213 causes locking spindle 211 to immediately move upwardly, placing locking spindle 211 in secure engagement with arcuately curved locking zone 226 of plate portion 218. As best seen in FIG. 52, once locking spindle 211 is engaged with curved locking zone 226, indicator member 210 is locked in position, and incapable of being pivoted back to its original position, except by the user/owner.

Furthermore, the pivoting movement of indicator member 210 also causes abutment wall 222 to arcuately pivot which causes radially extending arm 228 of spring member 214 to be forced towards radially extending arm 229. This movement increases the force generated by spring member 214, which attempts to return indicator member 210 to its original position. However, due to the locked interengagement of spindle 211 with locking zone 226 of plate portion 218, indicator member 210 is incapable of being returned to its original position.

As a result, once indicator member 210 has been activated by the use of key controlled locking section 24, indicator member 210 cannot be returned to its original position, except by using a special reset key, which is in the possession of the user/owner. In this way, the user/owner is assured that the activation of indicator member 210 of signal/indicator assembly 130 will be known to the user/owner, and not reset by any third party.

As is evident from the foregoing detailed discussion, although the third party returns shackle 22 into locked engagement with housing 21, after inspection of the product/suitcase is completed, this action merely causes cylinders 111 and 112 to rotate back to their original positions, with shackle 22 returned to locked engagement with housing 21. However, although cylinders 111 and 112 are returned to their original positions, and key 89 is removed from cylinder 112, the arcuate rotation of the cylinders has no affect on signal/indicator assembly 130, which remains locked in the activated position, as detailed above.

In order to return signal/indicator assembly 130 to its original position, special reset key 166 must be employed. Since reset key 166 is in the possession of the user/owner, only the user/owner is able to return signal/indicator assembly 130 to its original position. As a result, the user/owner is assured that activation of signal/indicator assembly 130 will be evident to the user/owner, and not reset by any third party. By referring to FIGS. 53 and 54, along with the following detailed discussion, the reset operation can best be understood.

In order to return indicator member 210 to its original position, the user/owner must insert reset key 166 into keyhole 157 which is formed in rear panel 127 of housing 21. Once fully inserted into housing 21, reset key 166 is arcuately pivoted, in order to bring radially extending finger 167 of reset key 166 into contact with ledge 225 of locking spindle 211. Once finger 167 contacts ledge 225, key 166 is arcuately pivoted further, causing finger 167 to force ledge 225 downwardly along with locking spindle 211. This arcuate pivoting movement overrides the biasing force of spring member 213, enabling spindle 211 to move downwardly in cavity 231.

As locking spindle 211 is moved downwardly, the upper end of spindle 211 is removed from holding engagement with arcuately curved locking zone 226 of indicator member 210. Once locking spindle 211 is completely clear of locking zone 226 of indicator member 210, the biasing forces generated by spring member 214 on abutment wall 222 of indicator member 210 forces indicator member 210 to automatically arcuately rotate back to its original position.

Once in its original position, indicator member 210 overlies locking spindle 211, causing locking spindle 211 to be secured in its original position below indicator member 210. When this position has been attained, reset key 166 can be removed from keyhole 157, with complete assurance that indicator member 210 and the entire signal/indicator assembly 130 is secured in its original position, ready for being activated at the appropriate time.

As is evident from the foregoing detailed discussion, the embodiment of the present invention depicted in FIGS. 43–54 provides an effective and reliable signal/indicator system which is automatically activated whenever the key controlled locking section padlocked Is employed. Furthermore, once the signal/indicator assembly has been activated, the signal/indicator can only be returned to its original position by the user/owner. In addition, in each of these embodiments, the user/owner is able to reset the signal/indicator assembly without any regard to the locked or unlocked condition of padlock 20. As a result, all of the embodiments of this invention enable the user/owner to reset the signal/indicator assembly while padlock 20 is in a fully locked and secured configuration.

In addition to the three preferred embodiments of the present invention shown in FIGS. 27–54, and fully detailed above, the present invention also comprises a fourth preferred embodiment for providing a signal/indicator to the user/owner whenever key controlled locking 24 portion of padlock 20 of the present invention is employed. In addition, as with the embodiments detailed above, this fourth embodiment also requires the user/owner to employ a special reset key in order to reposition the signal/indicator into its original location. By referring to FIGS. 55–63, along with the following detailed disclosure, the construction and operation of this fourth preferred embodiment can best be understood.

In the preferred construction of this embodiment of the present invention, padlock 20 comprises a construction substantially equivalent to the padlock construction depicted in FIGS. 1–19 and detailed above. In this regard, dual locking mode padlock 20 comprises housing 21, shackle 22, combination controlled locking section 23 formed on one side of housing 21, and key controlled locking section 24 formed on the opposite side thereof. By employing either combination controlled locking section 23 or key controlled locking section 24, shackle 22 is able to be released from locked engagement in housing 21 in order to open padlock 20. Furthermore, in the preferred construction of this embodiment, housing 21 of padlock 20 comprises a substantially unitary, one-piece construction incorporating cover panels 90 and 91, which peripherally surround central housing 21 and form an integral part thereof.

Figure 54:
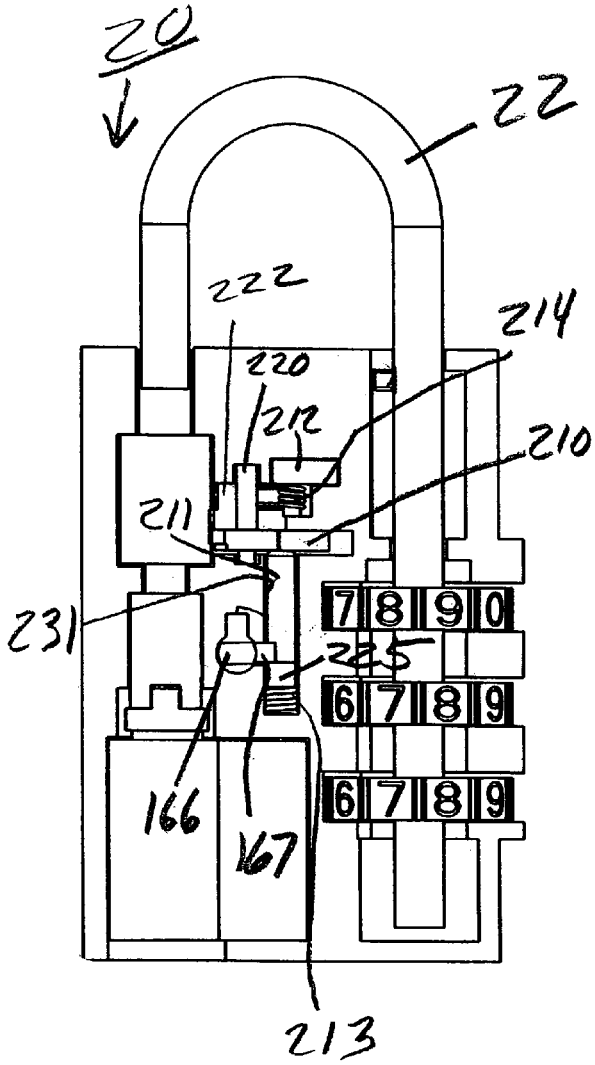
FIG. 54 is a rear elevation view of the dual-mode locking padlock incorporating the signal/indicator assembly of FIG. 53.

For purposes of convenience, the components forming padlock 20 which are substantially identical to the components detailed above in reference to FIGS. 1–54 are shown in FIGS. 55–63 using the identical reference numerals. In addition, in order to avoid repetition, a detailed disclosure of these components is not provided and, instead, the disclosure provided above is incorporated herein by reference. Consequently, any questions which may exist regarding particular reference numerals, and the components designated nearby, should become immediately apparent by referring to the foregoing detailed discussion.

In this embodiment of the present invention, automatically initiated signal/indicator assembly 130 principally comprises uniquely constructed indicator member 250, biasing spring 251 and locking spring 252. By employing these components, which are constructed and mounted to housing 21 in the manner detailed below, a highly effective, reliable, easily constructed, relatively low-cost, automatically initiated signal/indicator assembly 130 is attained.

In the preferred construction of this embodiment of signal/indicator assembly 130, indicator member 250 comprises a substantially flat plate member which is pivotally mounted directly to top surface 50 of housing 21. In the preferred construction, pivot pin 255 is employed which extends through indicator member 250, establishing a pivot axis therefor while also securely affixing indicator member 250 directly to top surface 50 of housing 21. In addition, indicator member 250 comprises an arm portion 256 extending from one side of pivot pin 255, which is constructed for causing indicator member 250 to arcuately pivot about the axis defined by pivot pin 255.

Indicator member 250 also incorporates an enlarged, display panel 257 which extends from the opposed side of pivot pin 255 and forms a major portion of indicator member 250. Furthermore, display panel 257 is constructed with an arcuately curved terminating edge 258 and incorporates indicia 260 printed on the top surface of display panel 257. Finally, the construction of indicator member 250 is completed by forming notch 261 in display panel 257, directly adjacent the terminating end of display panel 257 and arcuately curved edge 258.

As depicted, the overall construction of this embodiment of signal/indicator assembly 130 is completed by securely mounting spring members 251 and 252 to top surface 50 of central housing 21. In this regard, biasing spring 251 is securely affixed to holding pin 262 which is positioned for an enabling one radially extending arm of biasing spring 251 to be in contact with arm member 256 of indicator member 250. The second arm member of biasing spring 251 is maintained in contact with the inside wall of rear panel 91, thereby maintaining a continuous biasing force on arm member 256.

In addition, locking spring member 252, which is preferably in the form of an elongated leaf spring, is affixed to holding pin 263 which is mounted to top surface 50 of housing 21. In addition, locking spring member 252 is constructed with arms 264 and 265 extending from the central body portion thereof, with arm 265 in biasing contacting engagement with arcuately curved edge 258 of indicator member 250, while arm 264 is biasingly engaged with an upstanding portion of housing 21 which comprises an integral part of combination controlled section 23.

In the preferred construction of this embodiment of the present invention, front panel 90 incorporates an enlarged cavity or open zone 270 integrally formed therein. In addition, cavity/open zone 270 incorporates slot 271 which is formed in the inside terminating wall of cavity 270. By employing this construction, which is best seen in FIG. 55, it is evident that this embodiment of padlock 20 incorporates a highly visible, readily seen viewing area for enabling the presence of indicator/signal assembly 130 to be immediately apparent, whenever indicator/signal assembly 130 is activated.

As detailed above in reference to FIGS. 1–19, in this embodiment of the present invention, short leg 25 of shackle 22 is engaged with housing 21 of padlock 20 by locking collar 29. This locked position for this embodiment of the present invention is clearly depicted in FIG. 55, with FIGS. 56 and 57 also showing the locked configuration, with front panel 90, rear panel 91, and shackle 22 removed from central housing 21.

Figure 58:
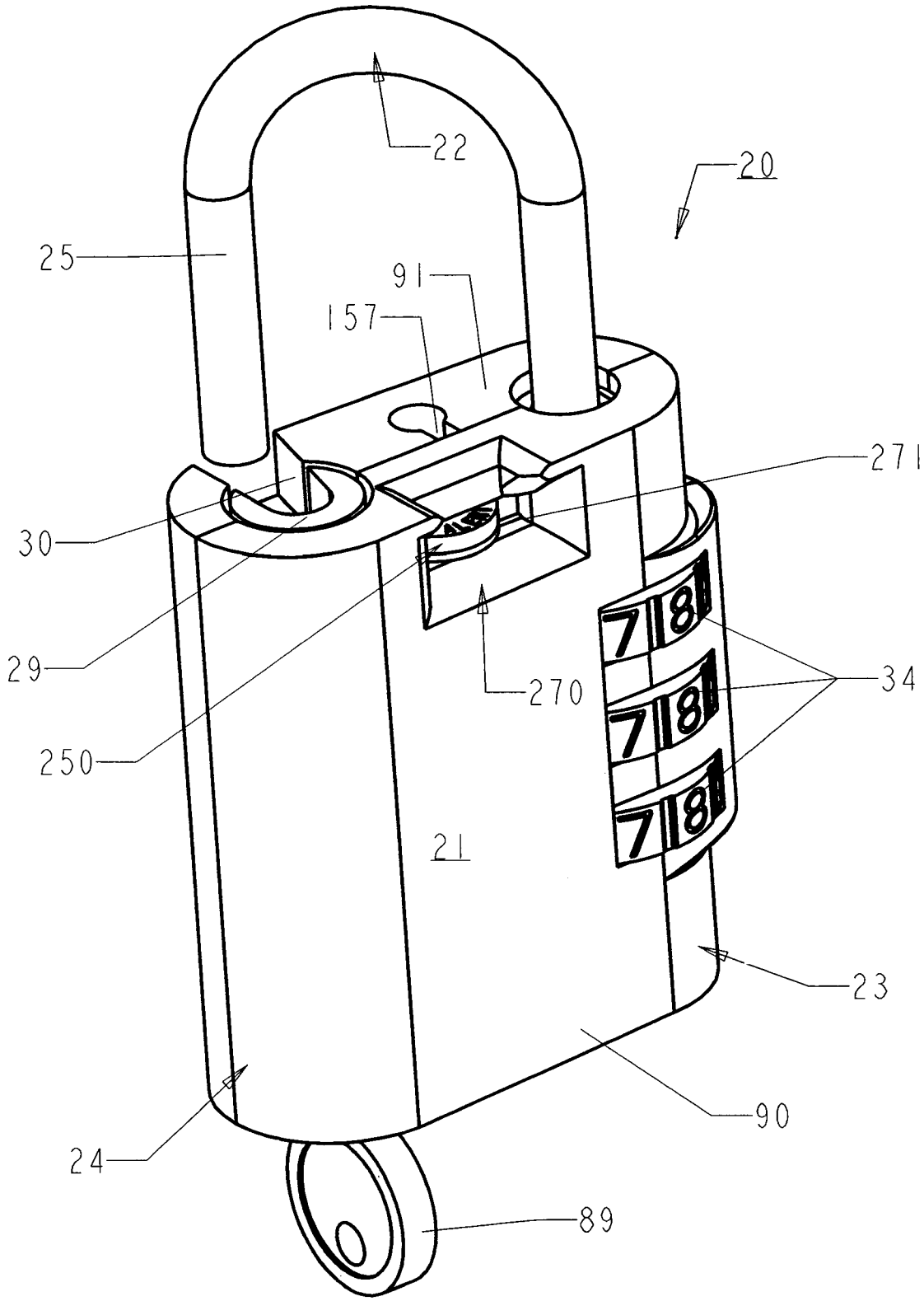
FIG. 58 is a perspective view of the dual-mode locking padlock incorporating the signal indicator assembly of FIG. 55 shown after being opened by a key with the indicator assembly activated.
Figure 59:
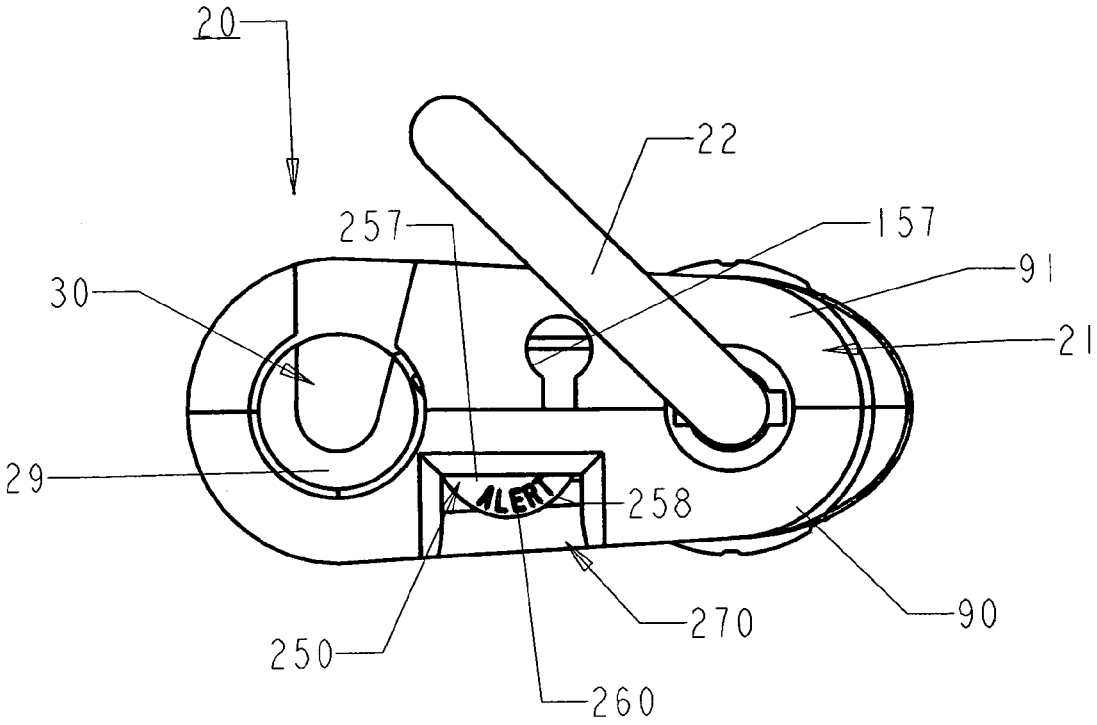
FIG. 59 is a top plan view of the dual-mode locking padlock incorporating the signal indicator assembly of FIG. 58.
Figure 60:
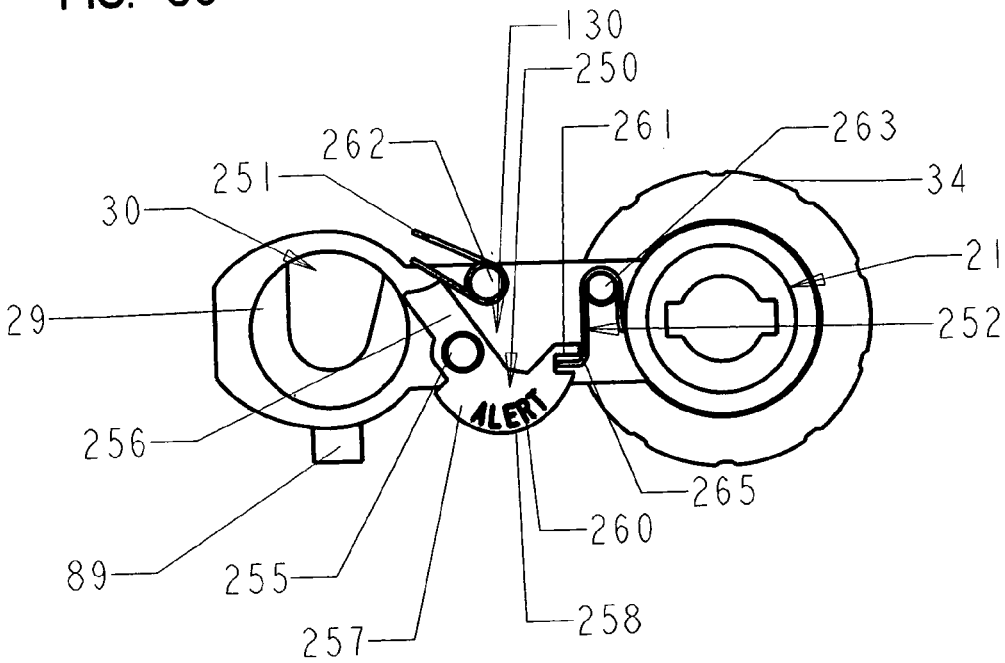
FIG. 60 is a top plan view of the housing of the dual-mode locking padlock incorporating the signal indicator assembly of FIG. 59.
Figure 61:
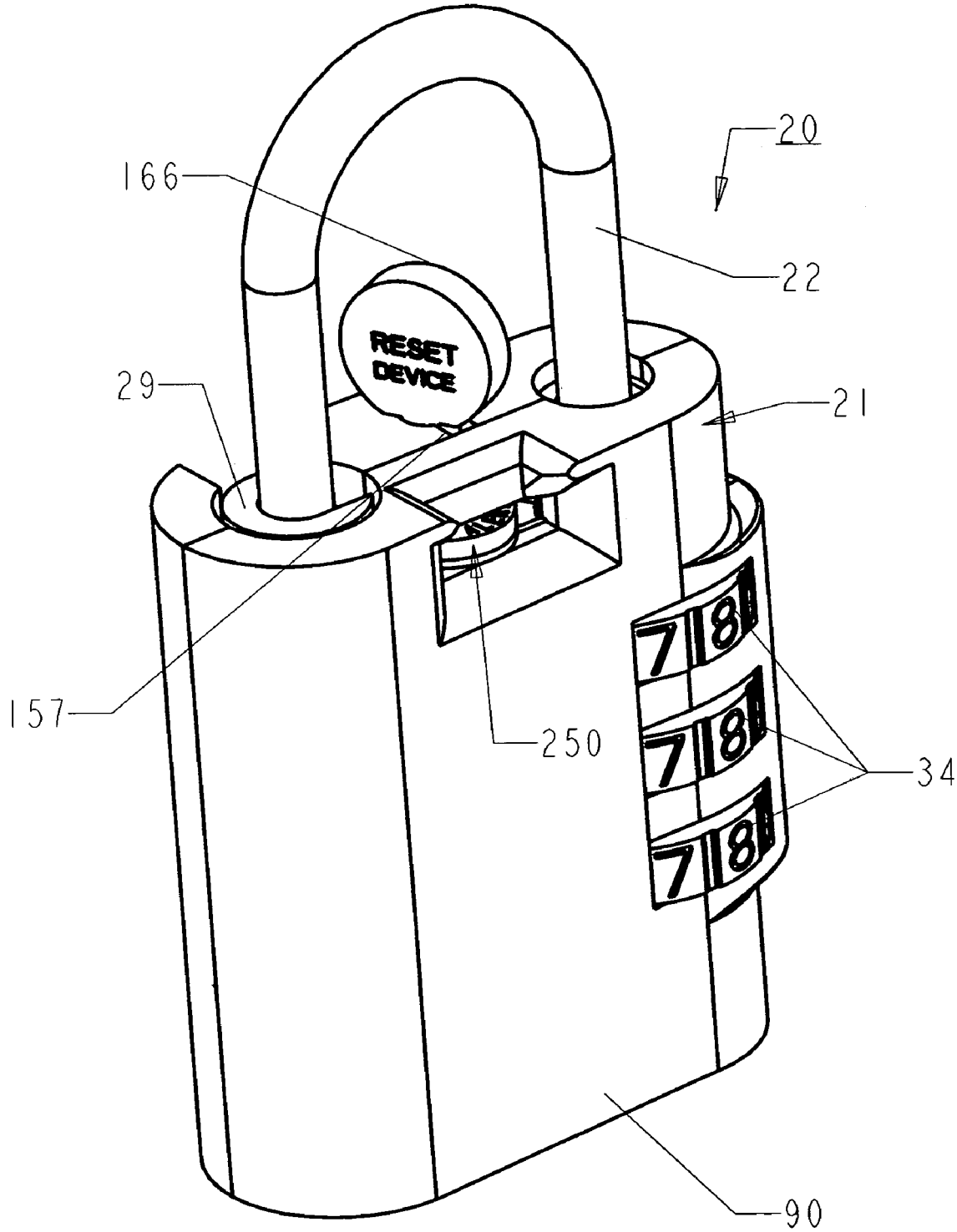
FIG. 61 is a perspective view of the dual-mode locking padlock incorporating signal indicator assembly of FIG. 55 shown in the locked position after the indicator assembly had been activated and in the process of being reset.
Figure 62:
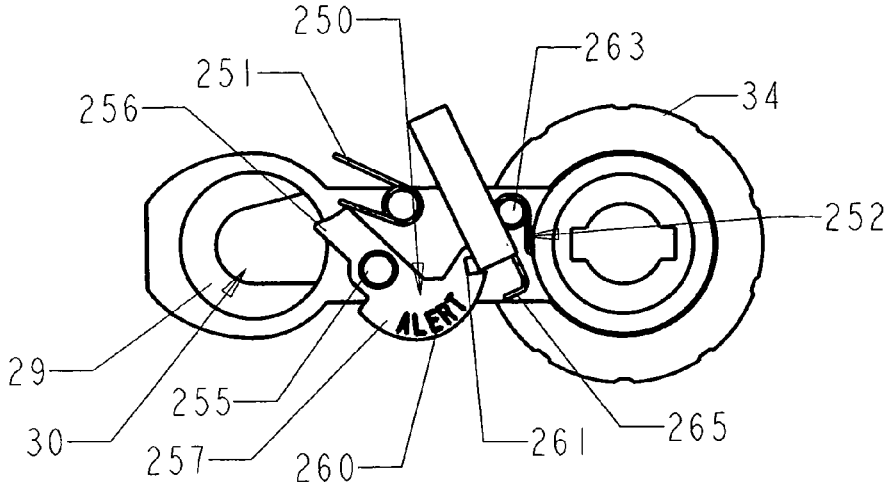
FIG. 62 is a top plan view of the housing of the dual-mode locking padlock incorporating the signal indicator assembly of FIG. 61.
Figure 63:
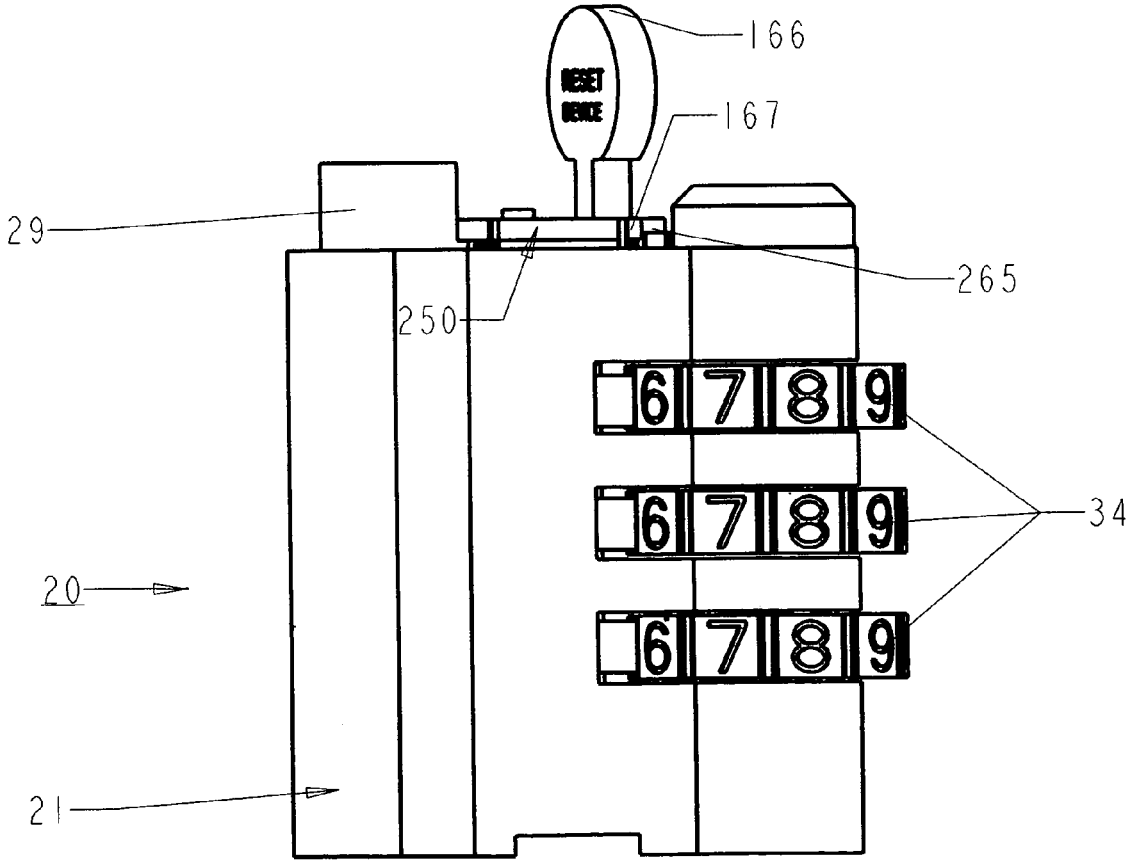
FIG. 63 is a front elevation view of the housing of the dual-mode locking padlock incorporating the signal indicator assembly of FIG. 62.

In order to release short leg 25 of shackle 22 from locked engagement with collar 29 of padlock 20, key controlled locking section 24 of housing 21 is employed. In this regard, as shown in FIGS. 58–60, a suitable key 89 is inserted into the cylinders mounted in key controlled locking section 24 with the cylinders being arcuately pivoted relative to housing 21. This arcuate rotational movement causes collar 29 to arcuately pivot through an angular distance of about 90°, positioning slot 30 of locking collar 29 in a location which enables short leg 25 to be moved out of engagement within locking collar 29. As fully detailed below, the arcuate pivoting movement of locking collar 29 causes indicator member 250 to arcuately pivot simultaneously therewith, providing the alert indication to the user/owner.

Figure 55:
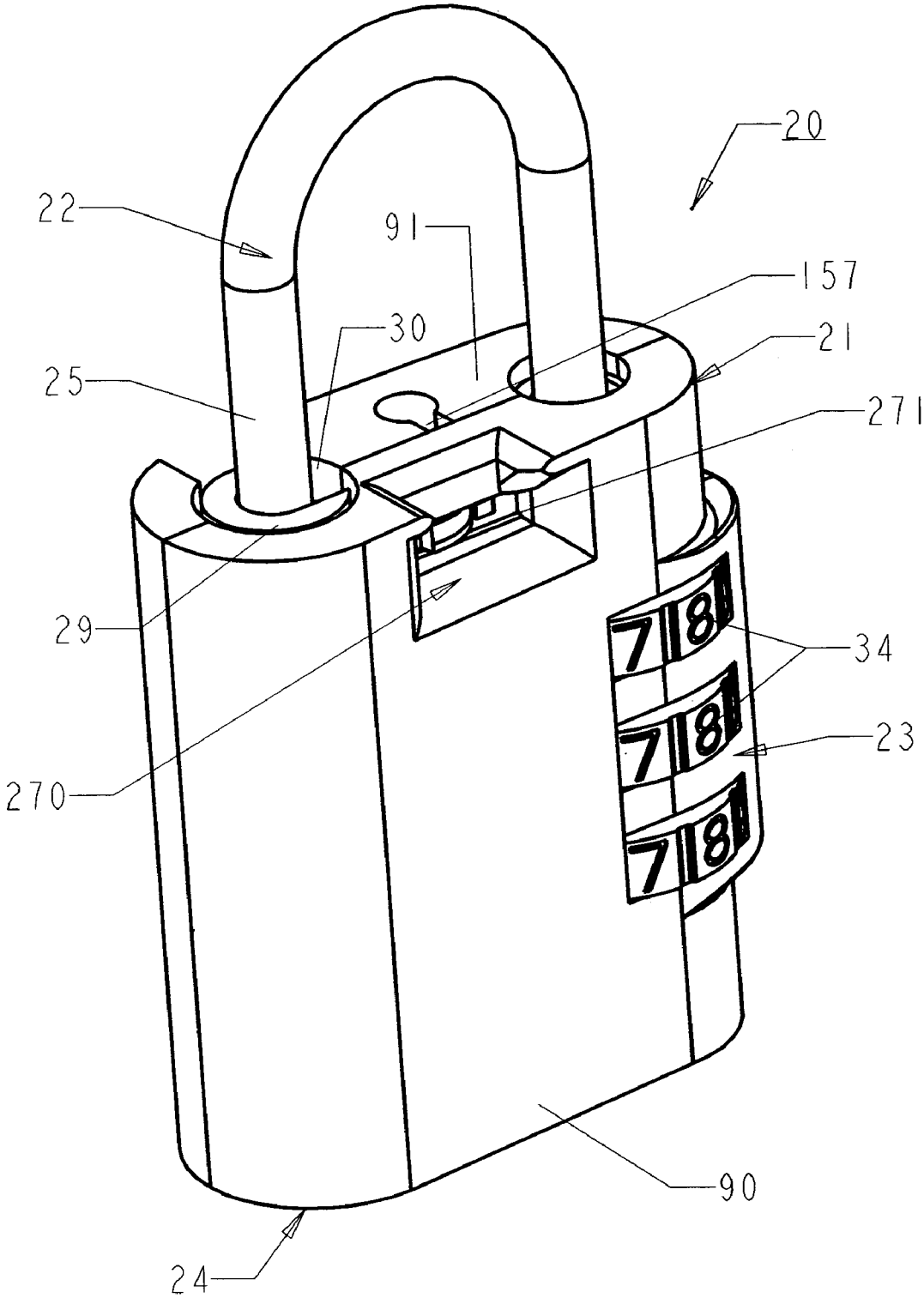
FIG. 55 is a perspective view of another further additional alternate embodiment of the dual-mode locking padlock incorporating a signal/indicator assembly made in accordance with the present invention and shown in the locked position.
Figure 56:
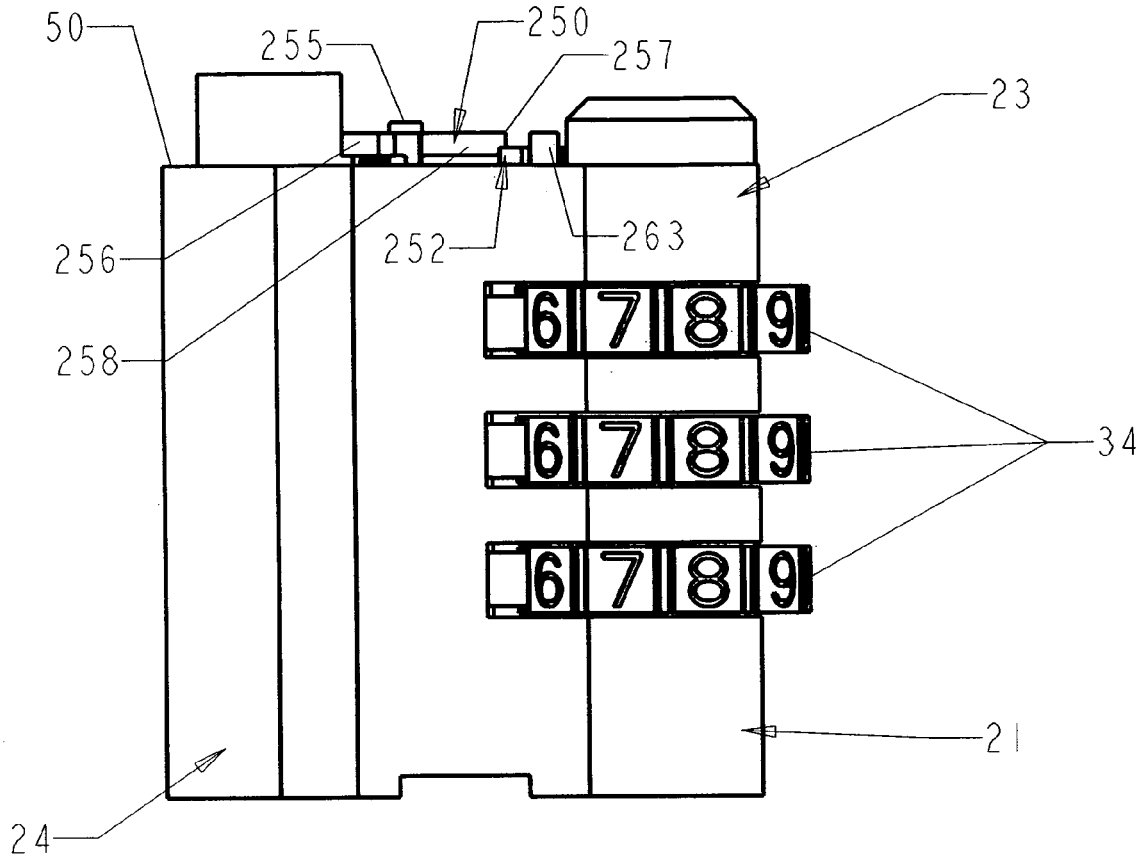
FIG. 56 is a front elevation view of the housing of the dual-mode locking padlock incorporating the signal indicator assembly of FIG. 55.
Figure 57:
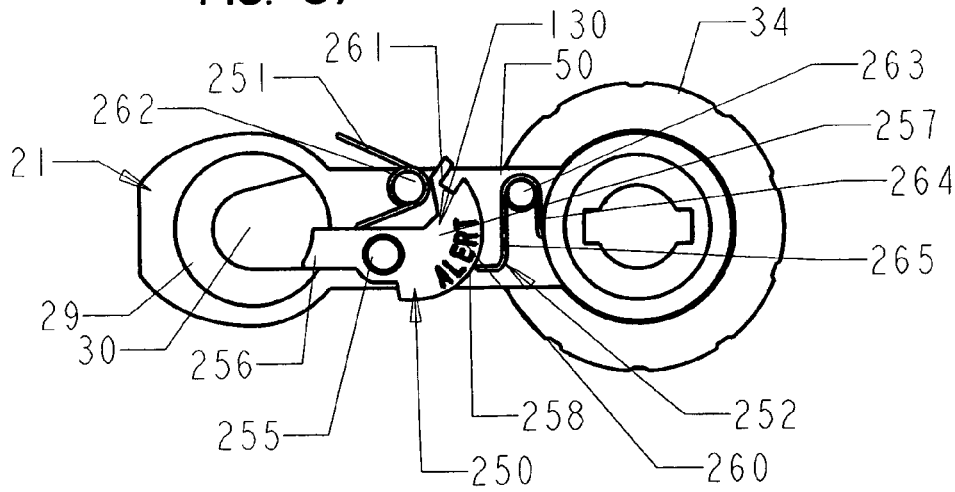
FIG. 57 is a top plan view of the housing of the dual-mode locking padlock incorporating the signal indicator assembly of FIG. 56.

By comparing FIGS. 55–57, wherein shackle 22 is shown in locked engagement with housing 21, with FIGS. 58–60, wherein shackle 22 is depicted released and disengaged from housing 21, the automatic activation of this embodiment of signal/indicator assembly 130 can be fully understood. In this regard, the arcuate pivoting movement of locking collar 29, due to the insertion and use of key 89, forces arm member 256 of indicator member 250 to arcuately pivot indicator member 250 about the axis defined by pivot pin 255.

As a result of this arcuate movement, enlarged display panel 257 with indicia 260 printed thereon is moved from a first position fully retained inside panels 90 and 91 of housing 21 to a second position wherein panel 257 and indicia 260 are outside of front panel 90 in a readily visible, external position. As shown, this pivoting movement causes enlarged display panel 257 with indicia 260 of indicator member 250 to move through slot 271 of front panel 90, causing indicia 260 and panel 257 to be readily visible in enlarged cavity/open zone 270.

Once in this position, signal providing indicia 260 is readily visible and is immediately apparent to the user/owner. Furthermore, as shown in FIGS. 58 and 59, indicia 260 is immediately visible from both the front of housing 21, as well as from the top of housing 21, due to the construction of enlarged cavity/open zone 270.

As shown in FIG. 60, as enlarged display panel 257 of indicator member 250 moves into its display position, arm member 256 contacts one of the radial arms of biasing spring 251, moving the first arm closer to the second arm. This movement causes biasing spring 251 to exert a greater force upon indicator member 250, attempting to move indicator member 250 back to its original position.

In spite of this increased force on indicator member 250, slot 261 of indicator member 250 simultaneously becomes aligned with arm 265 of locking spring 252. Once the leading edge of arm 265 becomes engaged within slot 261, indicator member 250 is locked in the display position, incapable of being moved into its original position, until released by the user/owner, regardless of the additional forces being exerted thereon by spring 251.

As is evident from the foregoing detailed discussion, the arcuate pivoting movement of indicator member 250 causes enlarged display panel 257 and indicia 260 to be moved into a position wherein panel 257 and indicia 260 extend outwardly from front panel 90 of housing 21, positioned in enlarged cavity/open zone 270, in an easily seen, highly visible, readily identifiable location. In this way, upon seeing padlock 20, the user/owner is immediately notified that padlock 20 had been opened by employing key controlled locking portion 24, thereby providing the user/owner with the notice desired in an efficient and cost-effective manner.

Once this position has been attained, indicator member 250 is locked in the displayed position, and is incapable of being arcuately pivoted back to its original position, unless a specially constructed reset key is employed. As a result, the individual using key 89 to open padlock 20, typically a security or inspection agent who needs to gain access to the locked product, such as a suitcase, is unable to return indicator member 250 to its original position. As a result, the user/owner of padlock 20 is assured that indicia 260 will be visible, informing the user/owner that key controlled locking section 24 of padlock 20 had been employed.

Furthermore, as is evident from the foregoing detailed discussion, indicator member 250 is incapable of being returned to its original position by the third party who opened padlock 20, even though shackle 22 is returned into locked engagement with housing 21 using key controlled locking section 24. Instead, a special key which is in the personal possession of the user/owner must be employed in order to return indicator member 250 into its original position. By referring to FIGS. 61–63, along with the following detailed discussion, this reset operation can best be understood.

In this embodiment, indicator member 250 is automatically returned to its original position by merely inserting reset key 166 into key hole or receiving slot 157 formed on the top surface of rear panel 91. Once inserted into the proper position, reset key 166 is rotated, causing finger member 167 of reset key 166 to contact arm 265 of locking spring 252.

Once finger member 167 of reset key 166 contacts arm 265, the continued arcuate movement of reset key 166 causes finger member 167 to engage and force arm 265 to be withdrawn from slot 261 of indicator member 250. As soon as arm 265 is completely withdrawn from slot 261 of indicator member 250, the biasing forces produced by spring 251 act directly upon arm member 256 of indicator member 250, causing indicator member 250 to automatically arcuately pivot about the axis defined by pivot pin 255, returning indicator member 250 to its original position, as depicted in FIGS. 55–57.

Once in this position, enlarged display panel 257 and indicia 260 are returned into the interior of housing 21, completely removed from view and ready to be reactivated at an appropriate time. In addition, arm member 256 is returned into engagement in slot 30 of collar 29, ready for being reactivated whenever key controlled locking section 24 of padlock 20 is employed again.

In addition to the four preferred embodiments of the present invention shown in FIGS. 27–63, and fully detailed above, the present invention also comprises a fifth preferred embodiment for providing a signal/indicator to the user/owner whenever key controlled locking 24 portion of padlock 20 of the present invention is employed. In addition, as with the embodiments detailed above, this fifth embodiment also requires the user/owner to employ a special reset key in order to reposition the signal/indicator into its original location. By referring to FIGS. 64–75, along with the following detailed disclosure, the construction and operation of this fifth preferred embodiment can best be understood.

In the preferred construction of this embodiment of the present invention, padlock 20 comprises a construction substantially equivalent to the padlock construction depicted in FIGS. 43–54 and detailed above. In this regard, dual locking mode padlock 20 comprises housing 21, shackle 22, combination controlled locking section 23 formed on one side of housing 21, and key controlled locking section 24 formed on the opposite side thereof. In addition, housing 21 preferably comprises two mating sections, front panel section 126 and rear panel section 127. By employing either combination controlled locking section 23 or key controlled locking section 24, shackle 22 is able to be released from locked engagement in housing 21 in order to open padlock 20.

For purposes of convenience, the components forming padlock 20 which are substantially identical to the components detailed above in reference to FIGS. 43–54 are shown in FIGS. 64–75 using the identical reference numerals. In addition, in order to avoid repetition, a detailed disclosure of these components is not provided and, instead, the disclosure provided above is incorporated herein by reference. Consequently, any questions which may exist regarding particular reference numerals, and the components designated nearby, should become immediately apparent by referring to the foregoing detailed discussion.

As with the previous embodiments detailed above, key receiving cylinder 112 is preferably rotationally mounted in sleeve member 128 which is secured in housing 21. Sleeve member 128 securely retains cylinder 112 and enables cylinder 112 to rotationally move in response to the receipt of an appropriate key, for releasing shackle 22 from the locked position.

As shown in FIGS. 64–75, automatically initiated signal/indicator assembly 130 principally comprises indicator member 210, locking spindle 211, holding block 212 and spring members 213 and 214. By employing these components, which are constructed and mounted in housing 21 in the manner detailed below, a highly effective, reliable, easily constructed, automatically initiated signal/indicator assembly 130 is attained.

In the preferred construction of this embodiment of signal/indicator assembly 130, indicator member 210 comprises elongated pivot post or shaft 300 mounted to support plate 301 and extending substantially perpendicularly therefrom in an upward direction towards the top surface 51 of housing 21. In addition, lower post 302 extends downwardly from plate 301 and is coaxially aligned with post/shaft 300.

In addition, in the preferred construction of this embodiment of the present invention, elongated post/shaft 300 incorporates indicator providing end portion 305 formed at the terminating end of shaft 300. In the preferred construction, indicator providing terminating end portion 305 is mounted on the outside of top surface 51 of housing 21 in cooperating relationship with alert providing display zone 306 formed thereon. Furthermore, post/shaft 300 is retained in elongated channel 303 formed in housing 21 for assuring the desired, controlled, arcuate pivoting movement of post/shaft 300 and indicator portion 305.

Furthermore, as depicted, terminating end portion 305 is preferably integrally mounted to circular shaped support disc 307 which is affixed directly to post/shaft 300. In addition, support disc 307 is mounted within retaining cavity 308 formed in housing 21, which is constructed for securely retaining disc 307 and assuring that disc 307 and terminating end portion 305 are able to arcuately pivot in response to the movement of post/shaft 300.

In this embodiment of the present invention, terminating end portion 305 is preferably constructed in the form of a pointing element, such as an arrow head as depicted. Of course, any other desired pointing element configuration or structure can be employed with equal efficacy. Regardless of the specific configuration employed for the pointing element forming terminating end portion 305, terminating end portion 305 cooperates with display zone 306 which incorporates at least two separate and distinct indicia, non-alert condition indicia 309 and alert condition indicia 310. In this way, by merely observing the position of terminating end portion 305 relative to non-alert condition indicia 309 and/or alert condition indicia 310, the user/owner of padlock 20 is quickly and easily able to immediately know when padlock 20 has been opened by key controlled locking section 24.

Figure 64:
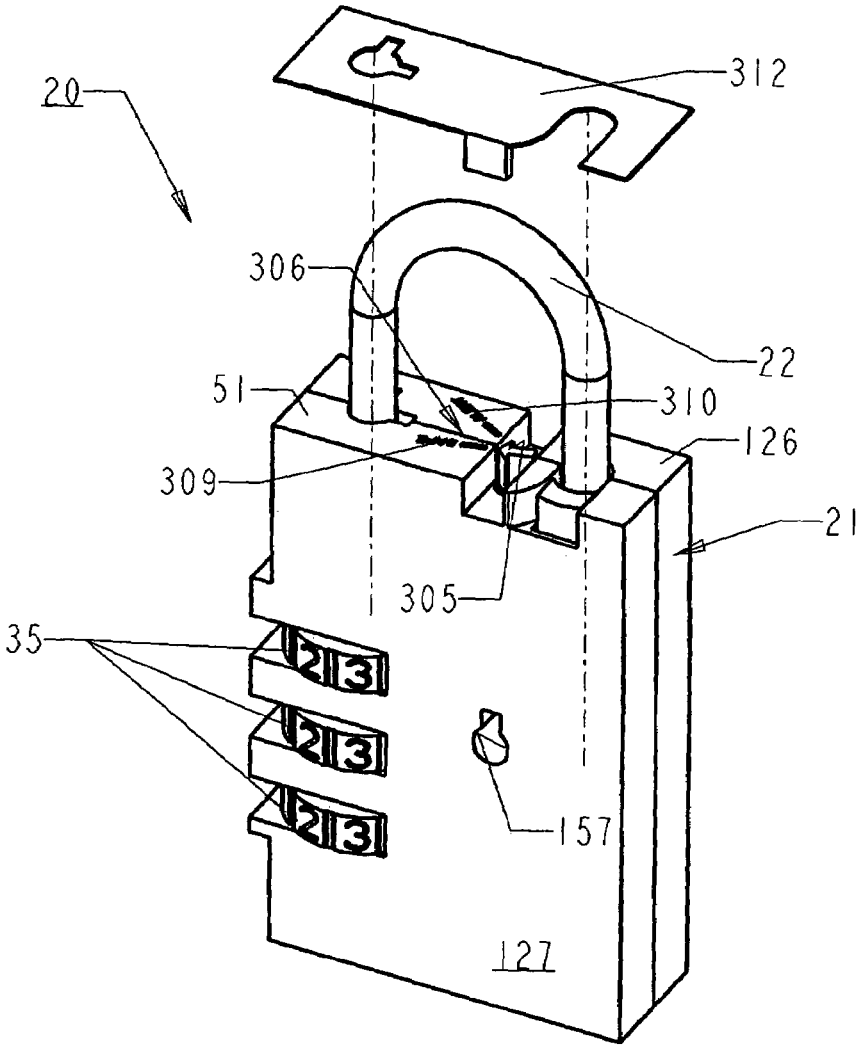
FIG. 64 is a partially exploded, rear perspective view of a still further, additional, alternate preferred embodiment of a dual-mode locking padlock incorporating a signal/indicator assembly of the present invention.
Figure 65:
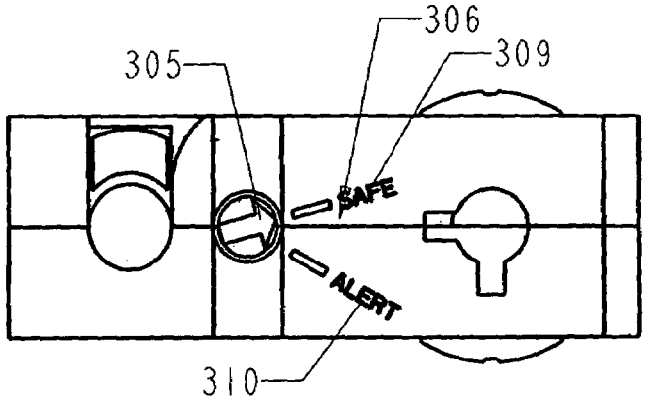
FIG. 65 is a top plan view of the dual-mode locking padlock incorporating the signal/indicator assembly of FIG. 64, with the shackle removed.
Figure 66:
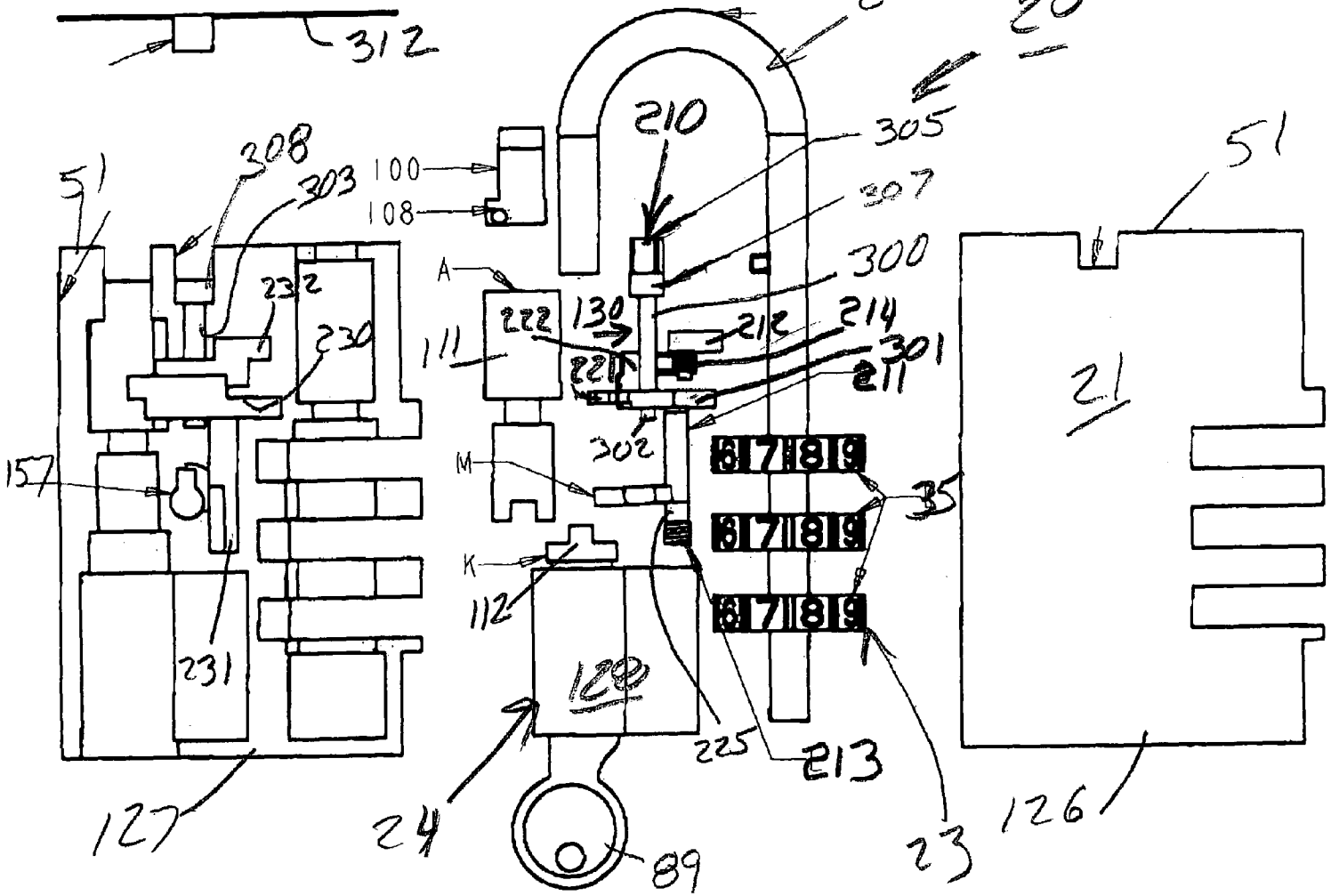
FIG. 66 is an exploded, front elevation view of the dual-mode locking padlock incorporation the signal/indicator assembly of FIG. 64.

In implementing this embodiment of the present invention, non-alert condition indicia 309 and alert condition indicia 310 may comprise any desired designation selected from the group consisting of alphanumeric designations, colors, symbols, pictures, and the like, as well as combinations thereof. As shown in FIGS. 64 and 65, the preferred embodiment of the present invention employs the word "SAFE" for the non-alert condition indicia 309 and the word "ALERT" for the alert condition indicia 310. In addition, if desired, colors can also be employed to further emphasize these designations. Furthermore, as is evident from the foregoing discussion, these designations are merely shown for exemplary purposes only and any other desired designations can be employed with equal efficacy.

When in its first, non-alert position, terminating end portion 305 of indicator member 210 is positioned in designating association with non-alert condition indicia 309. As a result, when this position is displayed, the user/owner recognizes and understands that padlock 20, when securely mounted to a particular product, such as a suitcase, had not been opened by any third party using the key operated portion 24 of padlock 20.

In addition, in the preferred construction of this embodiment of the present invention, transparent cover plate 312 is mounted to top surface 51 of housing 31 of padlock 20. By employing cover plate 312, added protection is provided to terminating end portion 305 and display zone 306 of signal indicating assembly 130, without obstructing or interfering with the visibility and immediate identification of the information provided by signal/indicator assembly 130.

Alternatively, as is fully detailed below, indicator member 210 is constructed for automatically arcuately pivoting, in response to the use of key operated portion 24 of padlock 20 to release shackle 22 from locked engagement with housing 21. Consequently, whenever key operated portion 24 of padlock 20 is employed, terminating end portion 305 of indicator member 210 arcuately pivots into designating association with alert condition indicia 310, providing the user/owner with immediate notification that a third party has employed key operated portion 24 of padlock 20.

In order to provide the desired arcuate pivoting movement of terminating end portion 305 of indicator member 210, pivot controlling arm member 221 is formed with support plate 301, extending therefrom and being positioned in cooperating engagement with cylinder 111. As further discussed below, as cylinder 111 arcuately pivots in response to the use of key 89 in cylinder 112, arm member 221 is forced to simultaneously move therewith, causing support plate 301, elongated post/shaft 300 and terminating end portion 305 to simultaneously arcuately pivot therewith.

In completing the construction of this embodiment of signal/indicator assembly 130, indicator member 210 also incorporates abutment wall 222 mounted to the top surface of support plate 301 and extending substantially perpendicularly therefrom, positioned for cooperating with movement controlling spring means, for returning indicator member 210 to its original position when released by the user/owner. In addition, indicator member 210 incorporates an arcuately curved locking zone 226 formed along an edge of support plate 301. As is more fully detailed below, curved locking zone 226 is constructed for engaging with locking spindle 211 whenever key controlled locking section 24 of padlock 20 is employed. In this way, indicator member 210 is locked in the alert displaying position, retained in this position until reset by the user/owner.

Furthermore, locking spindle 211 incorporates radially extending ledge 225 formed at the lower end thereof, while holding block 212 incorporates spring retaining shaft 227, about which spring member 214 is mounted. As shown, spring member 214 preferably comprises radially extending arms 228 and 229, with arm 229 in abutting engagement with housing 21, while arm 228 is in direct contact with abutment wall 222 of indicator member 210.

As a result, the spring forces generated by spring member 214 continuously exerts a biasing force on abutment wall 222 of indicator member 210, attempting to force indicator member 210 into its unactivated position, whenever indicator member 210 has been activated. However, due to the locked engagement of spindle 211 with arcuately curved locking zone 226 after activation, the automatic return of indicator member 210 to its original position is prevented, until positive steps are taken by the user/owner to reset signal/indicator assembly 130. This operation is fully detailed below.

In the preferred construction of this embodiment of the present invention, indicator member 210 is retained within cavity 230 formed in housing 21, with elongated post/shaft 300 retained in channel 303 of housing 21, which is constructed for holding post/shaft 300 in position and enabling post/shaft 300 to arcuately pivot therein. In addition, support disc 307 is pivotally retained in cavity 308, thereby assuring its controlled arcuate pivoting movement.

Locking spindle 211 is mounted in cavity 231 which is constructed for enabling locking spindle 211 to be axially movable therein, with spring member 213 mounted at the bottom of cavity 231, in controlling engagement with locking spindle 211. Finally, holding block 212 is securely mounted in cavity 232 of housing 21 which is constructed for securely retaining holding block 212 and spring member 214 in the manner detailed above.

In FIGS. 64–68, dual locking mode padlock 20 is depicted with this embodiment of automatically initiated signal/indicator of assembly 130 securely mounted therein, and locked in its non-alert state. When in this position, shackle 22 is in locked engagement with housing 21, retained in this locked position by both combination controlled section 23 and key controlled locking section 24. In addition, terminating end portion 305 of indicator member 210 is in its non-alert position, cooperatively aligned with non-alert condition indicia 309. In this position, terminating end portion 305 points directly to indicia 309, immediately informing any observer that padlock 20 is in its "SAFE" mode.

Figure 67:
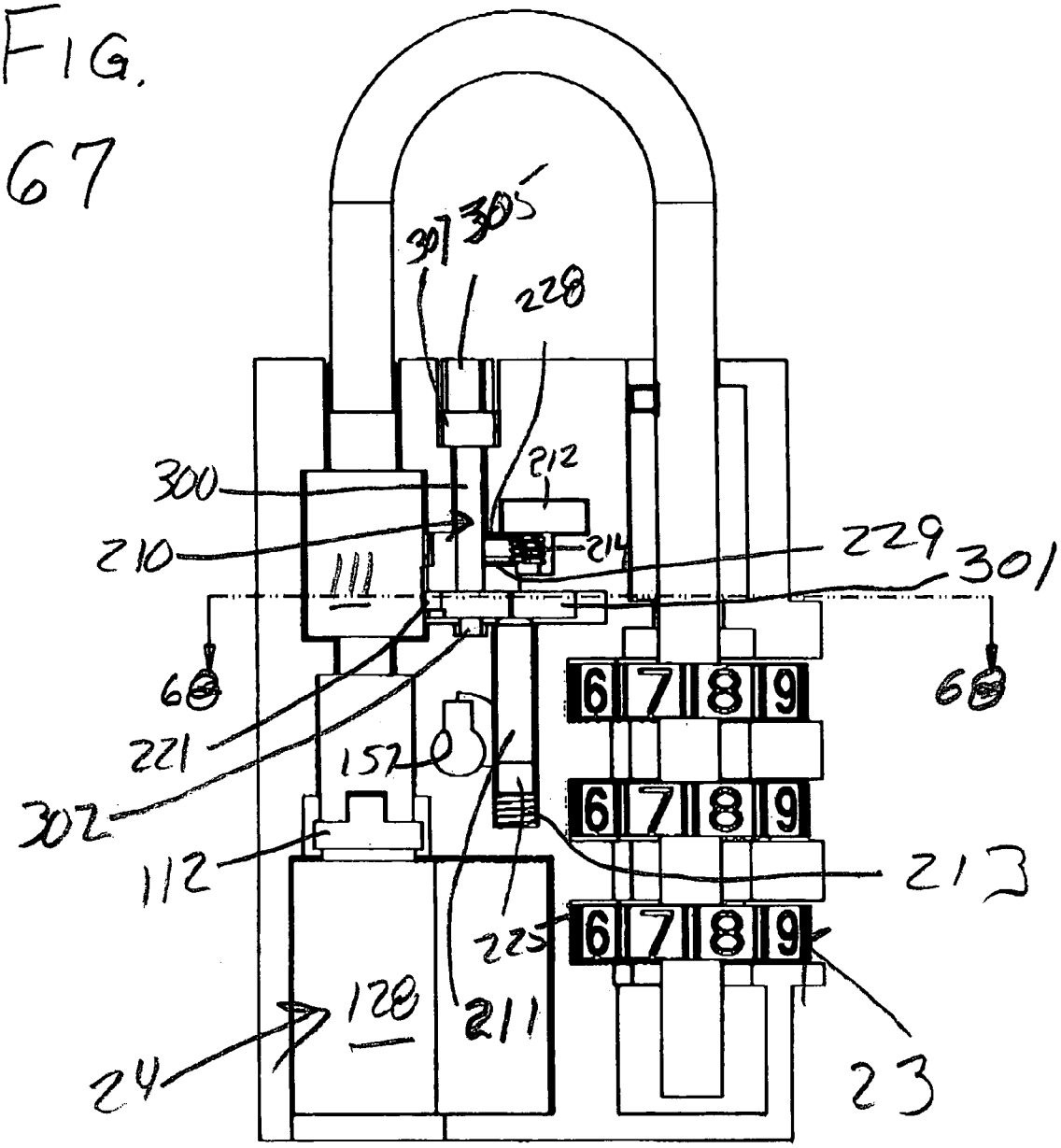
FIG. 67 is a front elevation view of the assembled dual-mode locking padlock incorporating the signal indicator assembly of FIG. 64 shown in the locked mode, with the front panel removed.
Figure 68:
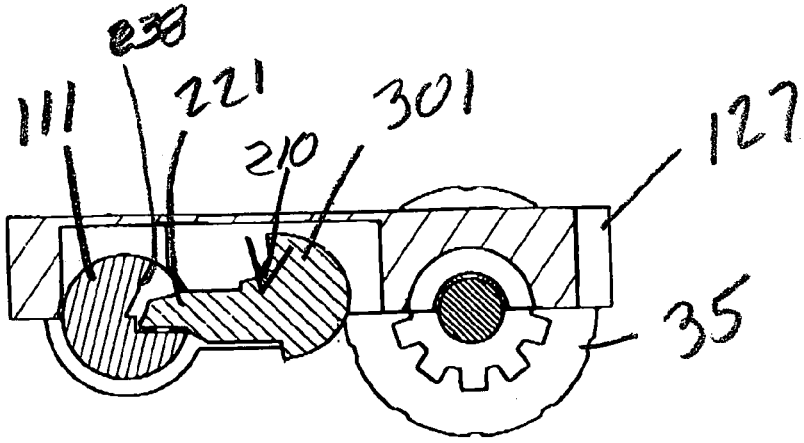
FIG. 68 is a cross-sectional top plan view of the assembled dual-mode locking padlock incorporating the signal indicator taken along line 68—68 of FIG. 67.
Figure 70:
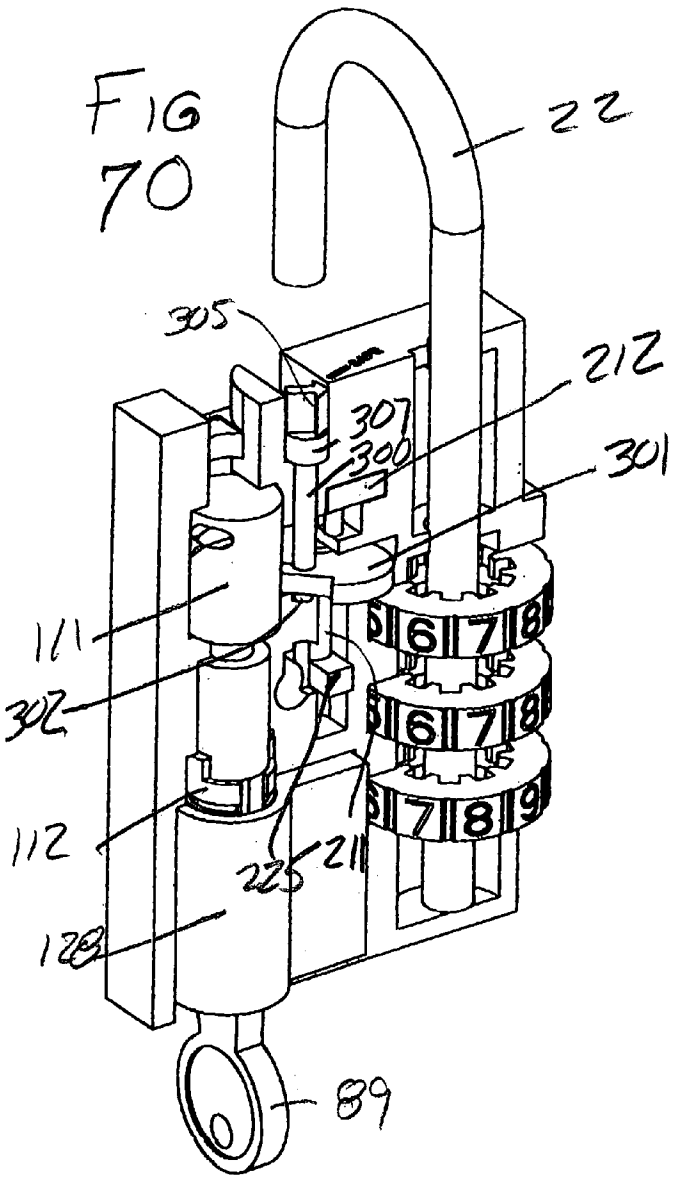
FIG. 70 is a front perspective view of the dual-mode locking padlock incorporating the signal indicator of FIG. 69, shown with the front panel section removed.
Figure 69:
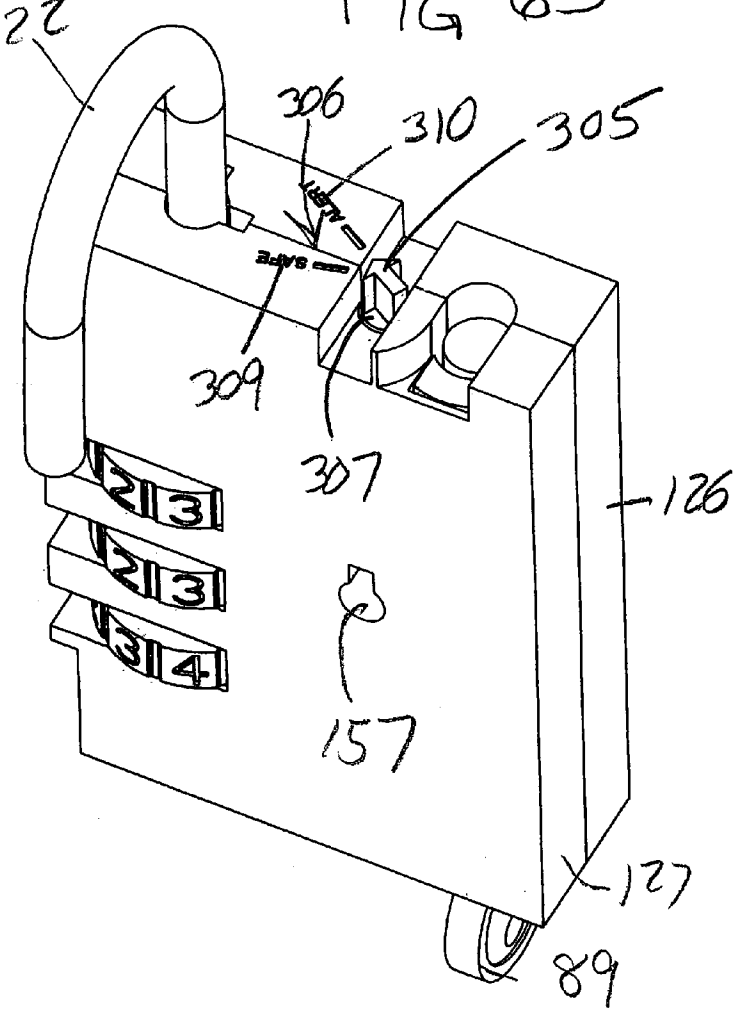
FIG. 69 is a rear elevation view of the dual-mode locking padlock incorporating the signal indicator of FIG. 64, shown fully assembled and after being opened by a key with the indicator assembly activated.
Figure 75:
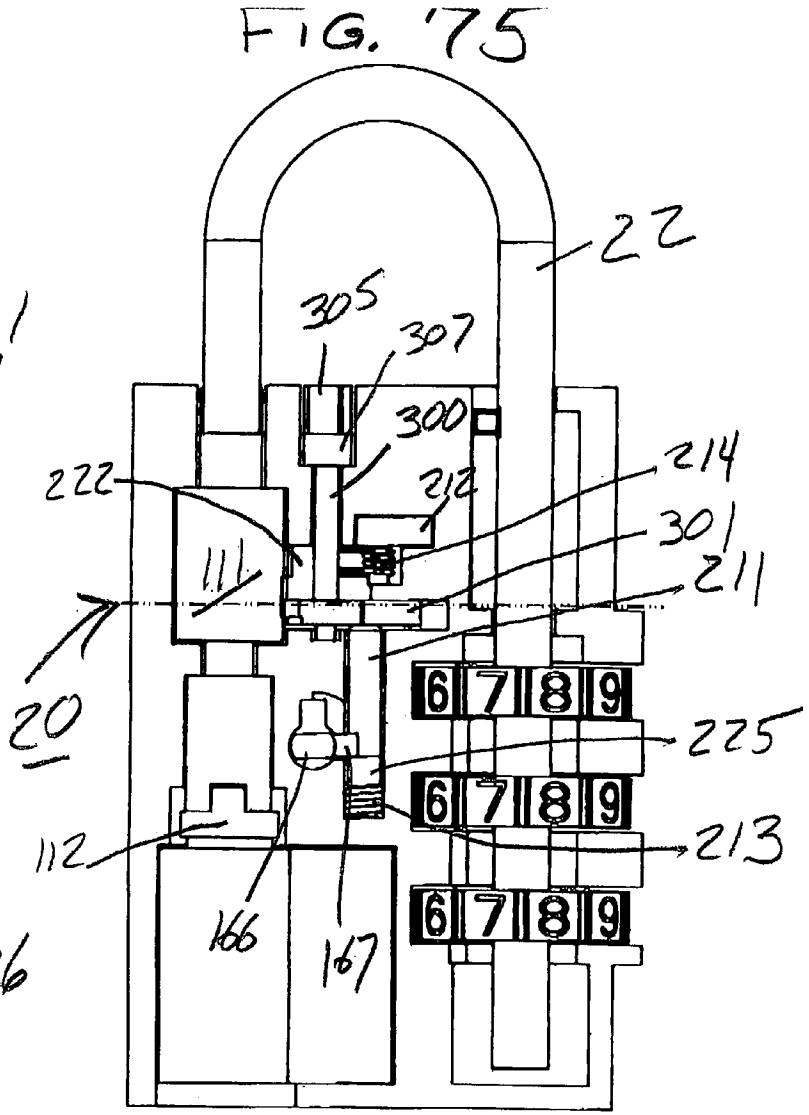
FIG. 75 is a front elevation view of the dual-mode locking padlock incorporating the signal indicator assembly of FIG. 74 and shown with the front panel section removed.
Figure 74:
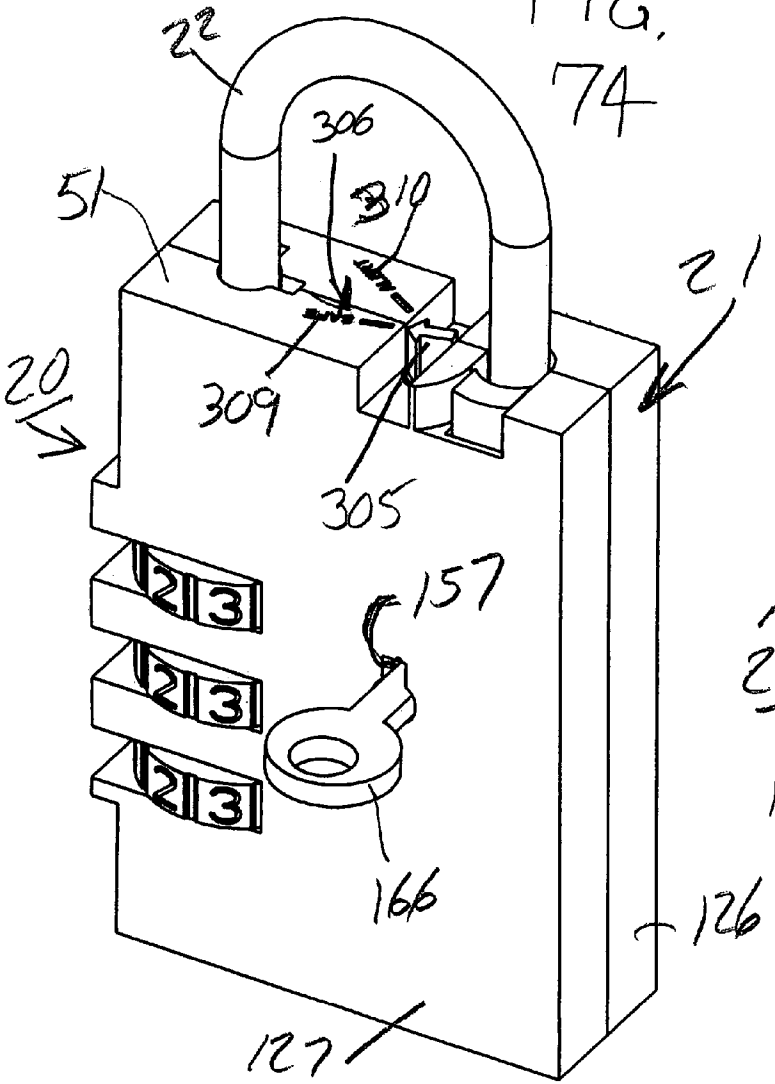
FIG. 74 is a rear perspective view of the dual-mode locking padlock incorporating the signal indicator of FIG. 69 shown in the locked position and in the process of being reset.

In addition, locking spindle 211 is retained within cavity 231 with spring member 213 engaged with the lower end of spindle 211 and fully compressed, ready to move locking spindle 211 upwardly. However, as best seen in FIG. 67, the top edge of locking spindle 211 is engaged with the bottom surface of plate 301 of indicator member 210, thereby preventing any axial movement of locking spindle 211 in spite of the forces being exerted by spring member 213.

In this position, pivot inducing arm member 221 is mounted in arm receiving zone 238 which is formed in cylinder 111. By positioning arm member 221 in receiving zone 238 of cylinder 111, the arcuate pivoting movement of cylinder 111, which is produced whenever key controlled locking section 24 of padlock 20 is employed, forces arm member 221 to arcuately pivot indicator member 210 in its entirety about the axis defined by post/shaft 300.

By referring to FIGS. 69–73, along with the following detailed discussion, the automatic activation of signal/indicator assembly 130 of this embodiment of the present invention can best be understood. As is evident from the foregoing detailed discussion, whenever a product, such as a suitcase, to which padlock 20 has been secured needs to be opened by a third party, such as security personnel, the security personnel is able to use key controlled locking section 24 of padlock 20 by employing key 89. In this regard, key 89 is inserted into cylinder 112 and rotated, thereby causing shackle 22 to be released from locked engagement with housing 21. In addition, however, the arcuate rotation of cylinder 112 also causes signal/indicator assembly 130 to be simultaneously activated, as detailed herein.

In this regard, as stated above, the arcuate movement of cylinder 112 causes cylinder 111 to simultaneously rotate therewith. This pivoting movement also causes arm member 221 to pivot therewith, forcing pivot indicator member 210 to arcuately pivot about the axis defined by post/shaft 300. In addition, the arcuate pivoting movement of indicator member 210 causes shaft 300 and terminating end portion 305 to arcuately pivot, moving end portion 305 into designating association with alert providing indicia 310, clearly indicating the existence of an alert condition.

In addition, arcuately curved locking zone 226 of support plate 301 also simultaneously pivots therewith, causing curved locking zone 226 to extend beyond the position of locking spindle 211. As a result, as soon as locking zone 226 extends beyond cavity 231, within which locking spindle 211 is retained, spring member 213 causes locking spindle 211 to immediately move upwardly, placing locking spindle 211 in secure engagement with arcuately curved locking zone 226 of plate 301. As best seen in FIG. 73, once locking spindle 211 is engaged with curved locking zone 226, indicator member 210 is locked in position, and incapable of being pivoted back to its original position, except by the user/owner.

Furthermore, the pivoting movement of indicator member 210 also causes abutment wall 222 to arcuately pivot which causes radially extending arm 228 of spring member 214 to be forced towards radially extending arm 229. This movement increases the force generated by spring member 214, which attempts to return indicator member 210 to its original position. However, due to the locked interengagement of spindle 211 with locking zone 226 of plate 301, indicator member 210 is incapable of being returned to its original position.

As a result, once indicator member 210 has been activated by the use of key controlled locking section 24, indicator member 210 cannot be returned to its original position, except by using a special reset key, which is in the possession of the user/owner. In this way, the user/owner is assured that the activation of indicator member 210 of signal/indicator assembly 130 will be known to the user/owner, and not reset by any third party.

As is evident from the foregoing detailed discussion, although the third party returns shackle 22 into locked engagement with housing 21, after inspection of the product/suitcase is completed, this action merely causes cylinders 111 and 112 to rotate back to their original positions, with shackle 22 returned to locked engagement with housing 21. However, although cylinders 111 and 112 are returned to their original positions, and key 89 is removed from cylinder 112, the arcuate rotation of the cylinders has no affect on signal/indicator assembly 130, which remains locked in the activated position, as detailed above.

In order to return signal/indicator assembly 130 to its original position, special reset key 166 must be employed. Since reset key 166 is in the possession of the user/owner, only the user/owner is able to return signal/indicator assembly 130 to its original position. As a result, the user/owner is assured that activation of signal/indicator assembly 130 will be evident to the user/owner, and not reset by any third party. By referring to FIGS. 74 and 75, along with the following detailed discussion, the reset operation can best be understood.

In order to return indicator member 210 to its original position, the user/owner must insert reset key 166 into keyhole 157 which is formed in rear panel 127 of housing 21. Once fully inserted into housing 21, reset key 166 is arcuately pivoted, in order to bring radially extending finger 167 of reset key 166 into contact with ledge 225 of locking spindle 211. Once finger 167 contacts ledge 225, key 166 is arcuately pivoted further, causing finger 167 to force ledge 225 downwardly along with locking spindle 211. This arcuate pivoting movement overrides the biasing force of spring member 213, enabling spindle 211 to move downwardly in cavity 231.

As locking spindle 211 is moved downwardly, the upper end of spindle 211 is removed from holding engagement with arcuately curved locking zone 226 of indicator member 210. Once locking spindle 211 is completely clear of locking zone 226 of indicator member 210, the biasing forces generated by spring member 214 on abutment wall 222 of indicator member 210 forces indicator member 210 to automatically arcuately rotate back to its original position.

Once in its original position, indicator member 210 overlies locking spindle 211, causing locking spindle 211 to be secured in its original position below indicator member 210. When this position has been attained, reset key 166 can be removed from keyhole 157, with complete assurance that indicator member 210 and the entire signal/indicator assembly 130 is secured in its original position, ready for being activated at the appropriate time.

As is evident from the foregoing detailed discussion, the embodiment of the present invention depicted in FIGS. 64–75 provides an effective and reliable signal/indicator system which is automatically activated whenever the key controlled locking section padlocked is employed. Furthermore, once the signal/indicator assembly has been activated, the signal/indicator can only be returned to its original position by the user/owner. In addition, in each of these embodiments, the user/owner is able to reset the signal/indicator assembly without any regard to the locked or unlocked condition of padlock 20. As a result, all of the embodiments of this invention enable the user/owner to reset the signal/indicator assembly while padlock 20 is in a fully locked and secured configuration.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

Having described our invention, what we claim as new and desire to secure by Letters Patent is:

1. A padlock constructed for providing two separate and independent locking means in a single, integrated construction, with a first locking assembly being controlled by a combination and a second locking assembly being key controlled, said padlock comprising:

A. a housing or cover incorporating a combination controlled locking section and a key controlled locking section said key controlled locking section being further defined as comprising at least one cylinder mounted therein for arcuate pivoting movement relative to the housing/cover in response to the receipt and use of an activating key, with the arcuate pivoting movement of said cylinder being constructed for releasing a shackle from locked engagement with the housing/cover;

B. said shackle cooperatively associated with the housing/cover and movable between a first lockingly engaged position and a second unlocked, released position, wherein said second position is attainable using either the combination controlled section or the key controlled section;

C. a signal/indicator assembly a. mounted in the housing/cover in cooperating relationship with the key controlled section and responsive to the use of the key controlled section for being movable from a first non-alert position to a second alert-providing position in response to the use of the key controlled locking section for opening the padlock, and b. comprising an elongated rod or shaft 1. mounted in the housing/cover in juxtaposed, adjacent, spaced, axial relationship to the cylinder, 2. extending outwardly from the housing/cover a fixed axial distance, defining an outwardly extending portion and forming an alert providing indicator, 3. constructed for arcuate pivoting movement about its central axis in response to the use of the key controlled section, and movable between a first non-alert providing position and a second alert-providing position without being axially movable, and 4. comprising a radially extending arm mounted for cooperative engagement with said rod/shaft, with said arm being constructed for controlled movement with the arcuate pivoting movement of said cylinder, thereby causing said rod/shaft to arcuately pivot simultaneously therewith; and c. comprising locking means for maintaining the indicator member in its second alert-providing position, said locking means being responsive to the use of a reset key for enabling the indicator member to be replaced in its first non-alert position; and 1. comprising a locking plate mounted to the rod/shaft and pivotally movable in the housing/cover in response to the arcuate pivoting movement of said radially extending arm; and 2. cooperating with an axially movable, spring biased shaft mounted in an elongated cavity formed in said housing/cover, with the first end of said shaft being in contact with the locking plate and in juxtaposed relationship with a shaft receiving zone formed in the locking plate, whereby movement of the indicator member from its first position to its second position causes the shaft receiving zone to be axially aligned with the spring biased shaft, for enabling the shaft to move into locking engagement with the receiving zone, thereby assuring that the indicator member is secured in its second, alert-providing position when activated; and D. a reset key cooperatively associated with the padlock for being inserted into the housing/cover after movement of the signal/indicator assembly into its second position and arcuately pivoting therein for causing the signal/indicator assembly to be returned to its first position.

2. The padlock defined in claim 1, wherein the reset key can be employed for returning the signal/indicator assembly from its second position to its first position when the padlock and shackle are in locked engagement with each other.

3. The padlock defined in claim 1, wherein said signal/indicator assembly is further defined as comprising a substantially cylindrically shaped indicator member incorporating alert-providing indicia formed thereon and being movable between a first non-alert providing position and a second alert-providing position wherein said indicia is readily visible, said indicator member being mounted outwardly from the housing/cover and constructed for being arcuately pivotable about its central axis in response to the arcuate movement of said cylinder, said arcuate pivoting movement causing said indicator member to pivot into its second position for displaying said alert-proving indicia.

4. The padlock defined in claim 3, wherein said cylindrically shaped indicator member is further defined as comprising a radially extending arm mounted for cooperative engagement with said cylinder, with said arm being constructed for controlled movement with the arcuate pivoting movement of said cylinder, thereby causing said indicator member to arcuately pivot simultaneously therewith.

5. The padlock defined in claim 4, wherein said signal/indicator assembly further comprises locking means for maintaining the indicator member in its second alert-providing position, said locking means being responsive to the use of a reset key for enabling the indicator member to be replaced in its first non-alert position.

6. The padlock defined in claim 5, wherein the signal/indicator assembly is further defined as comprising a returning spring member cooperatively associated with the indicator member for automatically returning the indicator member to its first position whenever the reset key is employed to disengage the shaft from the shaft receiving zone of the locking plate.

7. The padlock defined in claim 1, wherein the outwardly extending portion of the rod/shaft is further defined as being cooperatively associated with a display area formed on a surface of the housing/cover and constructed for providing a non-alert signal and an alert signal in response to the arcuate movement of said rod/shaft.

8. The padlock defined in claim 7, wherein the display area formed on the surface of the housing/cover comprises indicia for designating a non-alert condition and an alert condition and the outwardly extending portion of the rod/shaft comprises a condition indicator or pointer movable between the non-alert condition indicia when in its first position and the alert condition indicia when in its second position, thereby providing the desired readily seen, highly visible notification.

9. A padlock constructed for providing two separate and independent locking means in a single, integrated construction, with a first locking assembly being controlled by a combination and a second locking assembly being key controlled, said padlock comprising:

A. a housing or cover incorporating a. a first elongated bore, and a second elongated bore, b. plurality of dial receiving zones formed in the housing/cover in association with the first elongated bore, and c. an elongated release channel formed in the first elongated bore and axially extending therewith, said elongated release channel defining a zone for enabling the opening of the combination controlled lock assembly;

B. said shackle comprising a generally j-shape, incorporating a. a short leg having a terminating end constructed for cooperative locking and unlocking interengagement with a holding collar mounted in the housing/cover, and b. a long leg cooperatively mounted in the first elongated bore of the housing/cover for axial movement and pivoting movement relative thereto;

C. a key controlled lock assembly mounted in the second elongated bore of the housing/cover and constructed for being responsive to a designated key member for enabling movement between a first position, wherein the shackle is in locked engagement, and a second position, wherein the shackle is unlocked and movable, said lock assembly comprising:

a. a cylinder assembly 1. mounted in the second elongated bore for controlled rotational movement therein, and 2. incorporating a key receiving slot cooperatively associated with a plurality of tumblers for preventing the rotational movement of said cylinder whenever the designated key member is not present and enabling rotational movement of the cylinder in response to the presence of the designated key member, and b. a shackle engaging collar cooperatively associated with the terminating end of the short leg of the shackle and responsive to the rotational movement of the cylinder for preventing movement of the shackle when in a first position and enabling movement of the shackle when the cylinder assembly is in a second position;

D. a signal/indicator system a. mounted in the housing/cover in cooperating relationship with the key controlled section and responsive to the use of the key controlled section for activation thereof, b. comprising an alert-providing indicator member 1. at least partially mounted in the housing/cover in spaced relationship to the cylinder and positioned adjacent to the cylinder for cooperating therewith, 2. incorporating a radially extending arm constructed for controlled pivoting movement of the indicator member in response to the arcuate pivoting movement of the cylinder causing the indicator member to move between a first non-alert position, and a second alert-providing position wherein a portion of said indicator member extends outwardly from the housing/cover for providing positive notice that the key controlled locking section was used;

3. comprising an elongated rod mounted in the housing/cover for pivotal movement therein, said rod being incapable of axial movement and comprising a portion extending outwardly from the housing/cover a fixed axial length, said axially extending portion forming the alert-providing indicator arcuately movable between a first non-alert providing position and a second alert-providing position; and 4. comprising a locking plate i. mounted to the rod and pivotally movable in the housing/cover in response to the arcuate pivoting movement of said radially extending arm, and ii. cooperating with an axially movable, spring biased shaft mounted in an elongated cavity formed in said housing/cover, the first end of said shaft being in contact with the locking plate in and juxtaposed relationship with a shaft receiving zone formed in the locking plate, whereby movement of the indicator member from its first position to its second position causes the shaft receiving zone to be axially aligned with the spring biased shaft, for enabling the shaft to move into locked engagement with the receiving zone, thereby assuring that the indicator member is secured in its second, alert-providing position when activated.

10. The padlock defined in claim 9, wherein said alert-providing indicator member is further defined as being locked in its second alert-providing position after activation, requiring the use of a reset key for returning said alert-providing indicator member to its first position.

11. The padlock defined in claim 9, wherein the signal/indicator system is further defined as comprising a returning spring member cooperatively associated with the indicator member for automatically returning the indicator member to its first position in response to the use of a reset member employed to disengage the shaft from the shaft receiving zone of the locking plate.

12. The padlock defined in claim 9, wherein said alert-providing indicator member is further defined as comprising a flat plate pivotally mounted in the housing/cover and fully retained within the housing/cover when in a first position, with a portion of said flat plate being constructed for extending outwardly from the housing/cover when in a second position for providing positive notice whenever the key control locking section was used.

13. The padlock defined in claim 12, wherein said indicator member comprises an enlarged alert providing display zone formed on said outwardly extending portion, said display zone constructed for being fully retained in the housing/cover when in its first non-alert position and for extending outwardly from the housing/cover when in its second alert-providing position.

14. The padlock defined in claim 13, wherein said indicator member comprises locking means for maintaining the indicator member in its second alert-providing position, said locking means being responsive to the use of a reset member for enabling the indicator member to return to its non-alert position.

15. The padlock defined in claim 13, wherein said locking means is further defined as comprising an axially movable, spring biased shaft mounted in an elongated cavity formed in said housing/cover, with first end of said shaft being in contact with the indicator member and in juxtaposed relationship with a shaft receiving zone formed in the indicator member, whereby movement of the indicator member from its first position to its second position causes the shaft receiving zone to be axially aligned with the spring biased shaft, for enabling the shaft to move into locking engagement with the receiving zone.

16. The padlock defined in claim 13, wherein the indicator member is further defined as comprising a slot formed therein and said locking means is further defined as comprising a spring member mounted to the housing/cover in cooperating association with the indicator member and constructed for lockingly engaging the slot of the indicator member when the indicator member is moved into its second, alert-providing position, thereby assuring that the indicator member is secured in its second, alert-providing position when activated.

17. The padlock defined in claim 16, wherein the locking means is further defined as comprising a returning spring member cooperatively associated with the indicator member for automatically returning the indicator member to its first position whenever the reset member is employed to disengage the spring member from the slot.

18. A padlock constructed for providing two separate and independent locking means in a single, integrated construction, with a first locking assembly being controlled by a combination and a second locking assembly being key controlled, said padlock comprising:

A. a housing/cover a. incorporating a combination controlled locking section and a key controlled locking section said key controlled locking section being further defined as comprising at least one cylinder mounted therein for arcuate pivoting movement relative to the housing/cover in response to the receipt and use of an activating key, with the arcuate pivoting movement of said cylinder being constructed for releasing a shackle from locked engagement with the housing/cover, B. said shackle cooperatively associated with the housing/cover and movable between a first lockingly engaged position and a second unlocked, released position, wherein said second position is attainable using either the combination controlled section or the key controlled section;

C. a signal/indicator assembly a. mounted in the housing/cover in cooperating relationship with the key controlled section and responsive to the use of the key controlled section for being movable from a first non-alert position to a second alert-providing position in response to the use of the key controlled locking section for opening the padlock, and b. comprising an elongated rod or shaft 1. extending outwardly from the housing/cover a fixed axial distance for defining an outwardly extending portion and forming an alert providing indicator, and 2. constructed for arcuate pivoting movement about its central axis in response to the use of the key controlled section, and movable between a first non-alert providing position and a second alert-providing position;

3. comprising a radially extending arm mounted for cooperative engagement with said rod/shaft, with said arm being constructed for controlled movement with the arcuate pivoting movement of said cylinder, thereby causing said rod/shaft to arcuately pivot simultaneously therewith, and c. comprising a locking plate mounted to the rod/shaft and pivotally movable in the housing/cover in response to the arcuate pivoting movement of said radially extending arm; and D. a reset key cooperatively associated with the padlock for being inserted into the housing/cover after movement of the signal/indicator assembly into its second position and arcuately pivoting therein for causing the signal/indicator assembly to be returned to its first position wherein the housing/cover further comprising a reset key receiving aperture formed therein and constructed for receiving the reset key and positioning the reset key to engage the indicator member for enabling the return of said indicator to said first position; and wherein the signal/indicator assembly further comprises a locking means for maintaining the indicator member in its second alert-providing position, said locking means being responsive to the use of the reset key for enabling the indicator member to be replaced in its first non-alert position.

* * * * *